US010799420B2

(12) United States Patent
Ishibashi

(10) Patent No.: US 10,799,420 B2
(45) **Date of Patent: *Oct. 13, 2020**

(54) PORTABLE ROLLER MASSAGER

(71) Applicant: Jeanette Hong Ishibashi, Los Gatos, CA (US)

(72) Inventor: Jeanette Hong Ishibashi, Los Gatos, CA (US)

( * ) Notice: Subject to any disclaimer, the term of this patent is extended or adjusted under 35 U.S.C. 154(b) by 149 days.

This patent is subject to a terminal disclaimer.

(21) Appl. No.: 15/842,141

(22) Filed: Dec. 14, 2017

(65) Prior Publication Data

US 2018/0104140 A1 Apr. 19, 2018

Related U.S. Application Data

(63) Continuation of application No. 14/463,414, filed on Aug. 19, 2014, now Pat. No. 9,849,060.
(Continued)

(51) Int. Cl.
*A61H 15/00* (2006.01)

(52) U.S. Cl.
CPC . *A61H 15/0092* (2013.01); *A61H 2015/0021* (2013.01); *A61H 2201/0107* (2013.01);
(Continued)

(58) Field of Classification Search
CPC ..... A61H 15/00; A61H 15/0085; A61H 15/0092; A61H 2015/0007; A61H 2015/0014; A61H 2015/0021; A61H 2015/0028; A61H 2015/0035; A61H 2015/005; A61H 2015/0064; A61H 2201/0153; A61H 2201/0157; A61H 2201/161; A61H 2201/01; A61H 2201/0107; A63B 21/4033; A63B 21/4035; A63B 2210/00; A63B 2210/50; A63B 2210/58; B25G 1/00; B25G 1/04; B25G 1/06; B25G 1/085; B25G 3/00; B25G 3/02; B25G 3/04; Y10T 16/469
(Continued)

(56) References Cited

U.S. PATENT DOCUMENTS 3,636,945 A 1/1972 Sato
4,378,007 A 3/1983 Kachadourian
(Continued)

OTHER PUBLICATIONS

Notice of Allowance corresponding to U.S. Appl. No. 29/499,873, dated Jan. 2, 2015, 8 pages.
(Continued)

*Primary Examiner* — Colin W Stuart
*Assistant Examiner* — Douglas Y Sul
(74) *Attorney, Agent, or Firm* — Lathrop GPM LLP

(57) ABSTRACT

A portable roller massager includes an elongate center shaft having a longitudinal axis extending between a first end and a second end, a roller section rotatably positioned about an outer surface of the elongate center shaft and extending not entirely between the first and second ends, a first handle member movably attachable to the first end of the elongate center shaft, and a second handle member movably attachable to the second end of the elongate center shaft. The elongate center shaft, roller section, first handle member, and second handle member cooperate to form a portable roller massager for massaging and treating a person's muscles.

20 Claims, 51 Drawing Sheets

Related U.S. Application Data

(60) Provisional application No. 61/988,734, filed on May 5, 2014, provisional application No. 61/928,971, filed on Jan. 17, 2014.

(52) U.S. Cl.
CPC ..... *A61H 2201/0161* (2013.01); *A61H 2201/1685* (2013.01)

(58) Field of Classification Search
USPC ..... 81/489–492; 16/111.1
See application file for complete search history.

(56) References Cited

U.S. PATENT DOCUMENTS

| | | | | |
|---|---|---|---|---|
| D271,051 | S | 10/1983 | McCoy et al. | |
| 4,433,683 | A * | 2/1984 | McCoy | A63B 21/05 601/120 |
| 4,453,698 | A | 6/1984 | DeFrees | |
| 4,483,356 | A | 11/1984 | Kales | |
| 4,608,968 | A | 9/1986 | Rosofsky | |
| 4,752,072 | A | 6/1988 | Parsons | |
| 4,878,489 | A | 11/1989 | Kamayachi | |
| 4,945,900 | A * | 8/1990 | Masuda | A61H 15/0092 601/120 |
| 4,993,408 | A | 2/1991 | Schweisfurth | |
| D345,610 | S | 3/1994 | Shih | |
| D347,898 | S | 6/1994 | Belcher | |
| 5,766,210 | A | 6/1998 | Komoroczy et al. | |
| D398,400 | S | 9/1998 | Havelind | |
| D417,319 | S | 11/1999 | Weiss, Jr. | |
| 6,267,738 | B1 | 7/2001 | Louis | |
| D446,308 | S | 8/2001 | Schmitmeyer | |
| D448,851 | S | 10/2001 | Louis | |
| D495,422 | S | 8/2004 | Chen | |
| 6,830,552 | B1 | 12/2004 | Gonzalez | |
| D623,310 | S | 9/2010 | Cheng | |
| D648,034 | S | 11/2011 | Rice | |
| D704,852 | S | 5/2014 | Yang | |
| 9,168,196 | B2 | 10/2015 | Dagan | |
| 9,849,060 | B2 * | 12/2017 | Ishibashi | A61H 15/0092 |
| 2006/0142677 | A1 | 6/2006 | Perez | |
| 2011/0024541 | A1 | 10/2011 | L'Homme et al. | |
| 2013/0090582 | A1 | 4/2013 | Bertram et al. | |
| 2013/0096472 | A1 * | 4/2013 | Bertram | A61H 15/0092 601/120 |
| 2014/0128786 | A1 * | 5/2014 | Ross | A61H 15/0092 601/118 |
| 2015/0374576 | A1 * | 12/2015 | Dagan | A61H 7/003 601/119 |

OTHER PUBLICATIONS

The Stick Store (Copyright 2011 ). Accessed on the Internet Apr. 29, 2015, https://www.thestick.com, 2 pages.

GoFit, Extreme Massage Bar, Accessed on the Internet Jul. 13, 2015, http://store.gofit.net/GoFit-Massage-Bar-p/gf-emb.htm, 2 pages.

TigerTail, Accessed on the Internet Jul. 13, 2015, http://www.tigertailusa.com/pages/the-collection, 1 page.

Rogue Fitness, Beastie Bar, Accessed on the Internet Jul. 13, 2015, http://www.roguefitness.com/beastie-bar, 1 page.

ATC Medical, Thera-Band Roller Massager Plus, accessed on the Internet, Jul. 25, 2015: http://www.atcmedical.com/Aids_To_Daily_Living/Aids_Miscellaneous/TheraBand_Roller_Massager_Portable/TB11756/product.aspx?utm source=nextag&utm medium=cse &utm term= TB11756, 1 page.

* cited by examiner

O-RING GROOVES ACCEPT STANDARD METRIC 8X2MM BUNA-N RUBBER O-RINGS

ROLLER STOP

O-RING GROOVES ACCEPT STANDARD METRIC 8X2MM BUNA-N RUBBER O-RINGS

INNER HANDLE SECTION A-A

OUTER HANDLE SECTION A-A

PORTABLE ROLLER MASSAGER

RELATED APPLICATIONS

This application is a continuation of U.S. patent application Ser. No. 14/463,414, titled "Portable Roller Massager", filed Aug. 19, 2014, which claims priority to U.S. Patent Application Ser. No. 61/928,971, titled "Portable Roller Massager", filed Jan. 17, 2014, and to U.S. Patent Application Ser. No. 61/988,734, titled "Portable Roller Massager", filed May 5, 2014, each of which is incorporated herein by reference.

FIELD OF THE INVENTION

The present disclosure generally relates to a therapeutic device. More specifically, it pertains to a portable massager for treating a person's musculature.

BACKGROUND

Massage has long been used to treat tight, stiff, and injured muscles. Athletes and exercise aficionados have turned to massage to improve performance and ease aching muscles. Hand held massage devices were developed to provide massage in an inexpensive and timely manner. One type of hand held massage device is a wand that is rolled over a person's muscles to treat the ailments and provide improvements of strength, flexibility, and endurance, dispersal of lactic acid, and accelerated recovery. However, these devices are quite long and are not designed for a user to carry during travel or exercise.

SUMMARY OF THE INVENTION

In one embodiment, a portable roller massager includes an elongate center shaft having a longitudinal axis extending between a first end and a second end, a roller section rotatably positioned about an outer surface of the elongate center shaft and extending not entirely between the first and second ends, a first handle movably attachable to the first end of the elongate center shaft, and a second handle movably attachable to the second end of the elongate center shaft. The elongate center shaft, roller section, first handle, and second handle cooperate such that manual operation of the handles causes rotation of the roller section when applied to a body during massage.

In another embodiment, a portable roller massager includes an elongate center shaft having a longitudinal axis extending between a first end and a second end, a roller section rotatably positioned about an outer surface of the elongate center shaft and extending not entirely between the first and second ends, a first handle member movably attachable to the first end of the elongate center shaft, and a second handle member movably attachable to the second end of the elongate center shaft. The elongate center shaft, roller section, first handle member, and second handle member cooperate such that manual operation of the handles causes rotation of the roller section when applied to a body during massage.

In another embodiment, a portable roller massager includes a shaft having a longitudinal axis extending from a first end to a second end. A first groove is formed about the longitudinal axis of the first end, and a second groove is formed about the longitudinal axis of the second end. A first detent is positioned about the first groove and a second detent is positioned about the second groove. A roller section is rotatably positioned about an outer surface of the shaft and extends not entirely between the first and second ends of the shaft. A first roller stop is positioned on the shaft at the first end and a second roller stop is positioned on the shaft at the second end to retain the roller section on the shaft. An outer handle removably attaches to the first end of the shaft and is retained by the first detent, and an inner handle removably attaches to the second end of the shaft and is retained by the second detent. The shaft, first detent, second detent, roller section, first roller stop, second roller stop, outer handle, and inner handle cooperate such that manual operation of the handles causes rotation of the roller section when applied to a body during massage.

In another embodiment, a portable roller massager includes a shaft, a roller section, a first and second roller stops, and first and second handles. The shaft has a longitudinal axis extending from a first end to a second end. The roller section is rotatably positioned about an outer surface of the shaft and extends not entirely between the first and second ends. The first roller stop is positioned on the shaft at the first end and the second roller stop is positioned on the shaft at the second end to retain the roller section on the shaft. The first handle removably attaches to the first end of the shaft. The second handle removably attaches to the second end of the shaft. The shaft, roller section, first roller stop, second roller stop, first handle, and second handle cooperate such that manual operation of the handles causes rotation of the roller section when applied to a body during massage.

In another embodiment, a portable roller massager includes a shaft, a roller section, a roller stop, an inner handle, and an outer handle. The shaft has a longitudinal axis extending from a first end to a second end. The roller section is rotatably positioned about an outer surface of the shaft and extends not entirely between the first and second ends. The roller stop positioned on the shaft at the first end and the roller stop and shape of the second end retains the roller section on the shaft. The inner handle movably attaches to the first end of the shaft and the outer handle is retained by the shape of the second end of the shaft. The shaft, roller section, roller stop, and handles cooperate such that manual operation of the handles causes rotation of the roller section when applied to a body during massage In another embodiment, a portable roller massager includes a shaft, a roller section, an inner handle, and an outer handle. The shaft has a longitudinal axis extending from a first detent to a second detent. The roller section is rotatably positioned about an outer surface of the shaft and extends not entirely between the first and second detents. The inner handle is retained by a first shape of a first end of the shaft and is secured by the first detent. The outer handle is retained by a second shape of a second end of the shaft and is secured in position by the second detent. The shaft, roller section, and handles cooperate such that manual operation of the handles causes rotation of the roller section when applied to a body during massage.

In another embodiment, a portable roller massager includes a shaft, a roller section, a raised ring, a first roller stop, a second roller stop, a first handle, and a second handle. The shaft has a longitudinal axis extending from a first end to a second end. The roller section is rotatably positioned about an outer surface of the shaft and extends not entirely between the first and second ends. The raised ring is positioned centrally to and about the roller section and optionally has a textured outer surface. The first roller stop is positioned at the first end and the second roller stop is positioned at the second end. The first and second roller stops retain the roller section on the shaft. The first handle removably attaches to the first end and the second handle removably attaches to the second end. The shaft, roller section, raised ring, first roller stop, second roller stop, first handle, and second handle cooperate such that manual operation of the handles causes rotation of the roller section when applied to a body during massage.

Detent Connection

Figure 17:
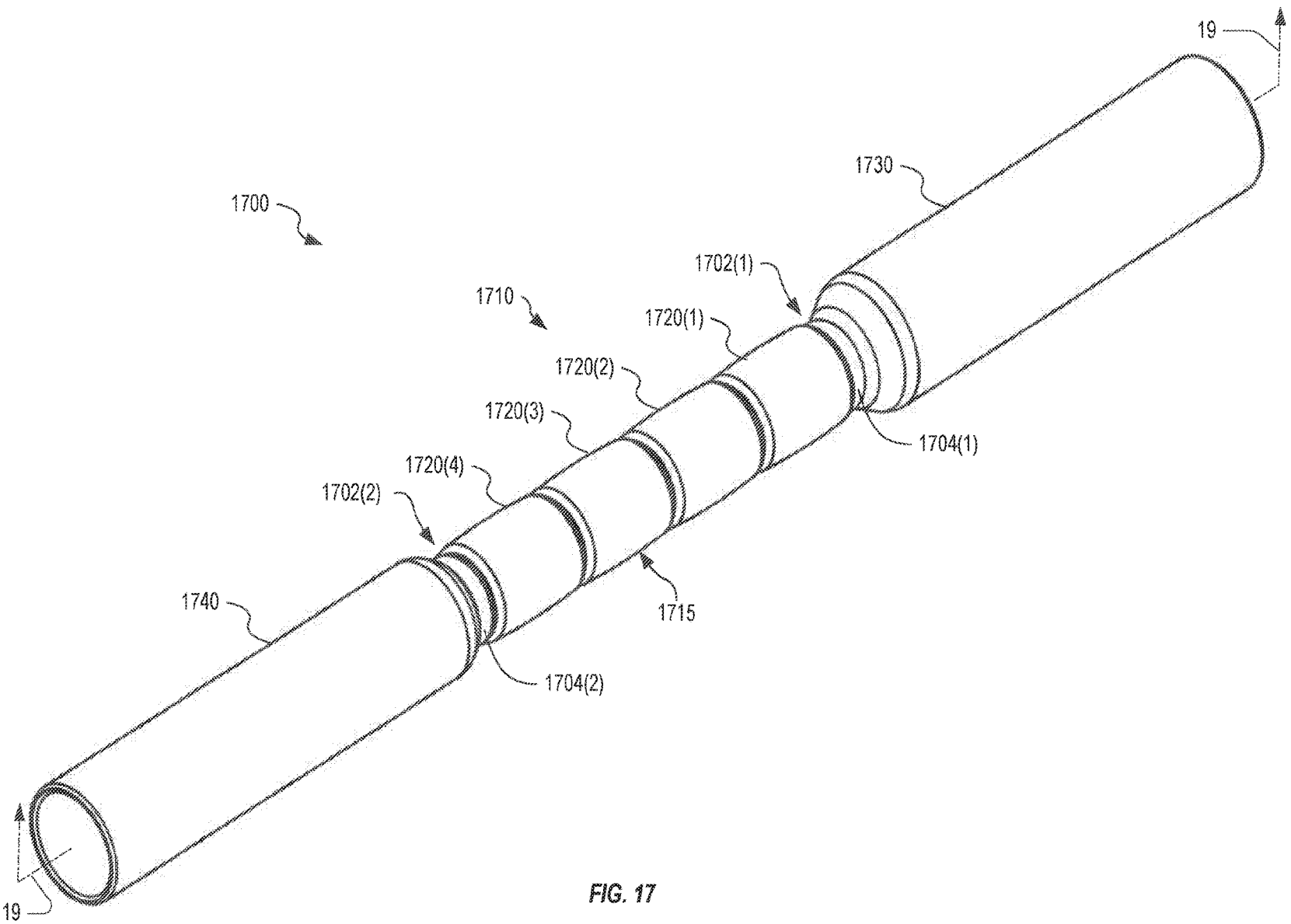

FIG. 17 is a perspective view illustrating one exemplary portable roller massager with a detent push-to-connect connection, in accordance with an embodiment of the disclosure.

Figure 18:
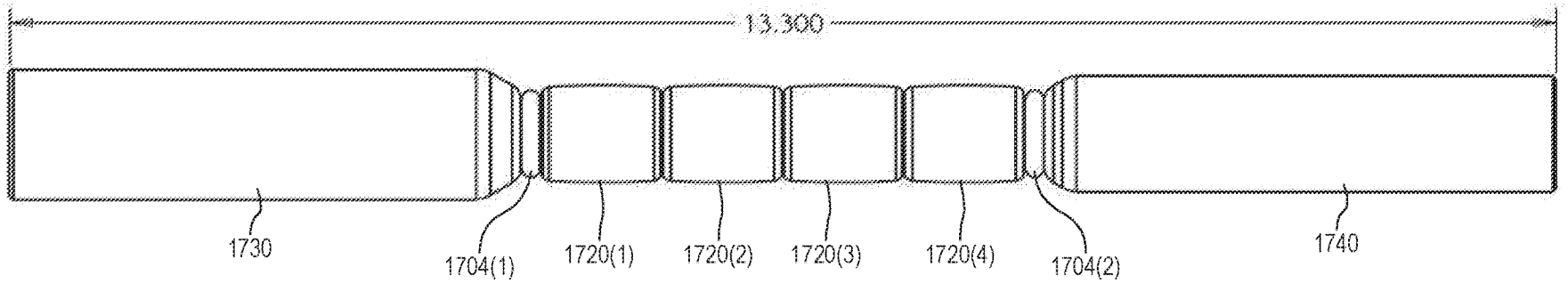

FIG. 18 is a front elevation of the portable roller massager of FIG. 17.

Figure 19:
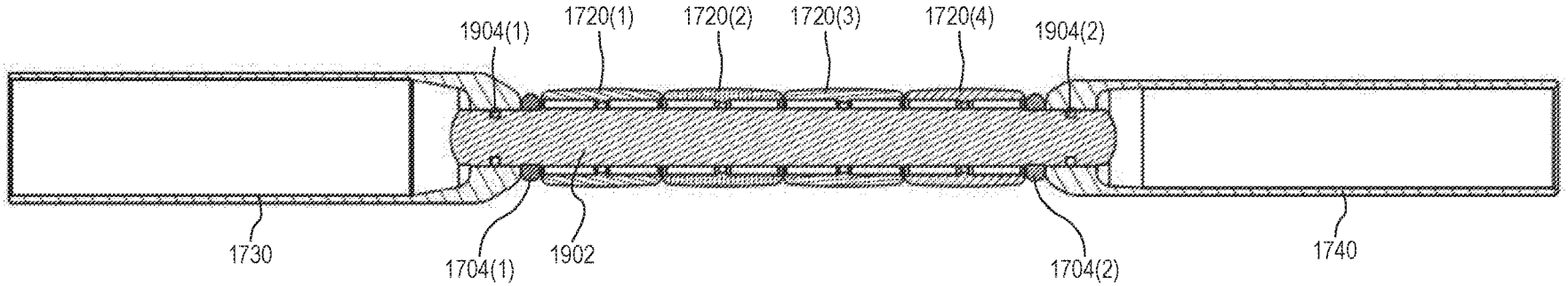

FIG. 19 is a cross section through the portable roller massager of FIG. 17.

Figure 22:
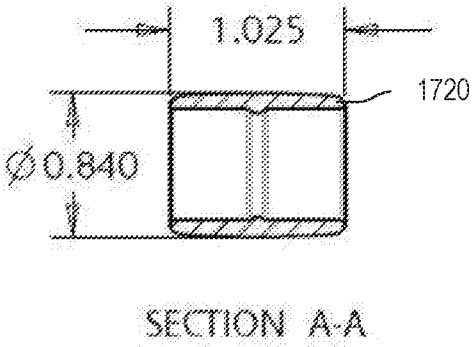
Figure 21:
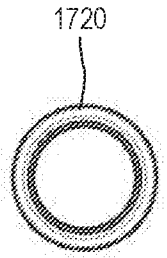
Figure 20:
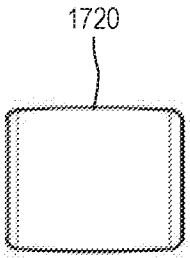

FIGS. 20, 21, and 22 shows one exemplary roller section of the portable roller massager of FIG. 17.

Figure 23:
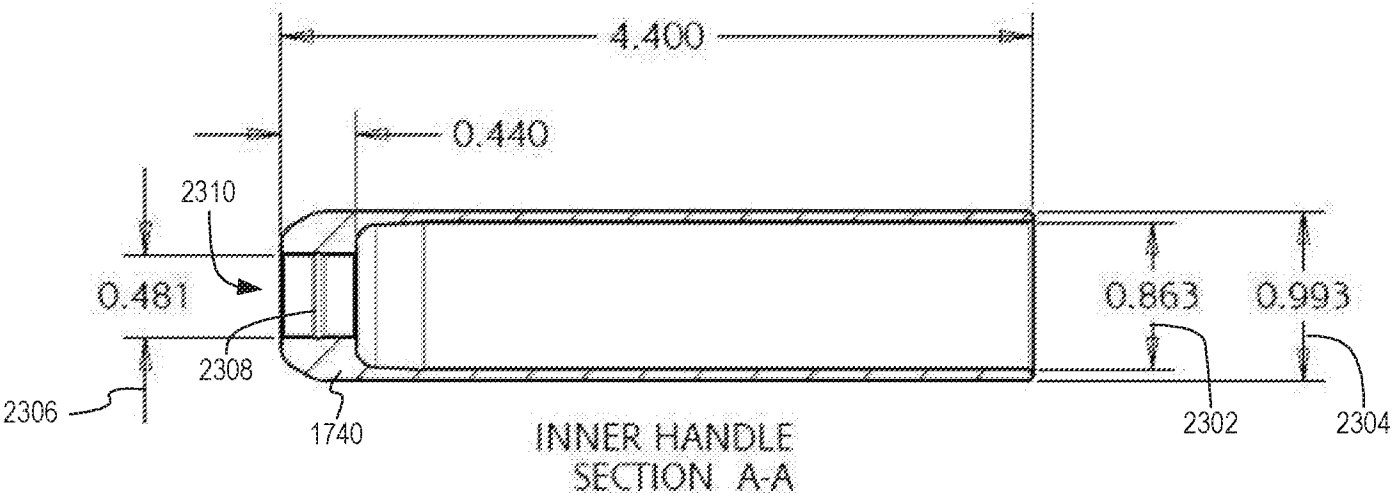

FIG. 23 is a cross-section through the inner handle of the portable roller massager of FIG. 17.

Figure 24:
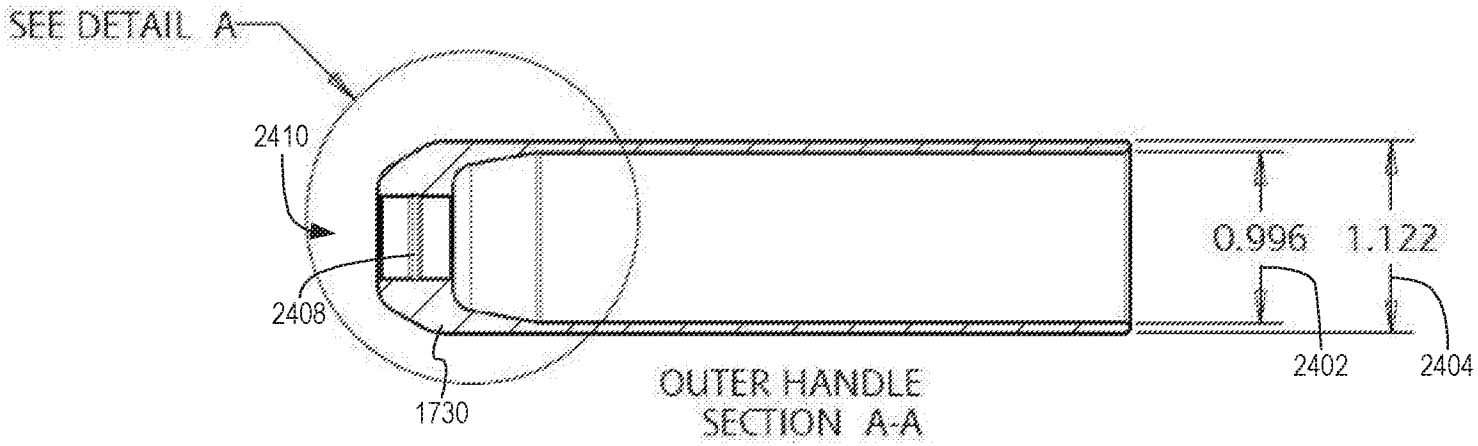

FIG. 24 is a cross-section through the outer handle of the portable roller massager of FIG. 17.

Figure 25:
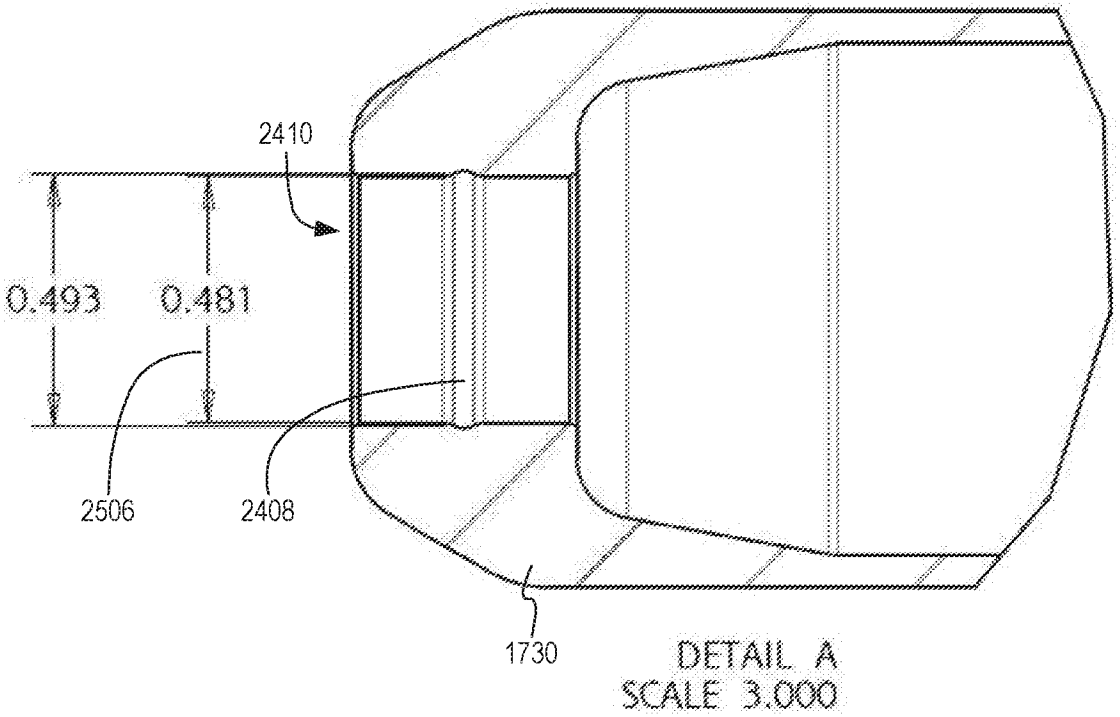

FIG. 25 is a cross-section showing greater detail of the outer handle of FIG. 23 illustrating the detent groove within the aperture for receiving the detent to removably secure the outer handle to the shaft.

Figure 26:
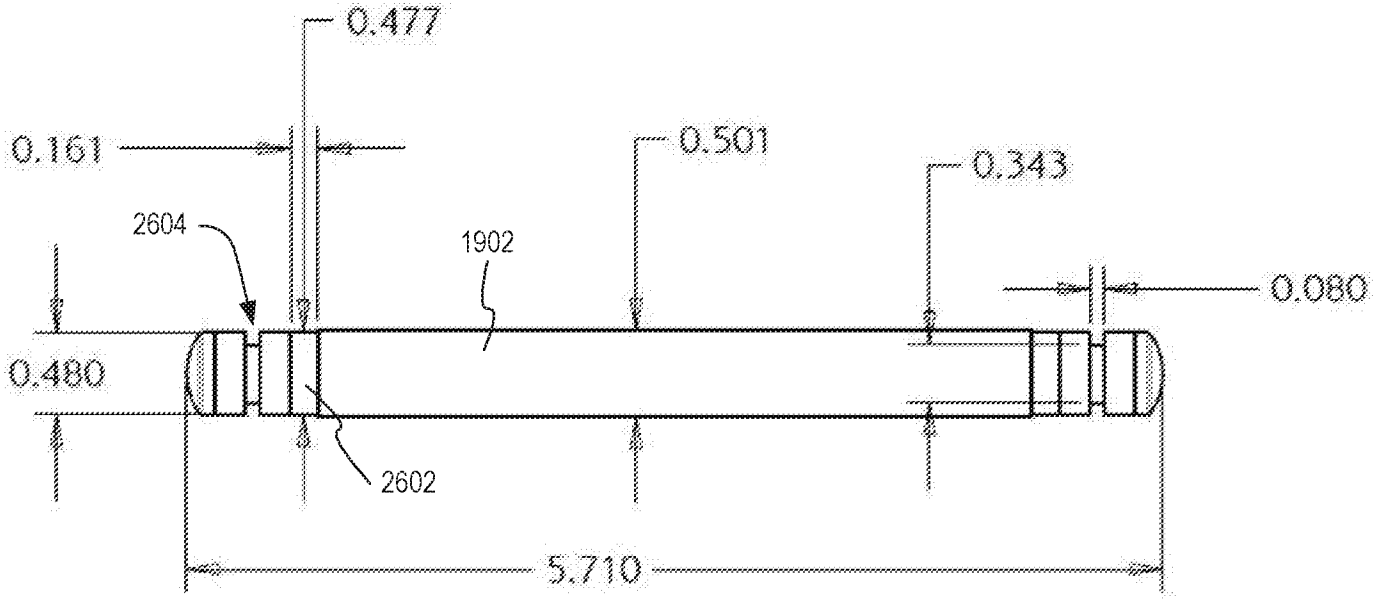

FIG. 26 is a front elevation of the shaft of FIG. 19.

Figure 27:
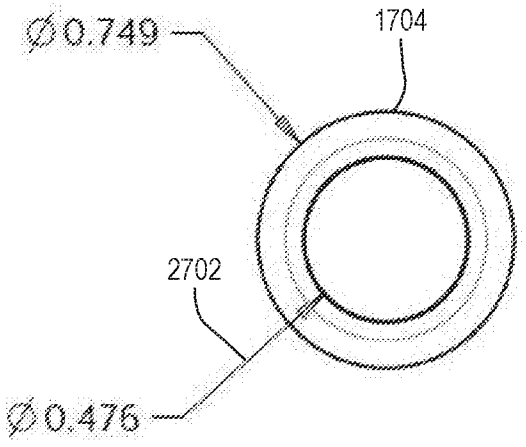

FIG. 27 is a side elevation of one exemplary roller stop of the portable roller massager of FIG. 17.

Figure 28:
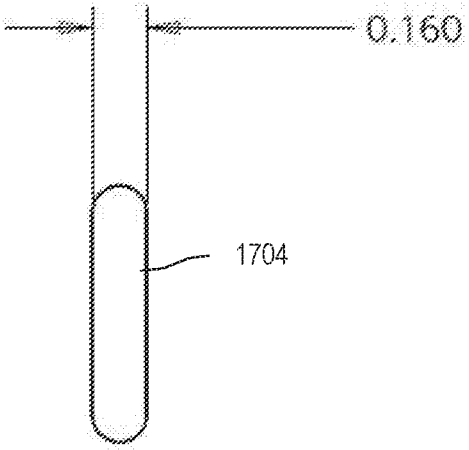

FIG. 28 is a front elevation of one exemplary roller stop of the portable roller massager of FIG. 17.

Figure 29:
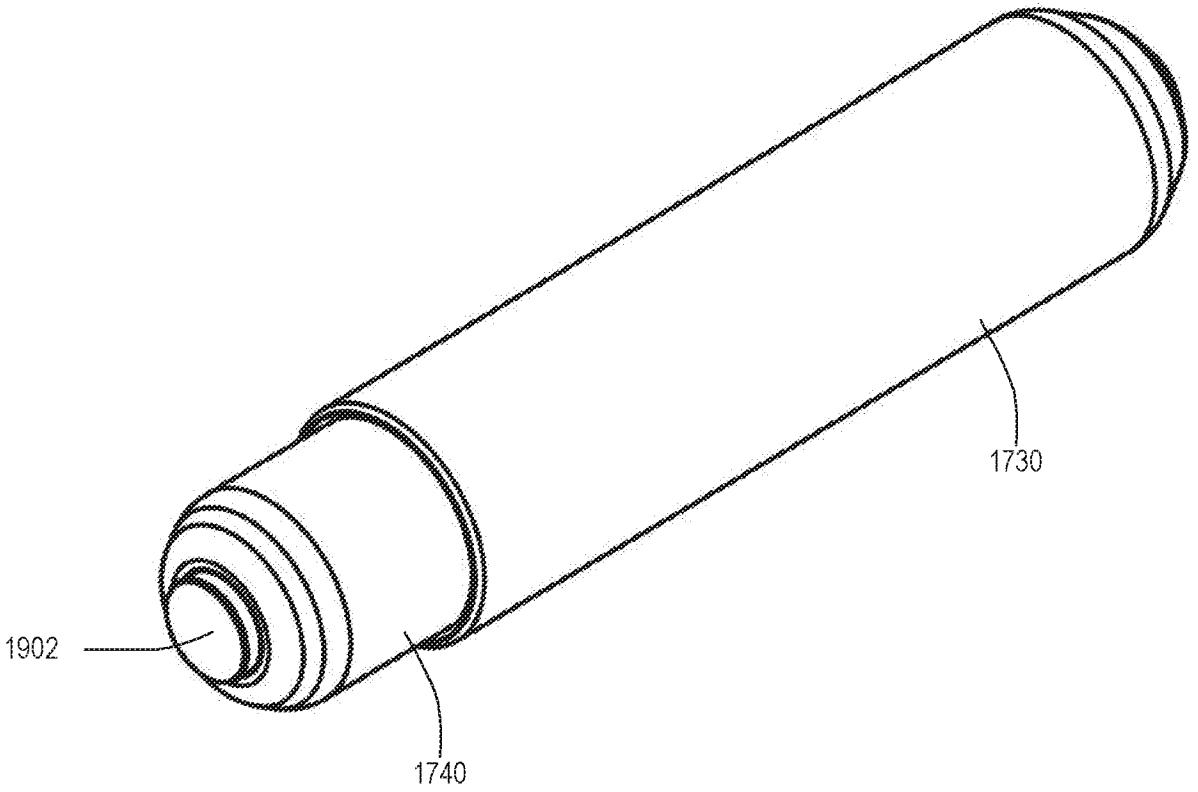

FIG. 29 is a perspective view of the portable roller massager of FIG. 17 configured for carrying.

Figure 30:
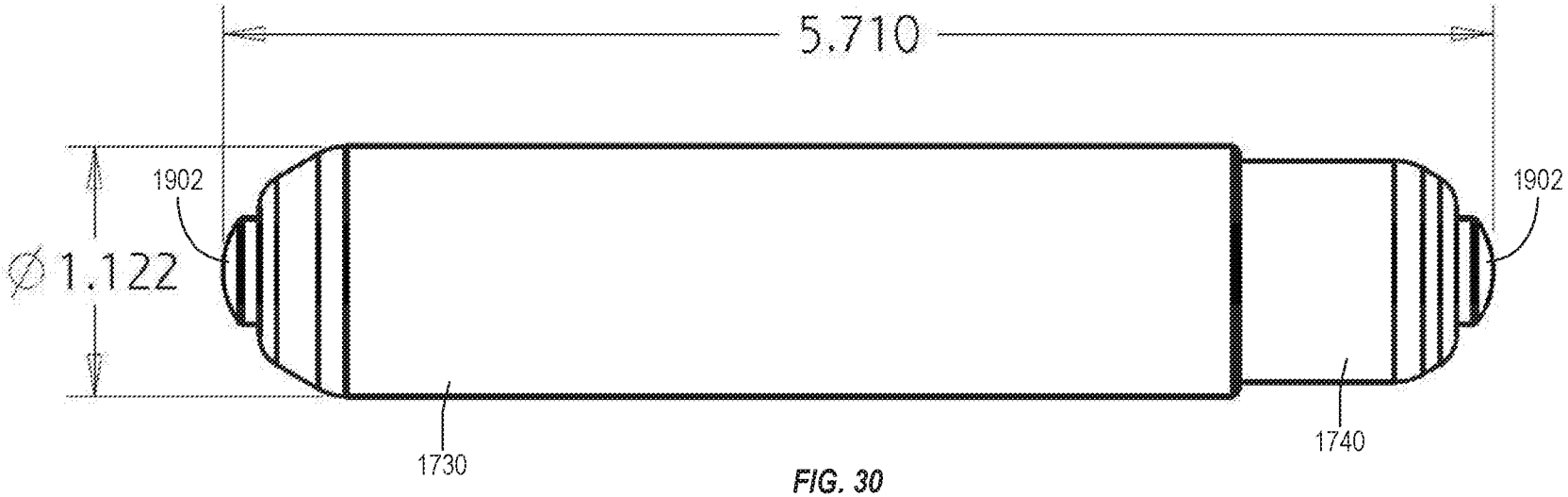

FIG. 30 is a front elevation of the portable roller massager of FIG. 17 configured for carrying.

Figure 31:
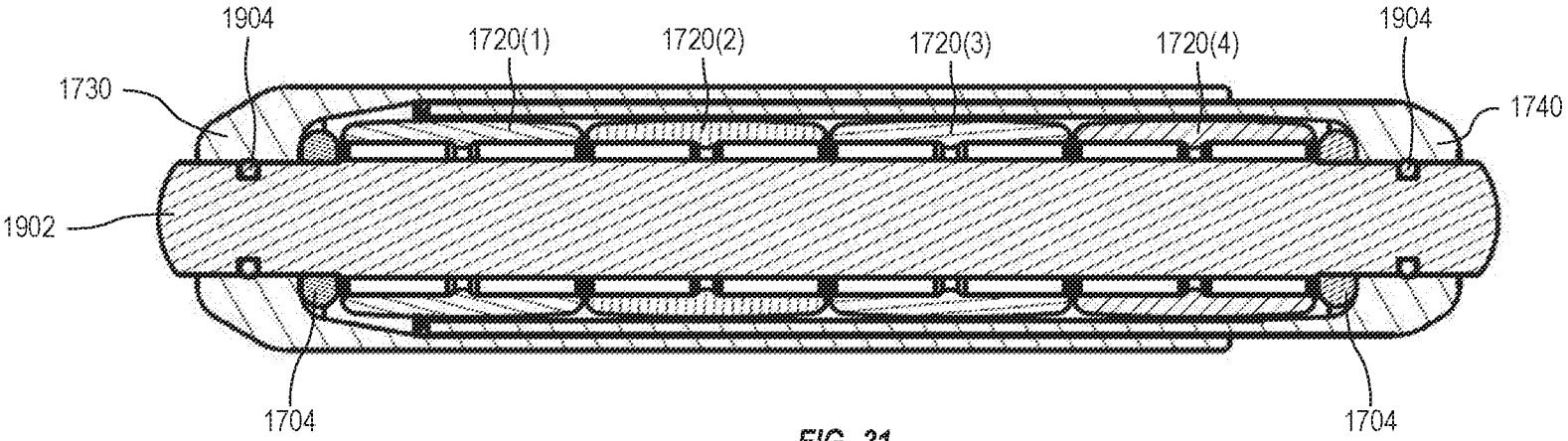

FIG. 31 is a cross-section of the portable roller massager of FIG. 17 configured for carrying.

Equal Sized Handles

Figure 32:
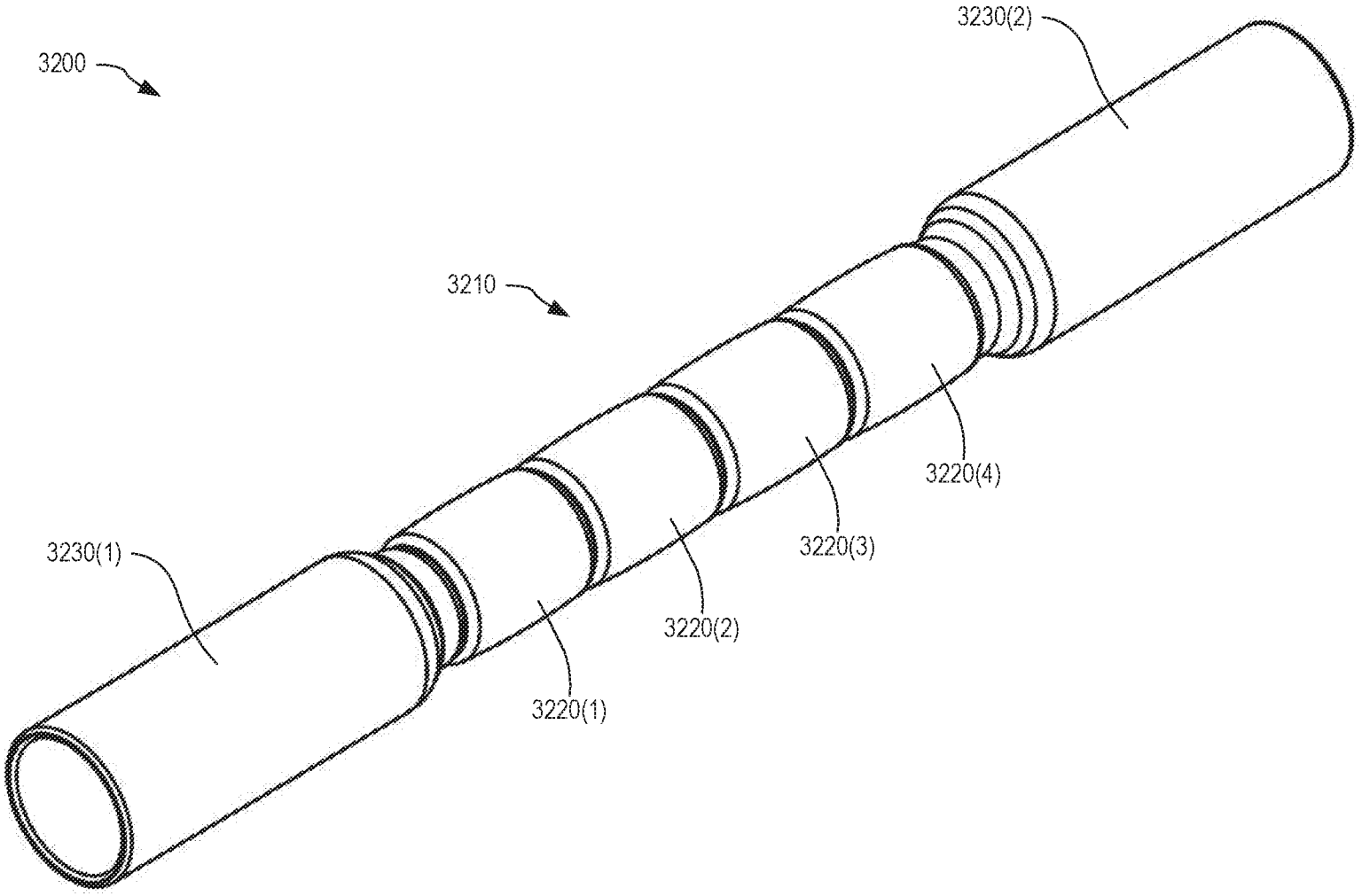

FIG. 32 is a perspective view illustrating one exemplary portable roller massager with a detent push-to-connect connection and equal sized handles, in accordance with an embodiment of the disclosure.

Figure 33:
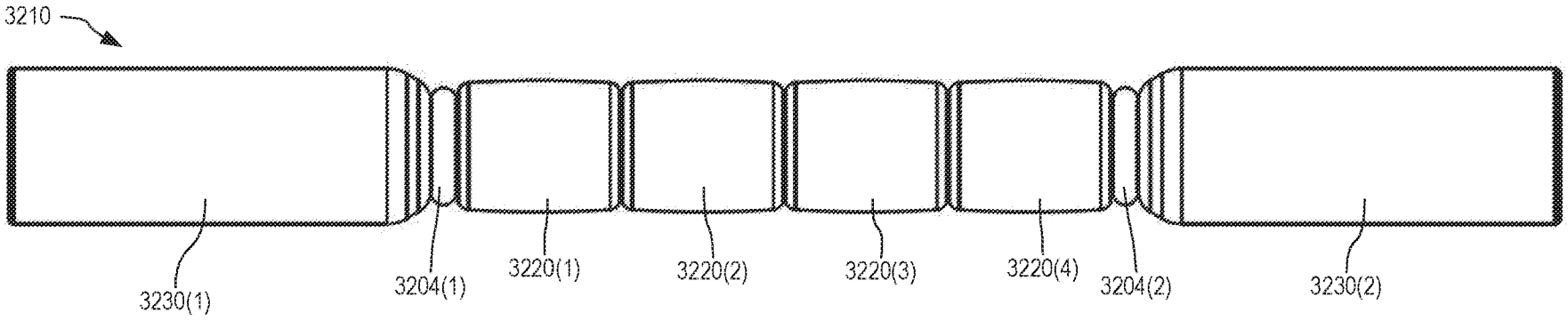

FIG. 33 is a front elevation of the portable roller massager of FIG. 32.

Figure 34:
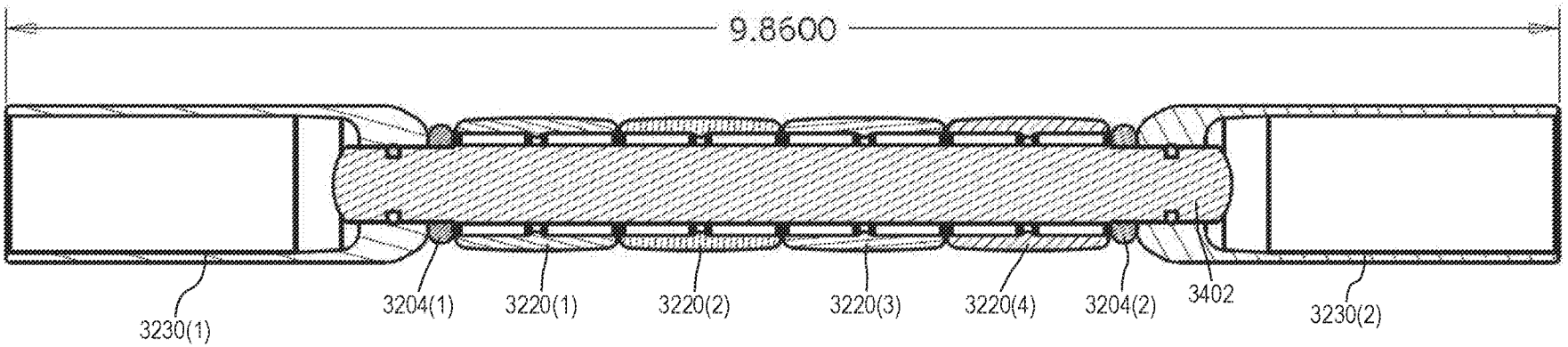

FIG. 34 is a cross section through the portable roller massager of FIG. 32.

Figure 37:
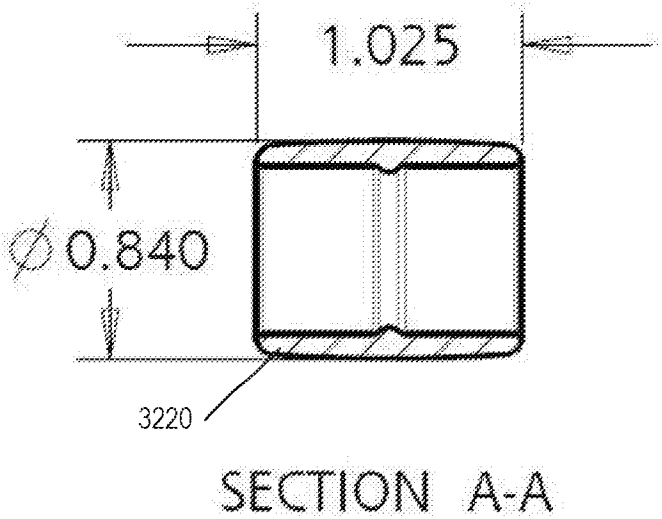
Figure 36:
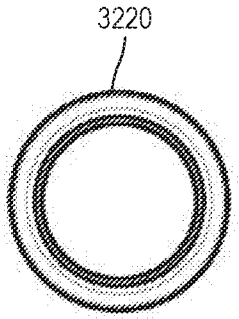
Figure 35:
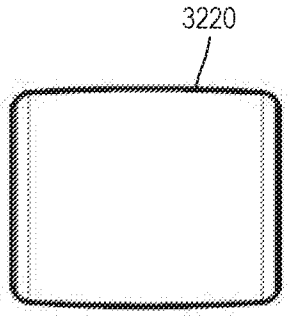

FIGS. 35, 36, and 37 shows one exemplary roller section of the portable roller massager of FIG. 32.

Figure 38:
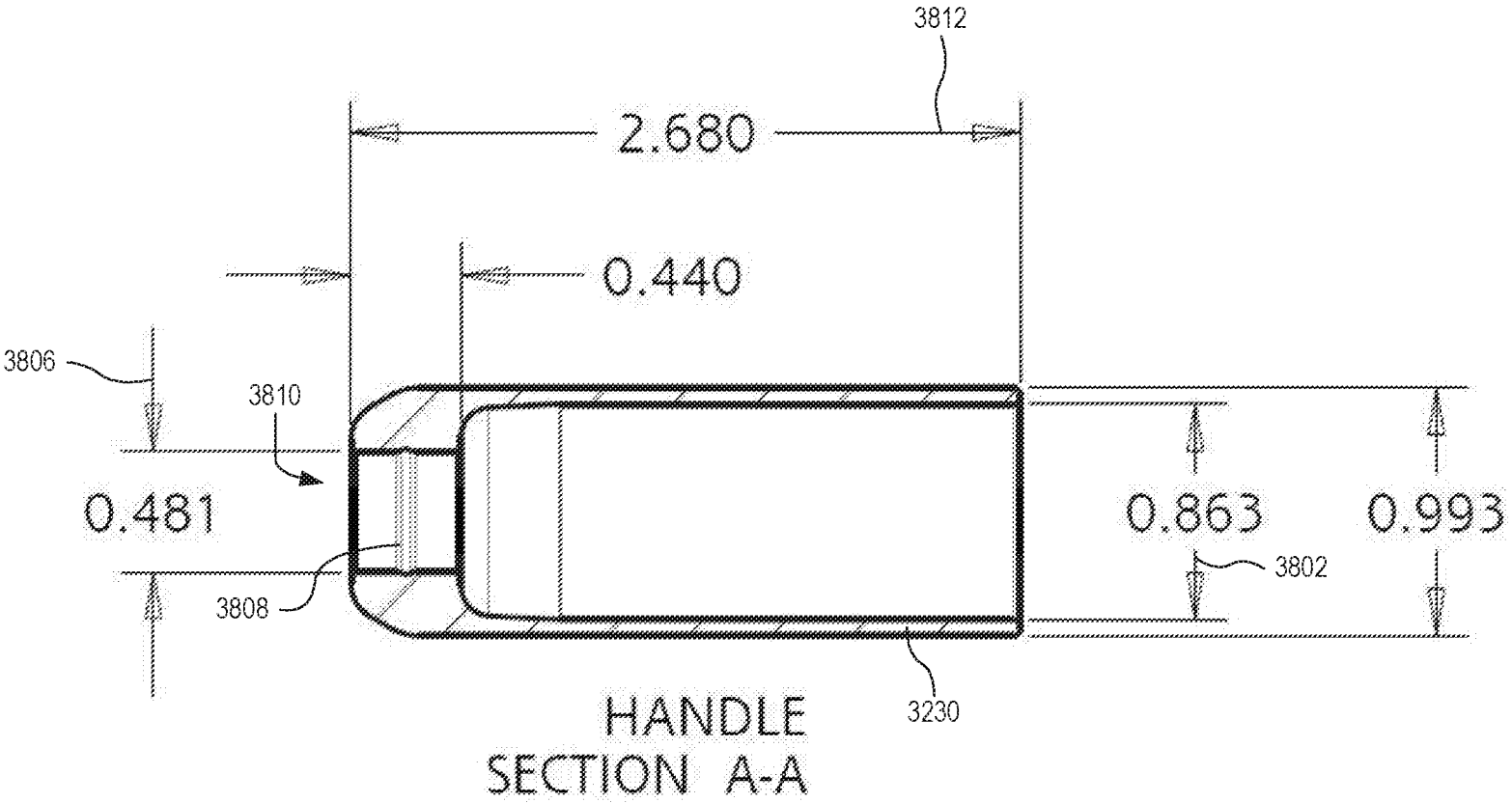

FIG. 38 is a cross-section through one handle of the portable roller massager of FIG. 32.

Figure 39:
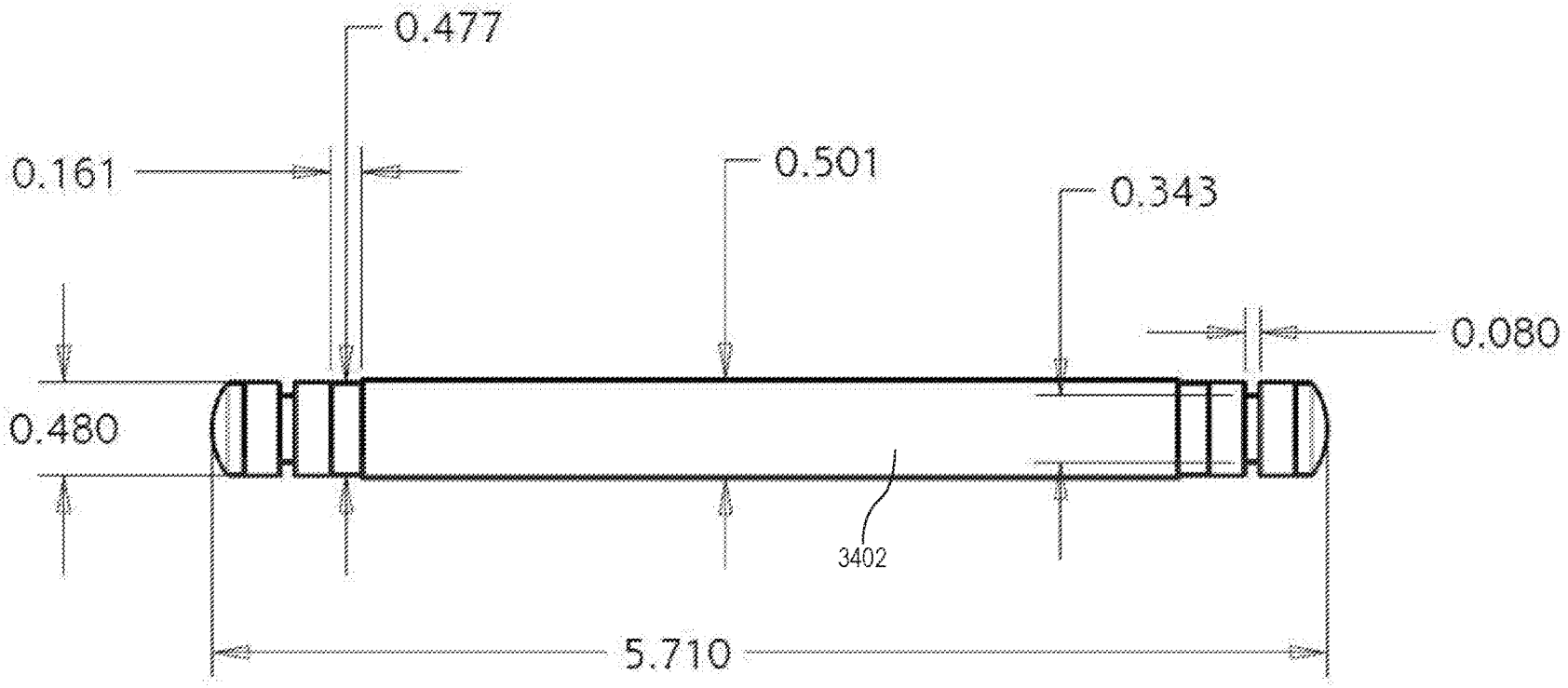

FIG. 39 is a front elevation of the shaft of the portable roller massager of FIG. 32.

Figure 40:
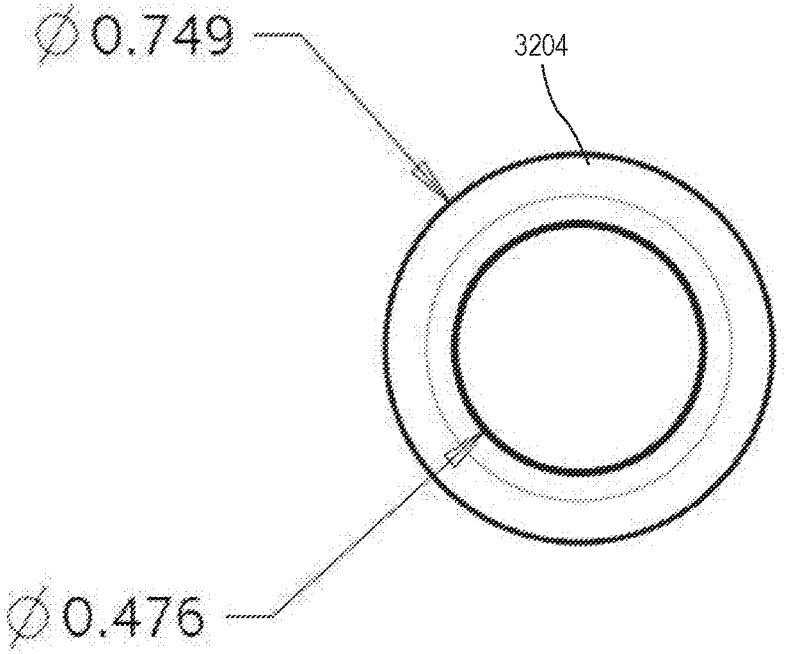

FIG. 40 is a side elevation of one exemplary roller stop of the portable roller massager of FIG. 32.

Figure 41:
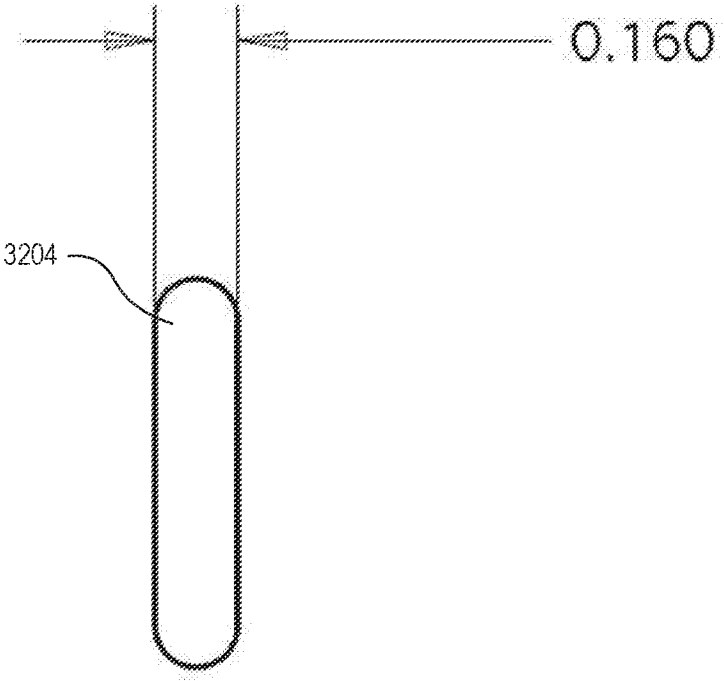

FIG. 41 is a front elevation of one exemplary roller stop of the portable roller massager of FIG. 32.

Figure 42:
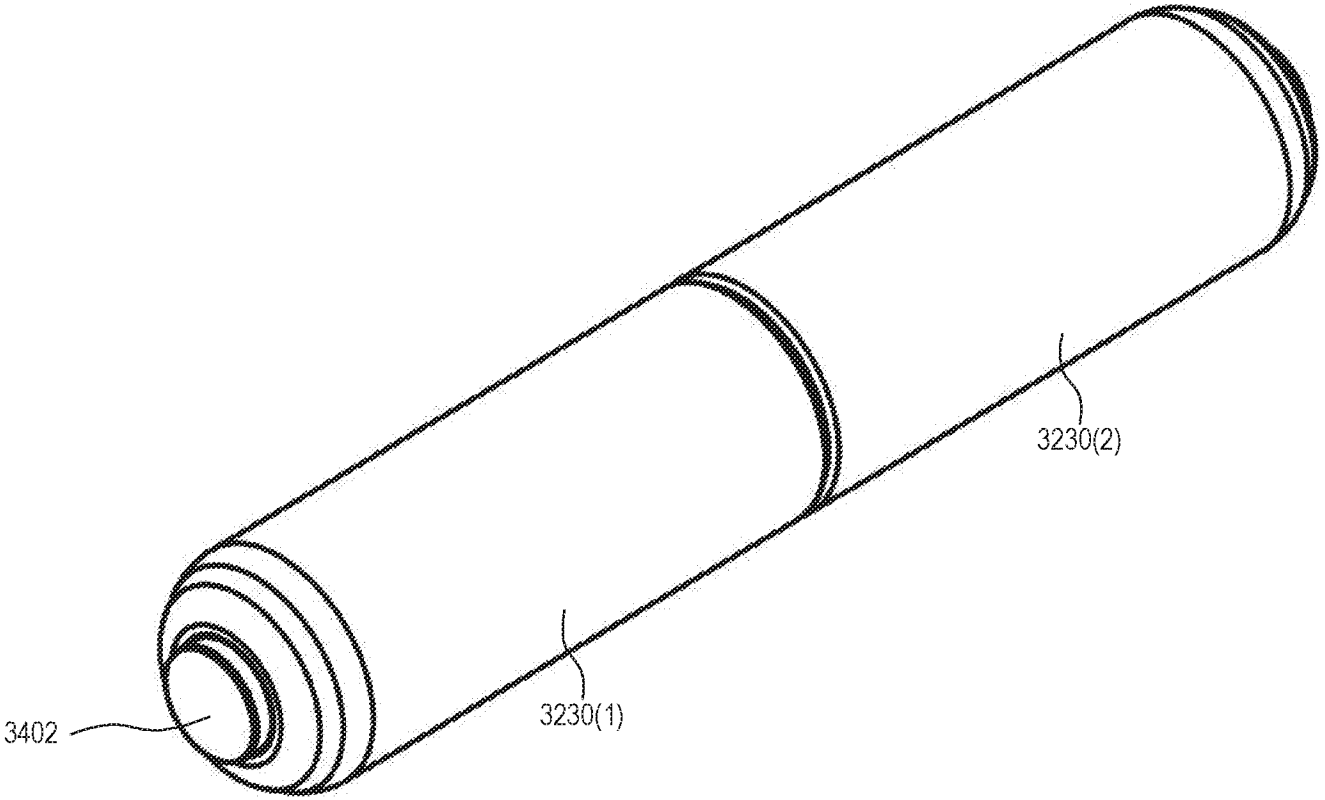

FIG. 42 is a perspective view of the portable roller massager of FIG. 32 configured for carrying.

Figure 43:
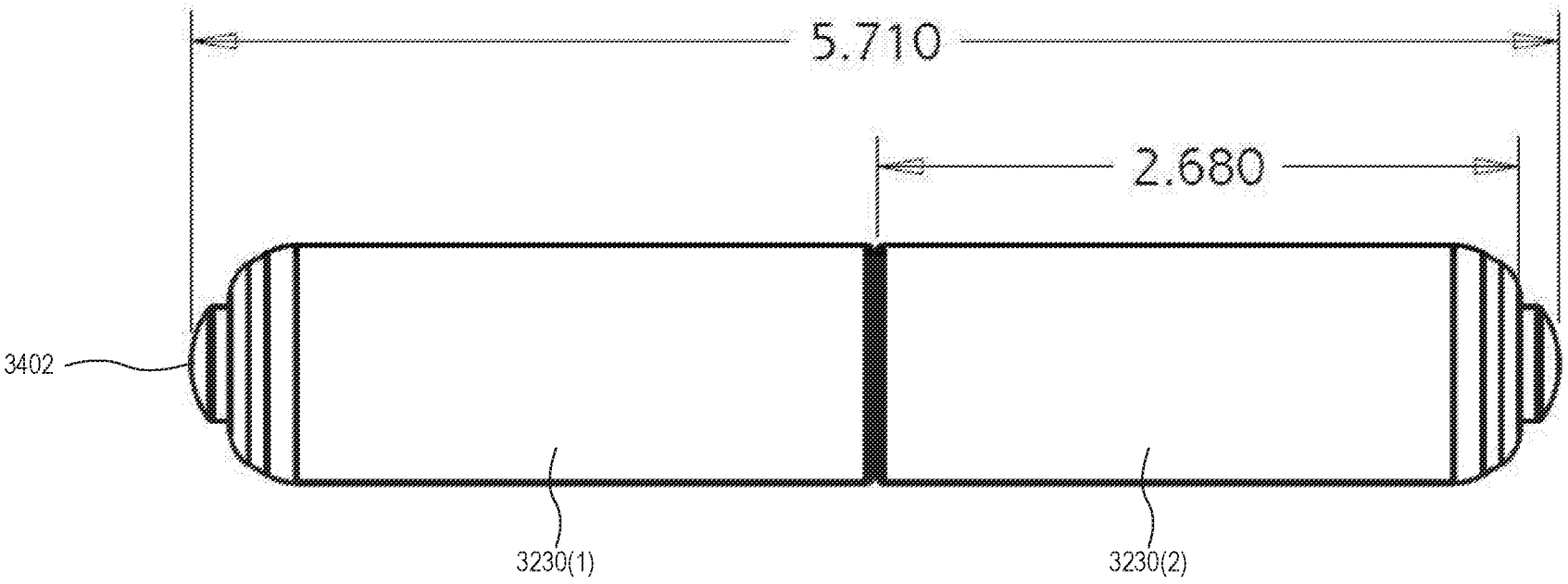

FIG. 43 is a front elevation of the portable roller massager of FIG. 32 configured for carrying.

Figure 44:
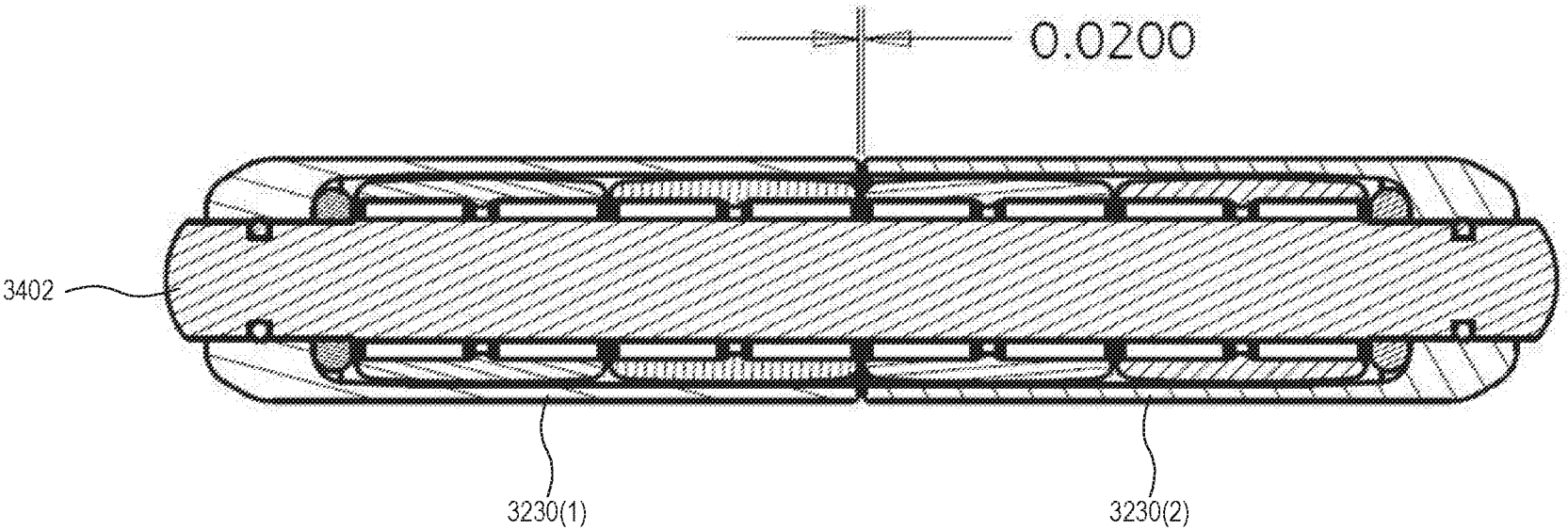

FIG. 44 is a cross-section of the portable roller massager of FIG. 32 configured for carrying.

Hybrid

Figure 45:
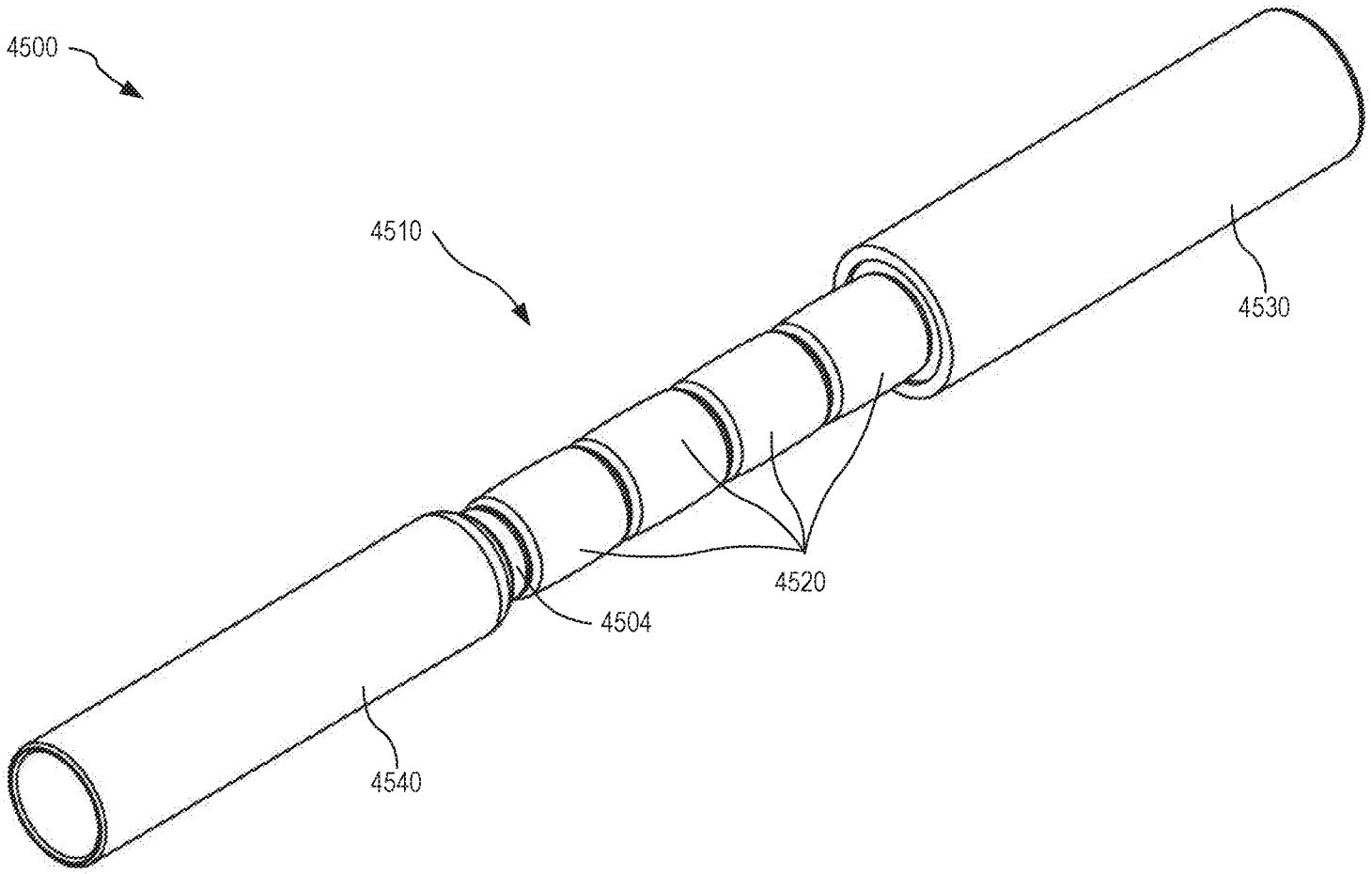

FIG. 45 is a perspective view illustrating one exemplary portable roller massager with one detent push-to-connect connection for an inner handle and a telescoping outer handle, in accordance with an embodiment of the disclosure.

Figure 46:
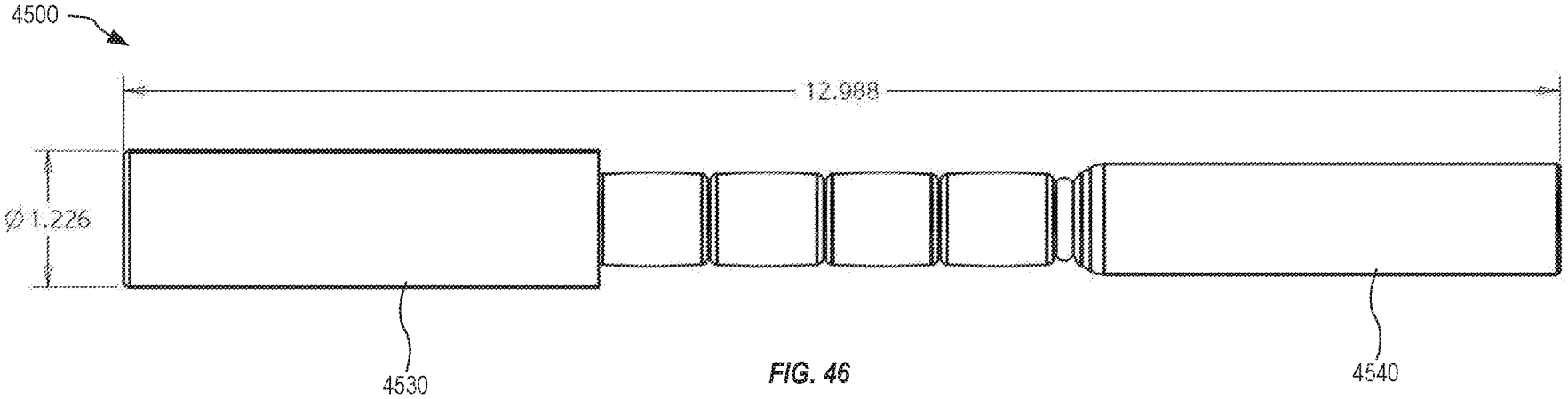

FIG. 46 is a front elevation of the portable roller massager of FIG. 45.

Figure 47:
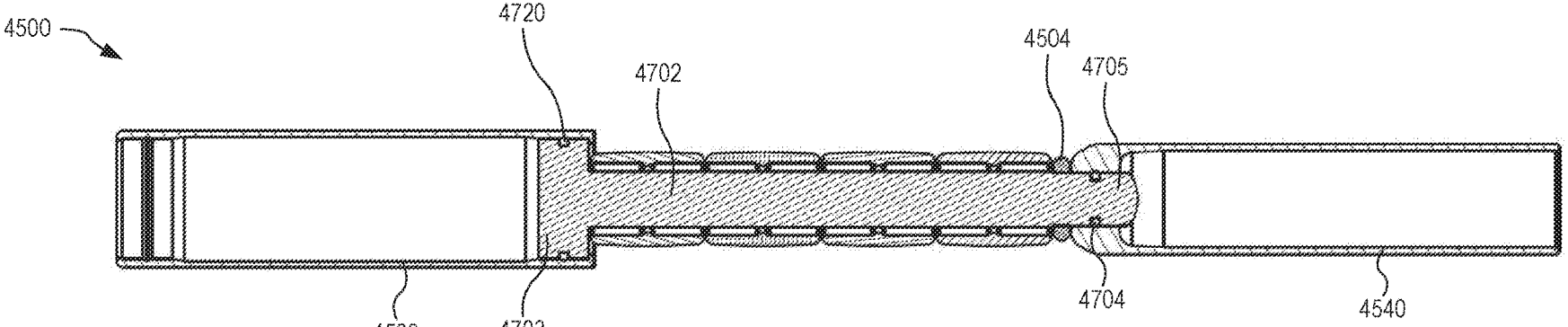

FIG. 47 is a cross section through the portable roller massager of FIG. 45.

Figure 50:
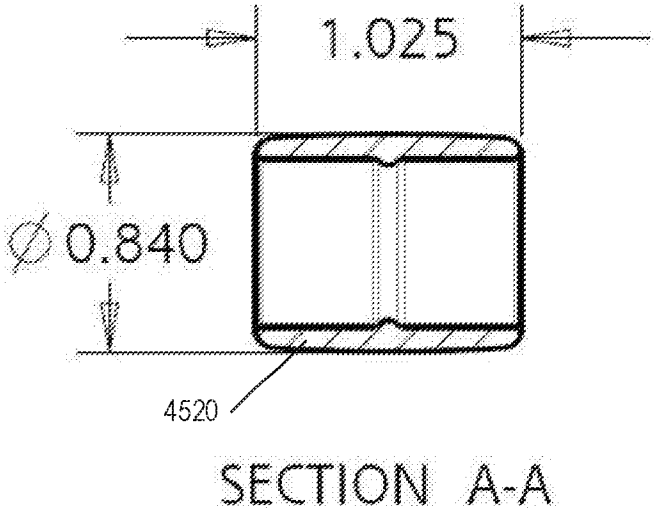
Figure 49:
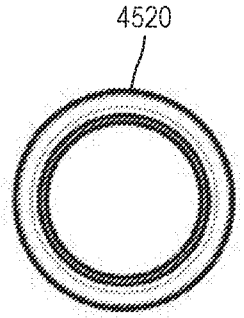
Figure 48:
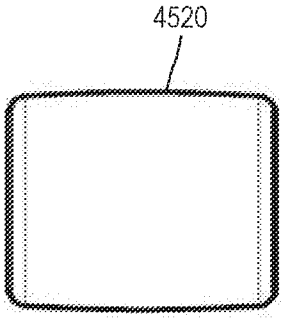

FIGS. 48, 49, and 50 shows one exemplary roller section of the portable roller massager of FIG. 45.

Figure 51:
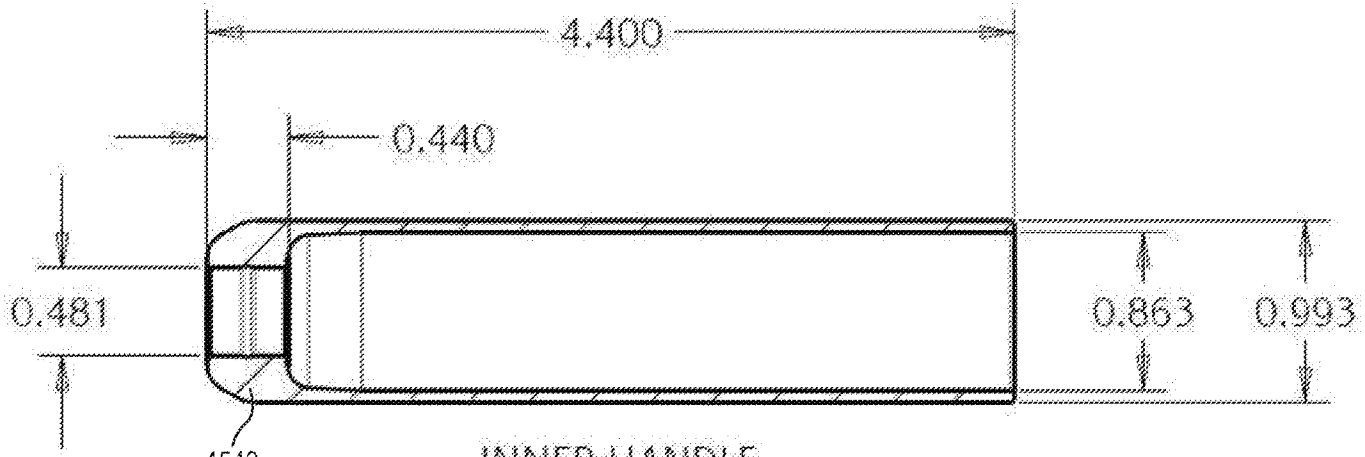

FIG. 51 is a cross-section through the inner handle of the portable roller massager of FIG. 45.

Figure 52:
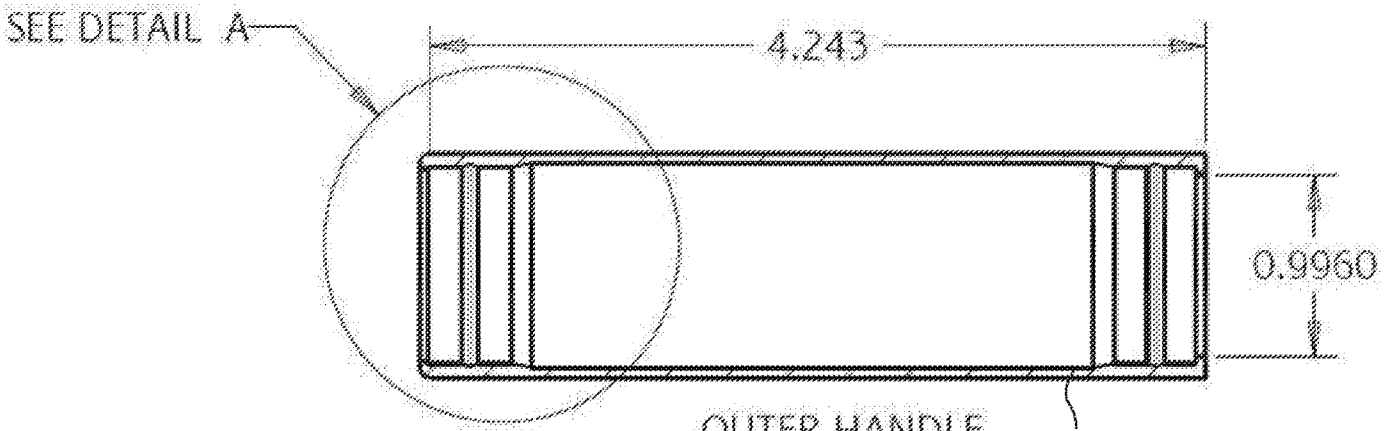

FIG. 52 is a cross-section through the outer handle of the portable roller massager of FIG. 45.

Figure 53:
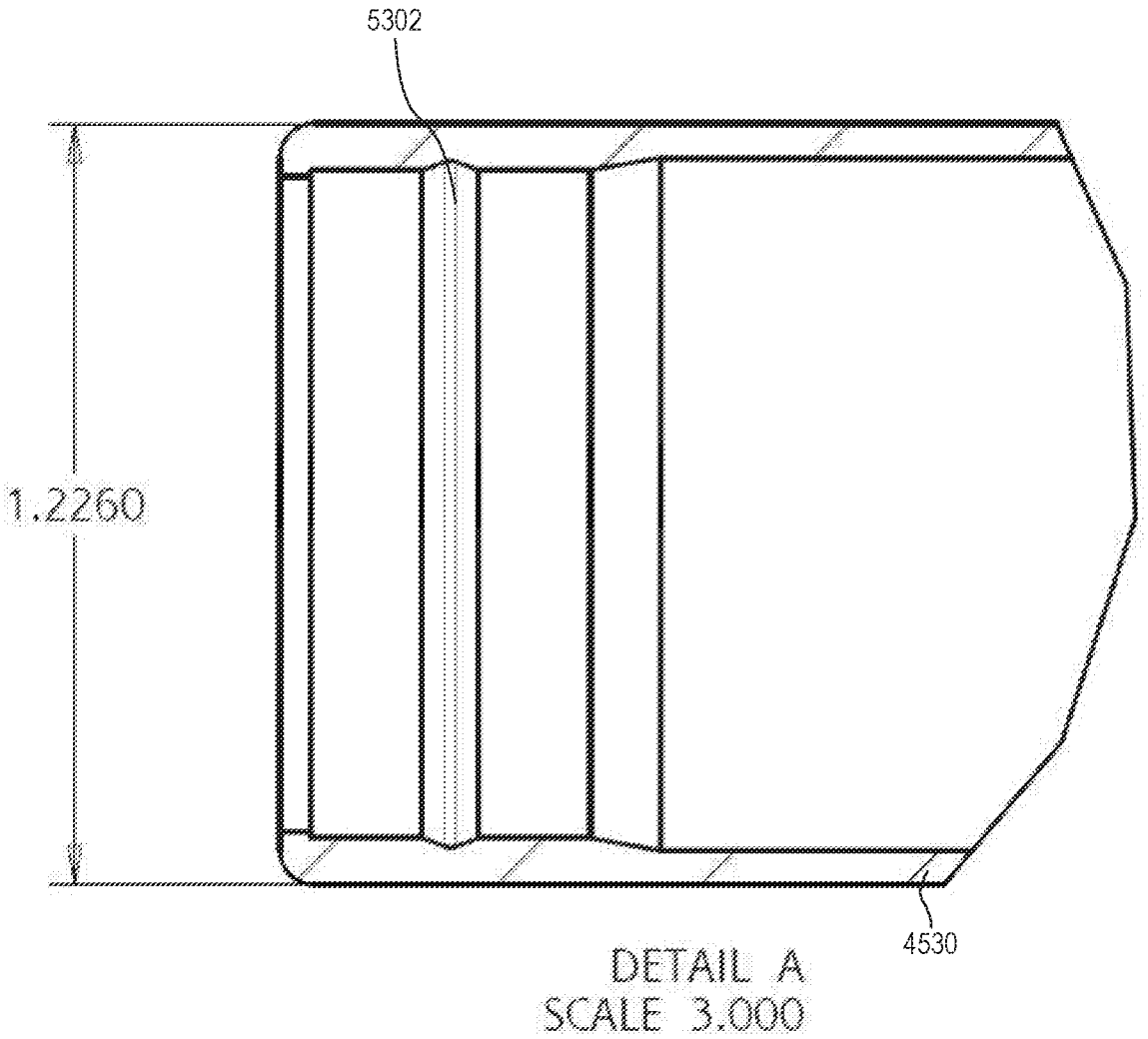

FIG. 53 is a cross-section showing greater detail of the outer handle of FIG. 52 illustrating the detent connection between the outer handle and the shaft.

Figure 54:
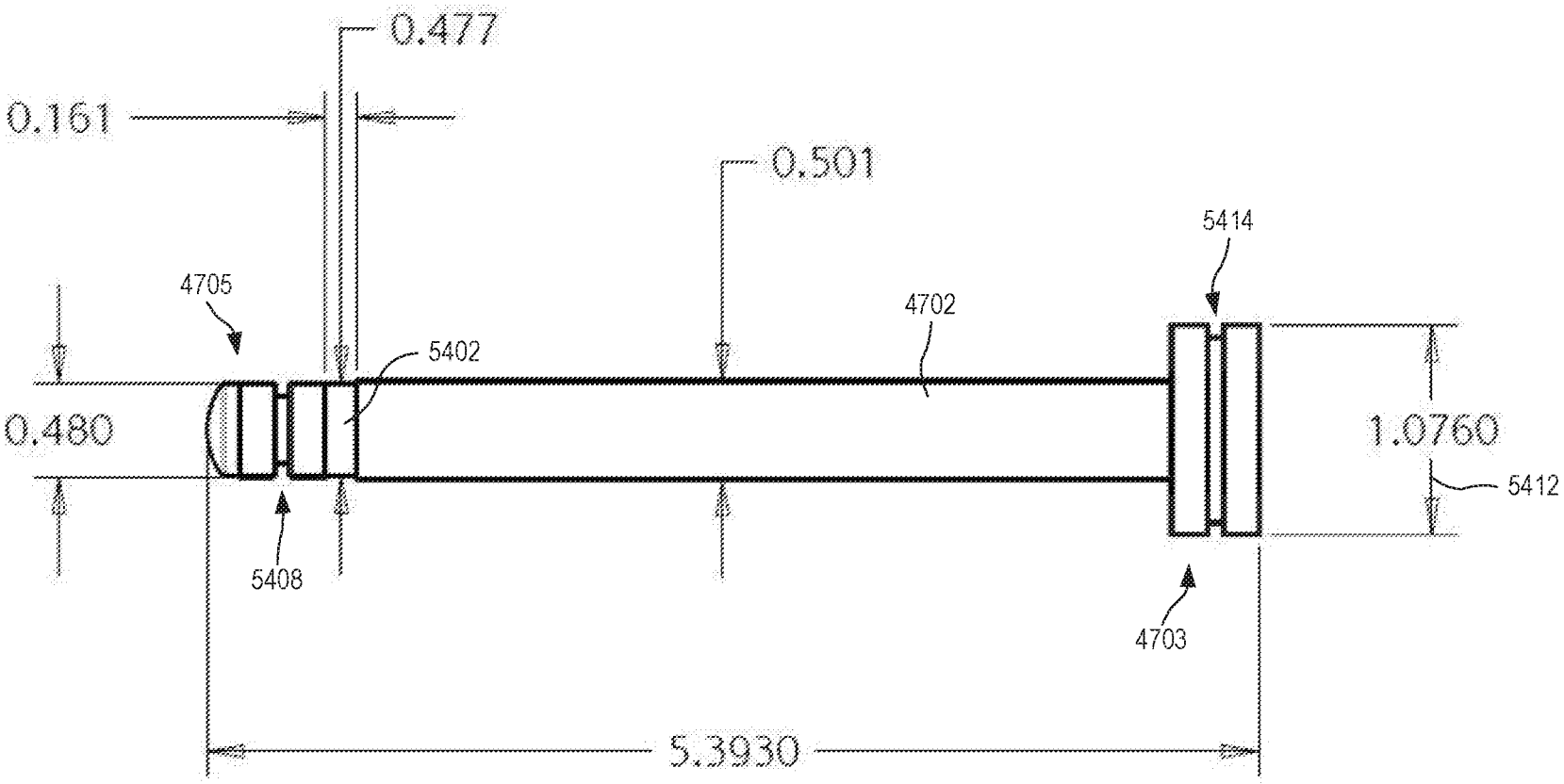

FIG. 54 is a front elevation of the shaft of the portable roller massager of FIG. 45.

Figure 55:
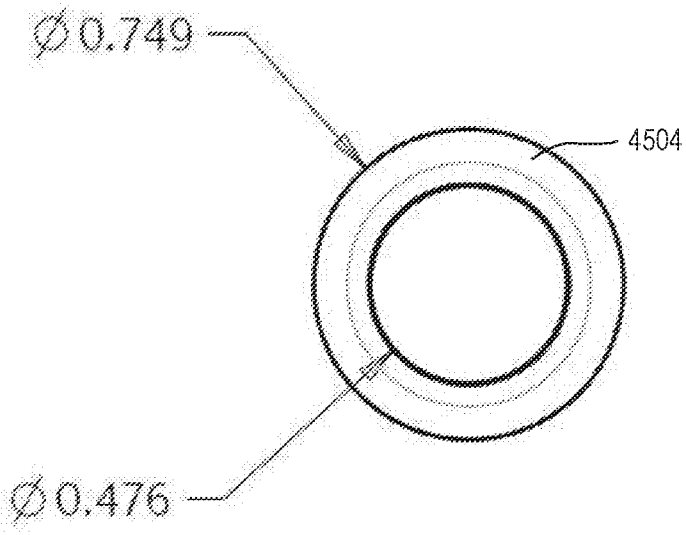

FIG. 55 is a side elevation of one exemplary roller stop of the portable roller massager of FIG. 45.

Figure 56:
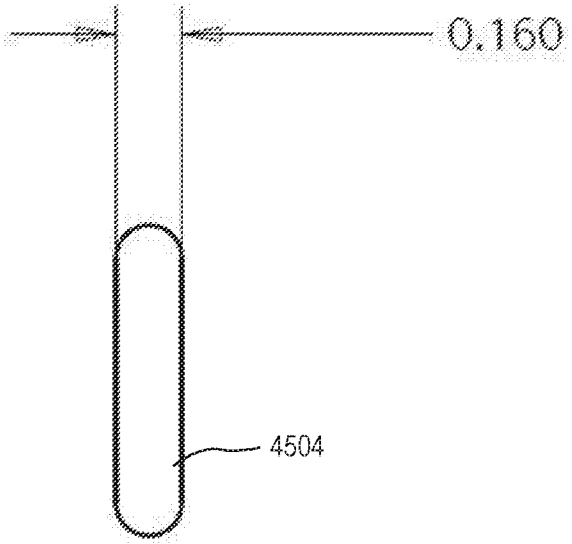

FIG. 56 is a front elevation of one exemplary roller stop of the portable roller massager of FIG. 45.

Figure 57:
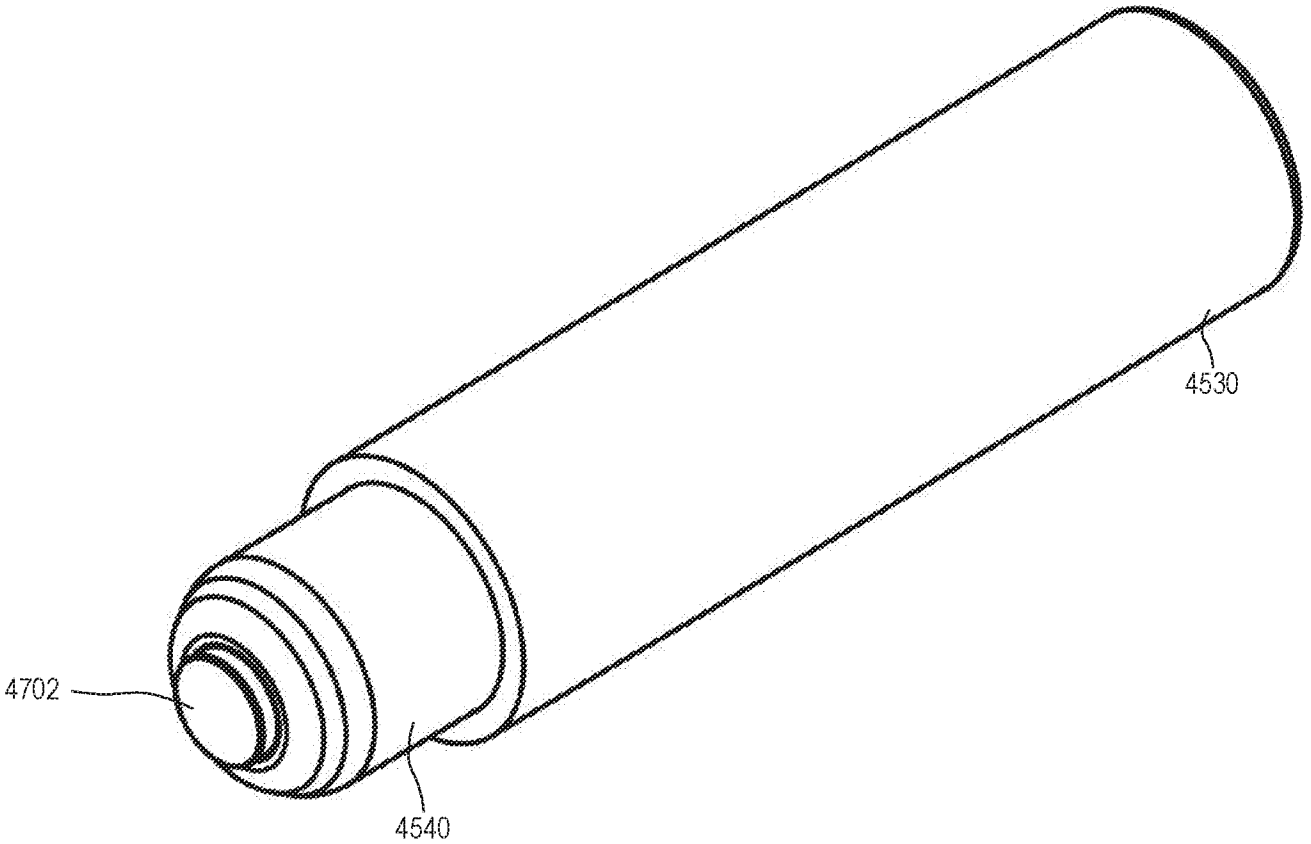

FIG. 57 is a perspective view of the portable roller massager of FIG. 45 configured for carrying.

Figure 58:
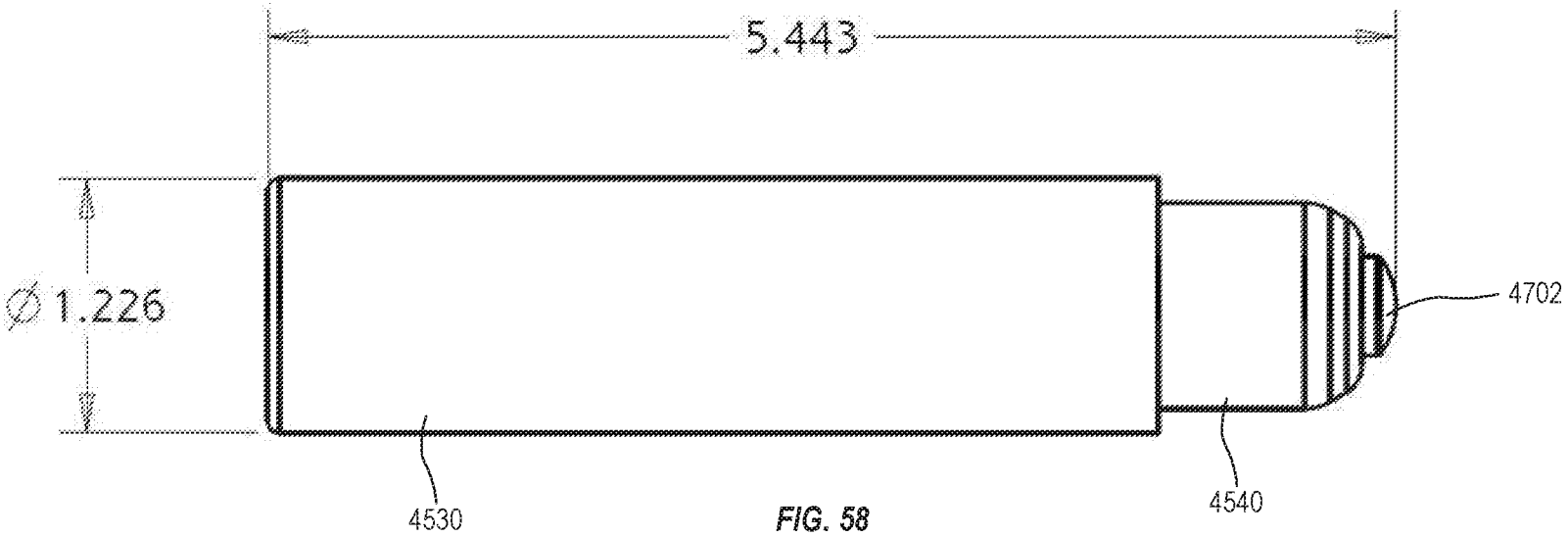

FIG. 58 is a front elevation of the portable roller massager of FIG. 45 configured for carrying.

Figure 59:
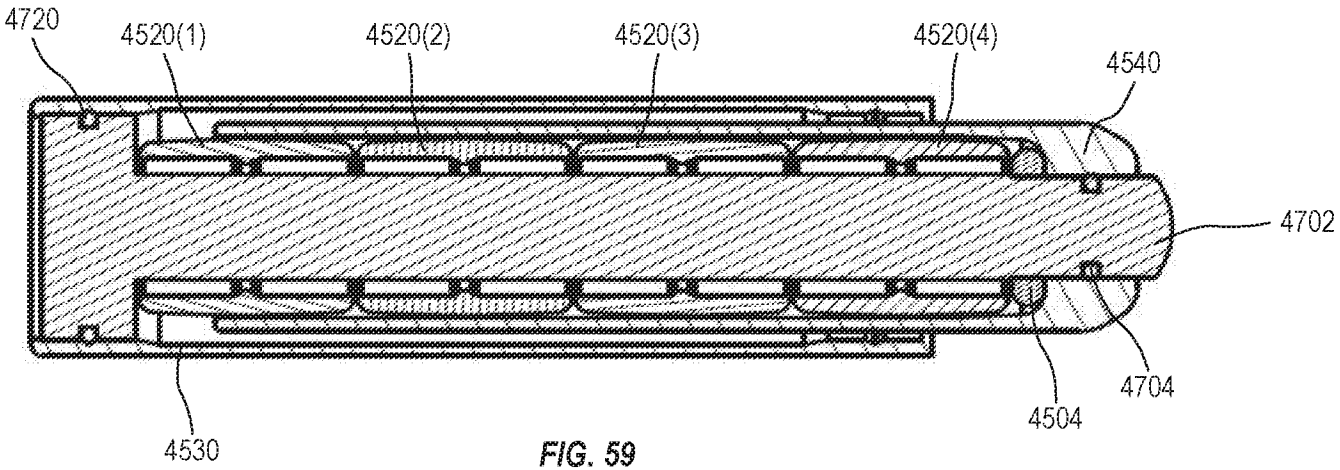

FIG. 59 is a cross-section of the portable roller massager of FIG. 45 configured for carrying.

Telescoping

Figure 60:
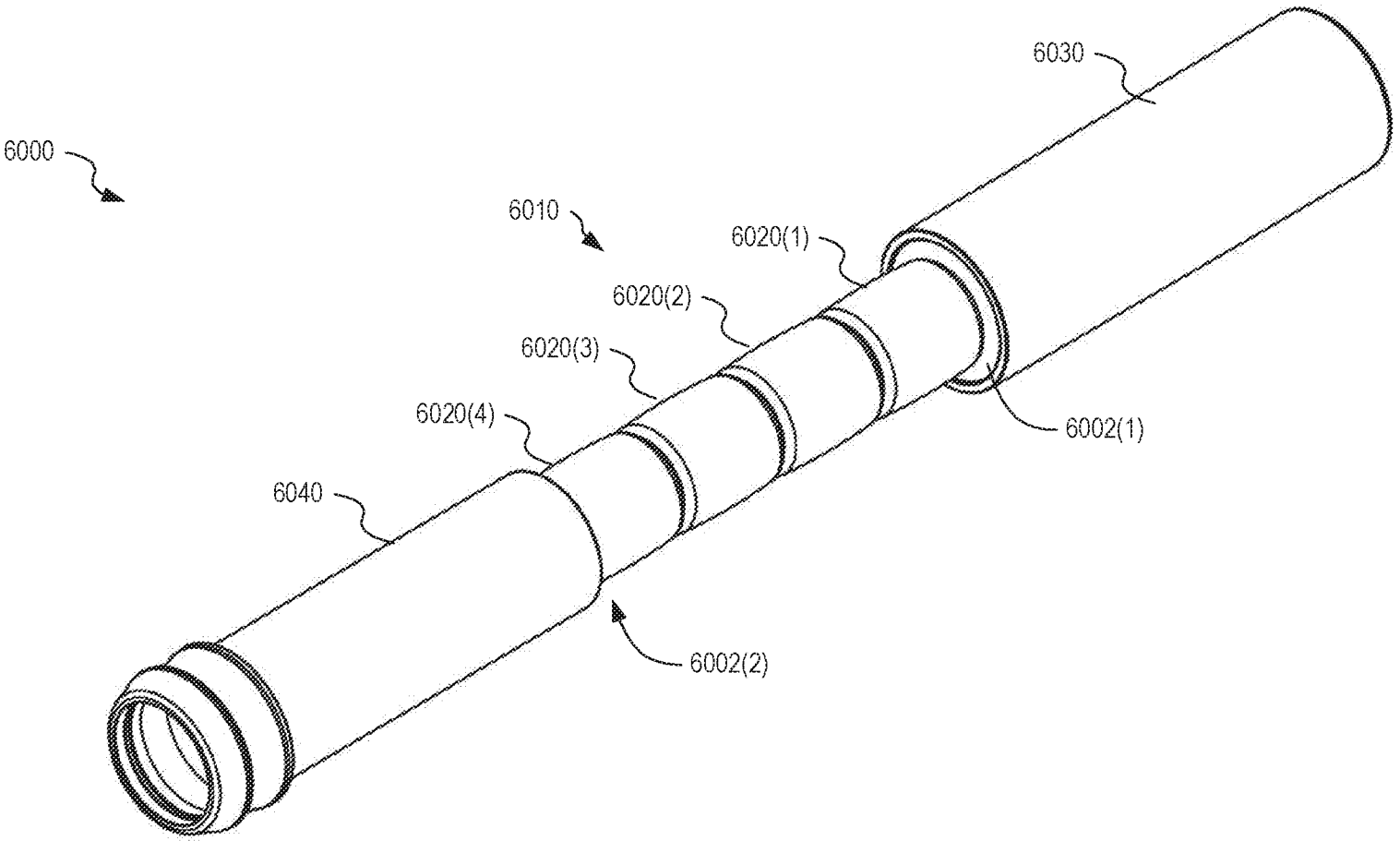

FIG. 60 is a perspective view illustrating one exemplary portable roller massager with telescoping handles, in accordance with an embodiment of the disclosure.

Figure 61:
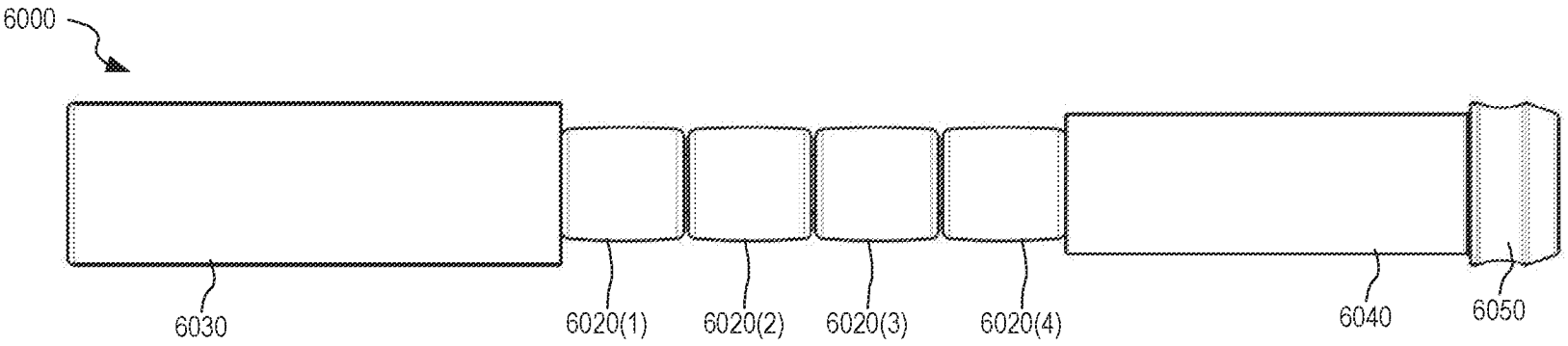

FIG. 61 is a front elevation of the portable roller massager of FIG. 60.

Figure 62:
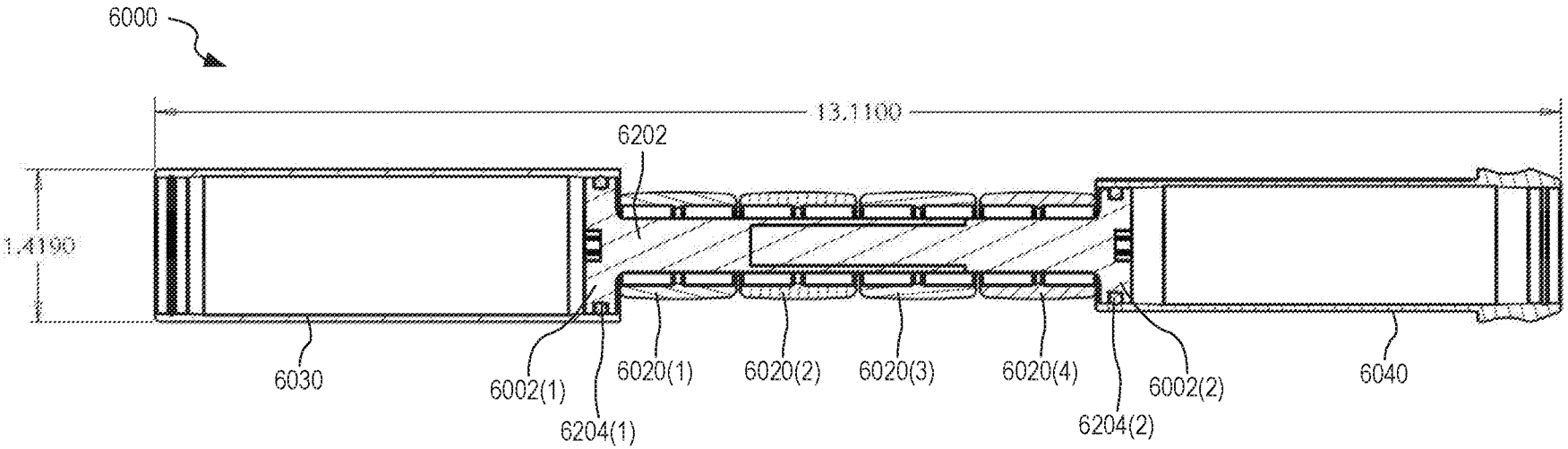

FIG. 62 is a cross section through the portable roller massager of FIG. 60.

Figure 63:
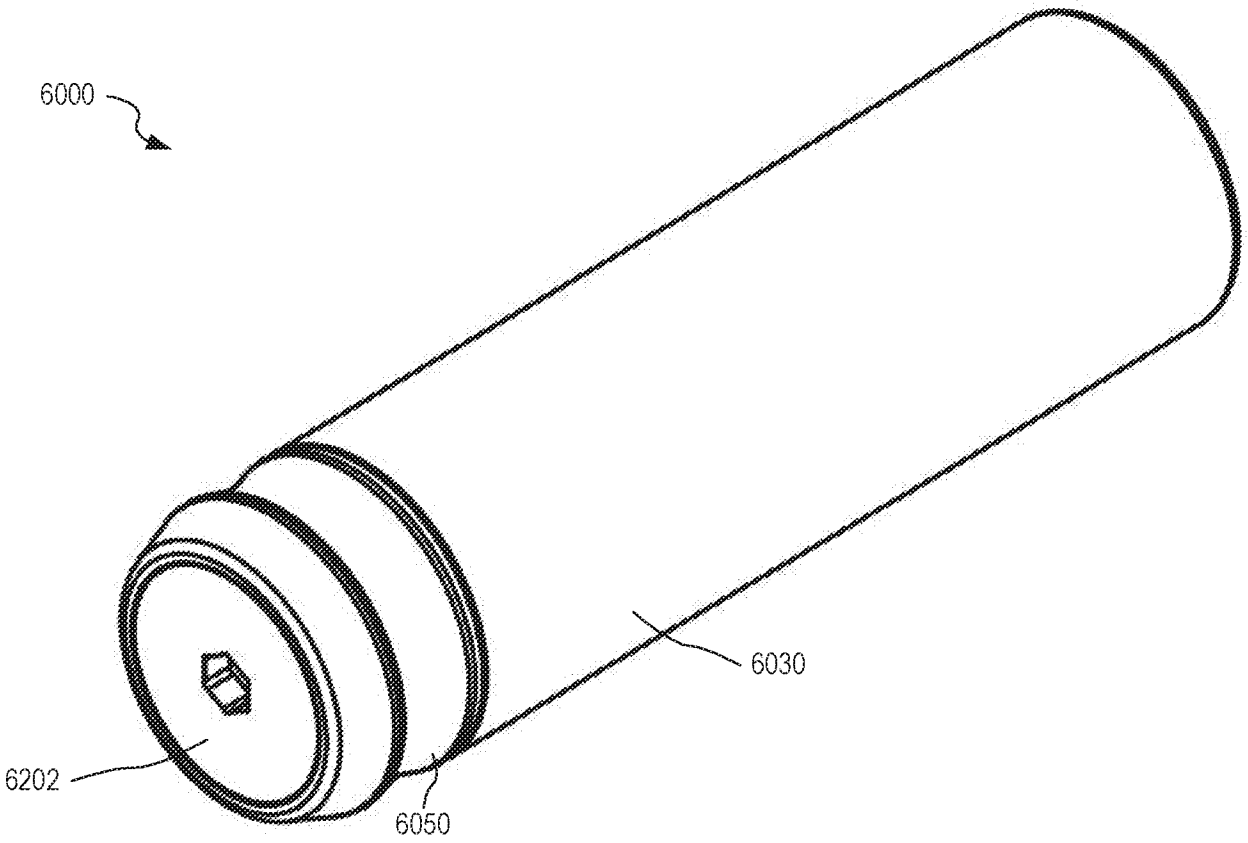

FIG. 63 is a perspective view of the portable roller massager of FIG. 60 configured for carrying.

Figure 64:
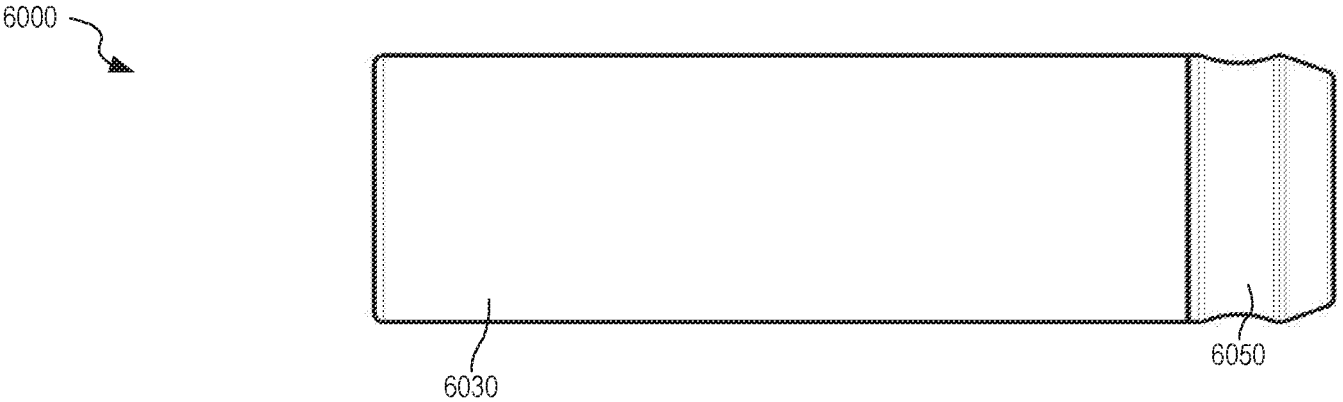

FIG. 64 is a front elevation of the portable roller massager of FIG. 60 configured for carrying.

Figure 65:
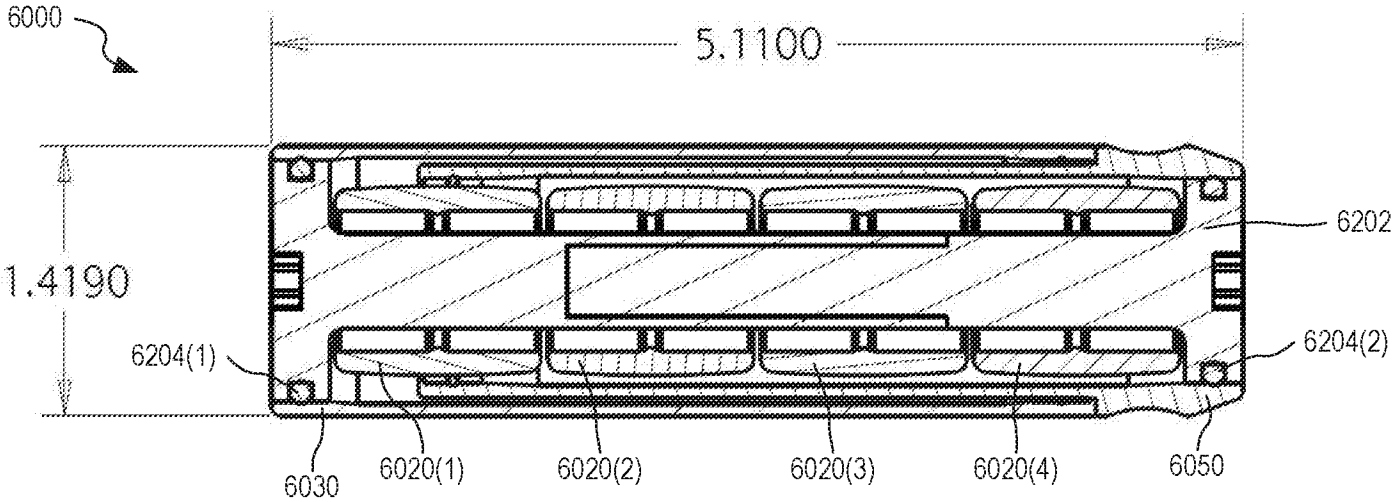

FIG. 65 is a cross-section of the portable roller massager of FIG. 60 configured for carrying.

Trigger Point Ring

Figure 66:
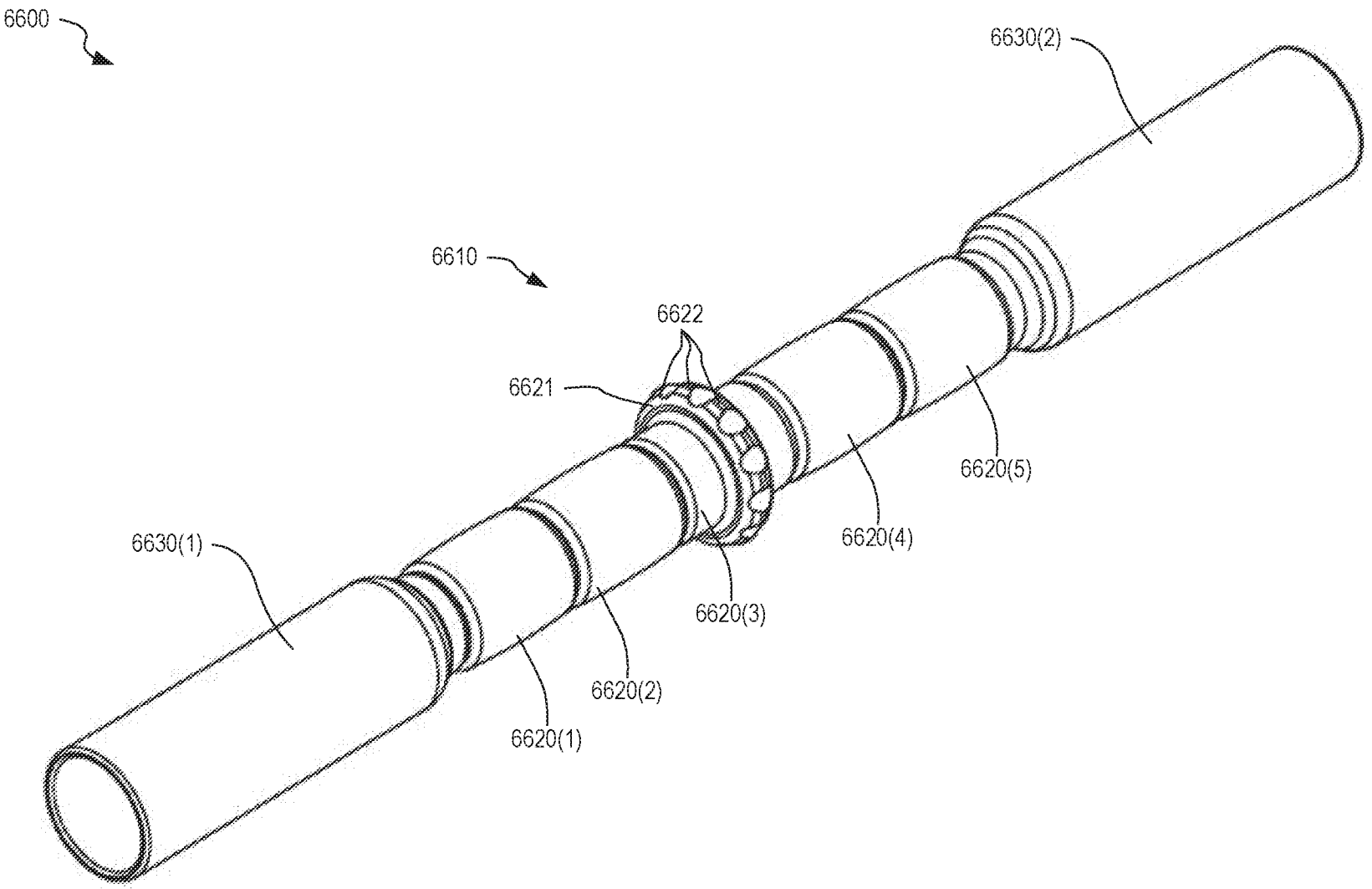

FIG. 66 is a perspective view illustrating one exemplary portable roller massager with a knobbed trigger point ring, detent push-to-connect connection and equal sized handles, in accordance with an embodiment of the disclosure.

Figure 67:
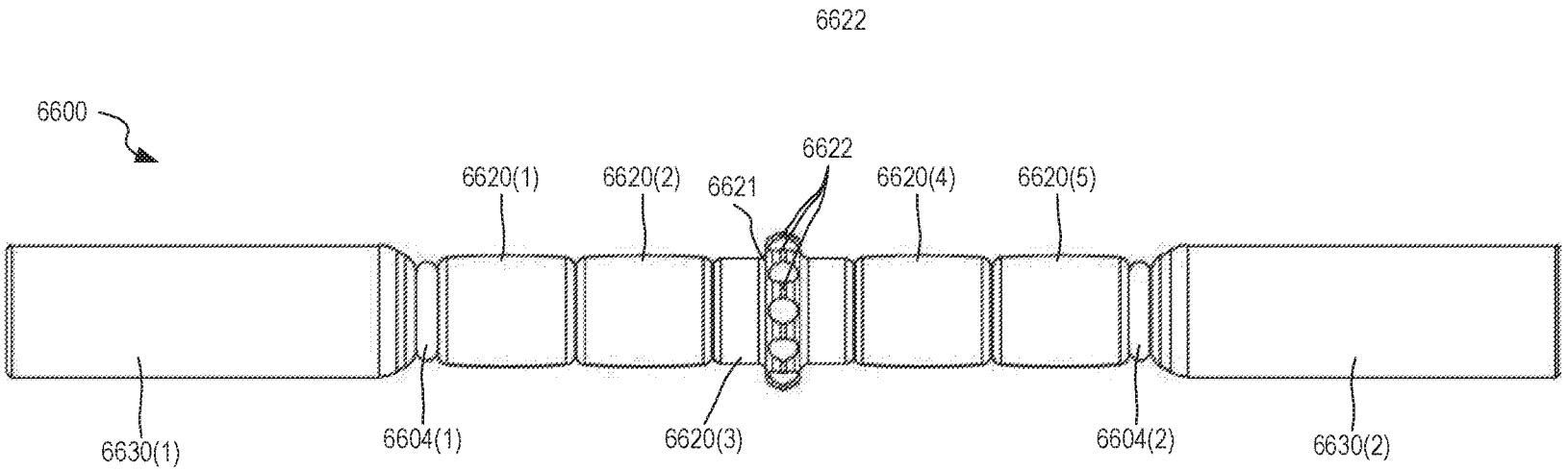

FIG. 67 is a front elevation of the portable roller massager of FIG. 66.

Figure 68:
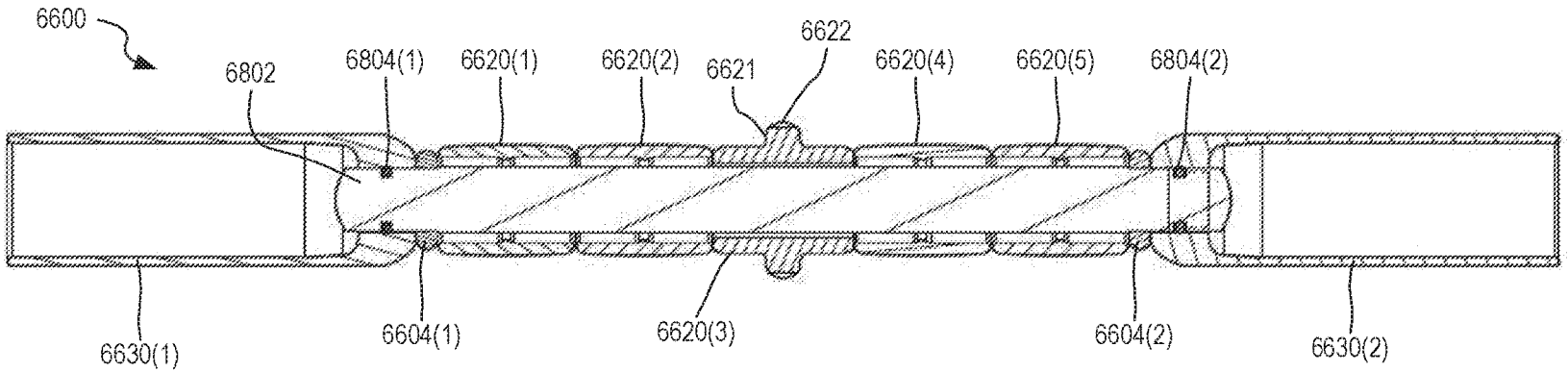

FIG. 68 is a cross section through the portable roller massager of FIG. 66.

Figure 69:
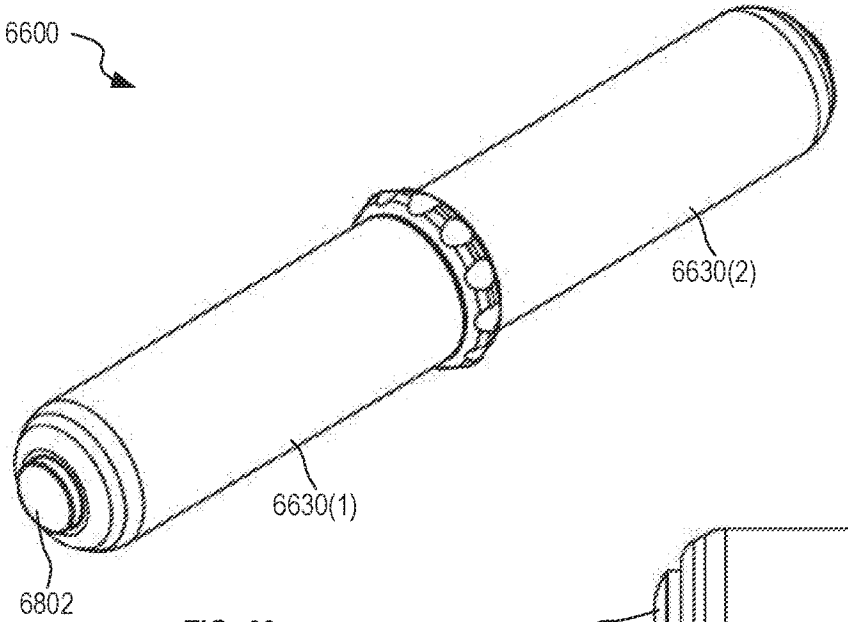

FIG. 69 is a perspective view of the portable roller massager of FIG. 66 configured for carrying.

Figure 70:
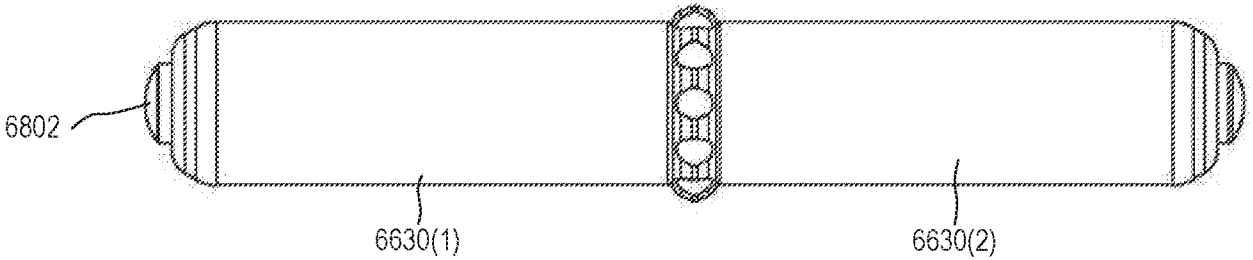

FIG. 70 is a front elevation of the portable roller massager of FIG. 66 configured for carrying.

Figure 71:
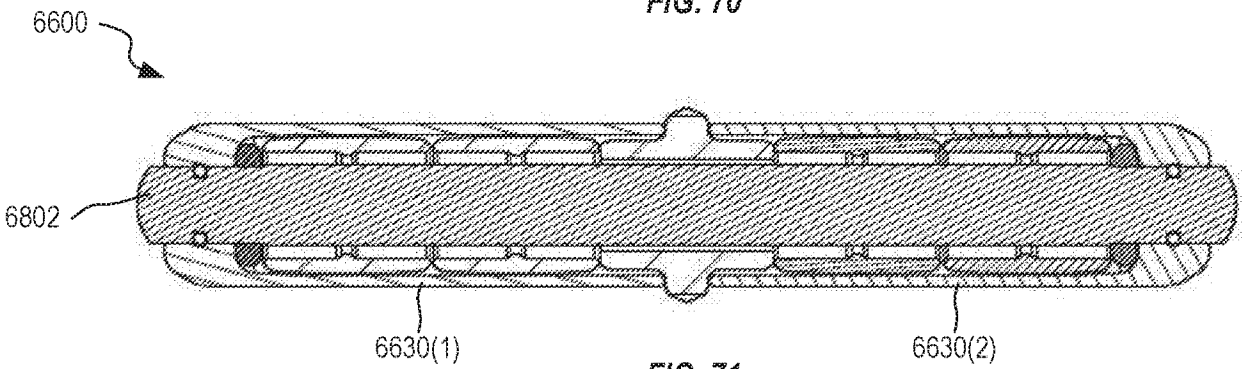

FIG. 71 is a cross-section of the portable roller massager of FIG. 66 configured for carrying.

Figure 72:
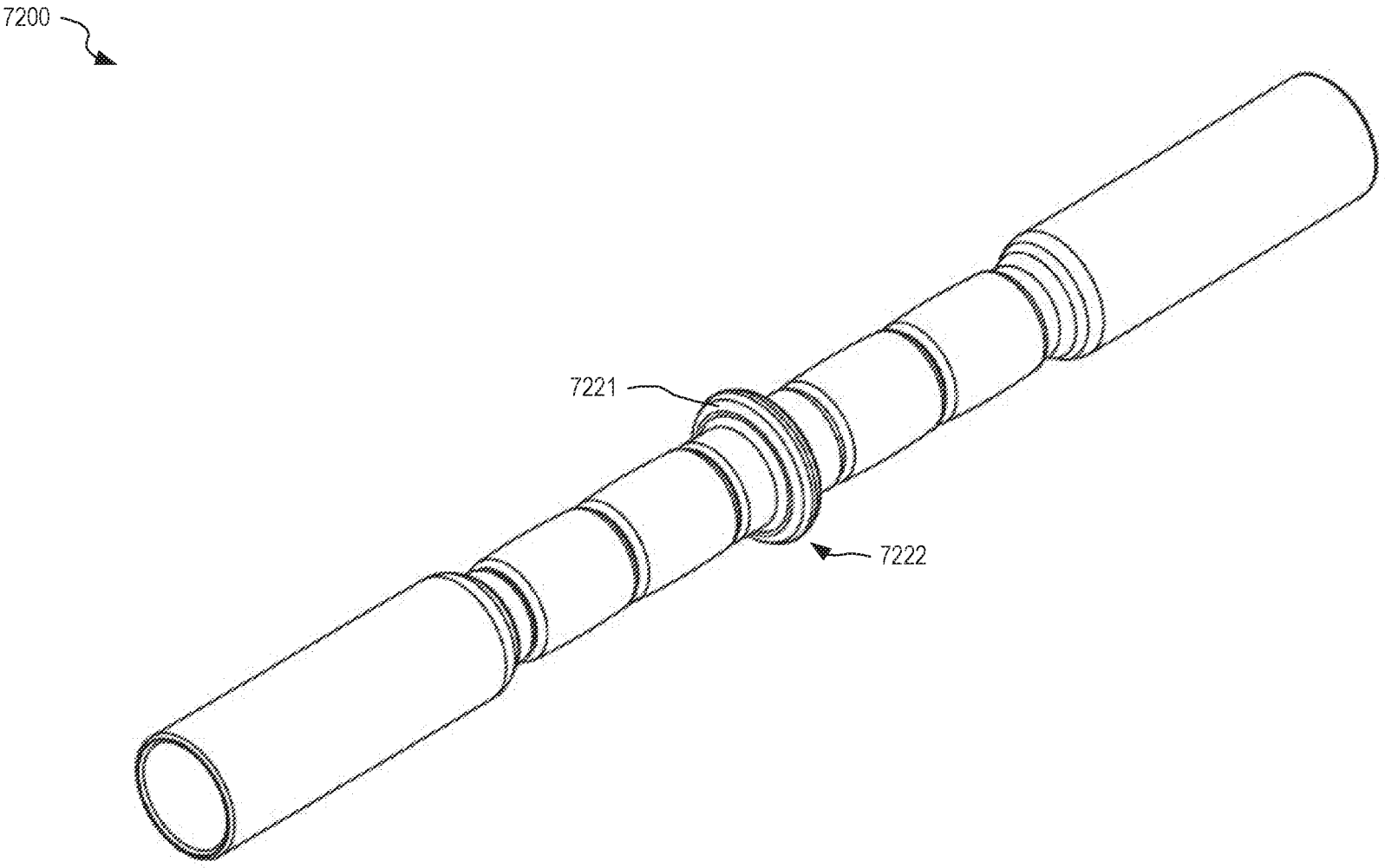

FIG. 72 is a perspective view illustrating one exemplary portable roller massager with a smooth trigger point ring, in accordance with an embodiment of the disclosure.

DETAILED DESCRIPTION OF THE EMBODIMENTS

It is therefore desirable to provide a portable roller massager device capable of being made smaller without compromising the efficacy of the device.

The present disclosure provides in some embodiments a portable device for massaging and treating a person's muscles. The device may include an elongate center shaft and a roller section rotatably positioned about the outer surface of the elongate cylindrical center shaft and extending at least a portion of a distance between a first end and a second end of the elongate center shaft. The device also includes a first handle member and a second handle member that are movably attachable to the first end and the second end. The handles allow manual operation of the portable roller massager for body massage, wherein the roller section may rotate around the elongate cylindrical shaft.

Figure 1:
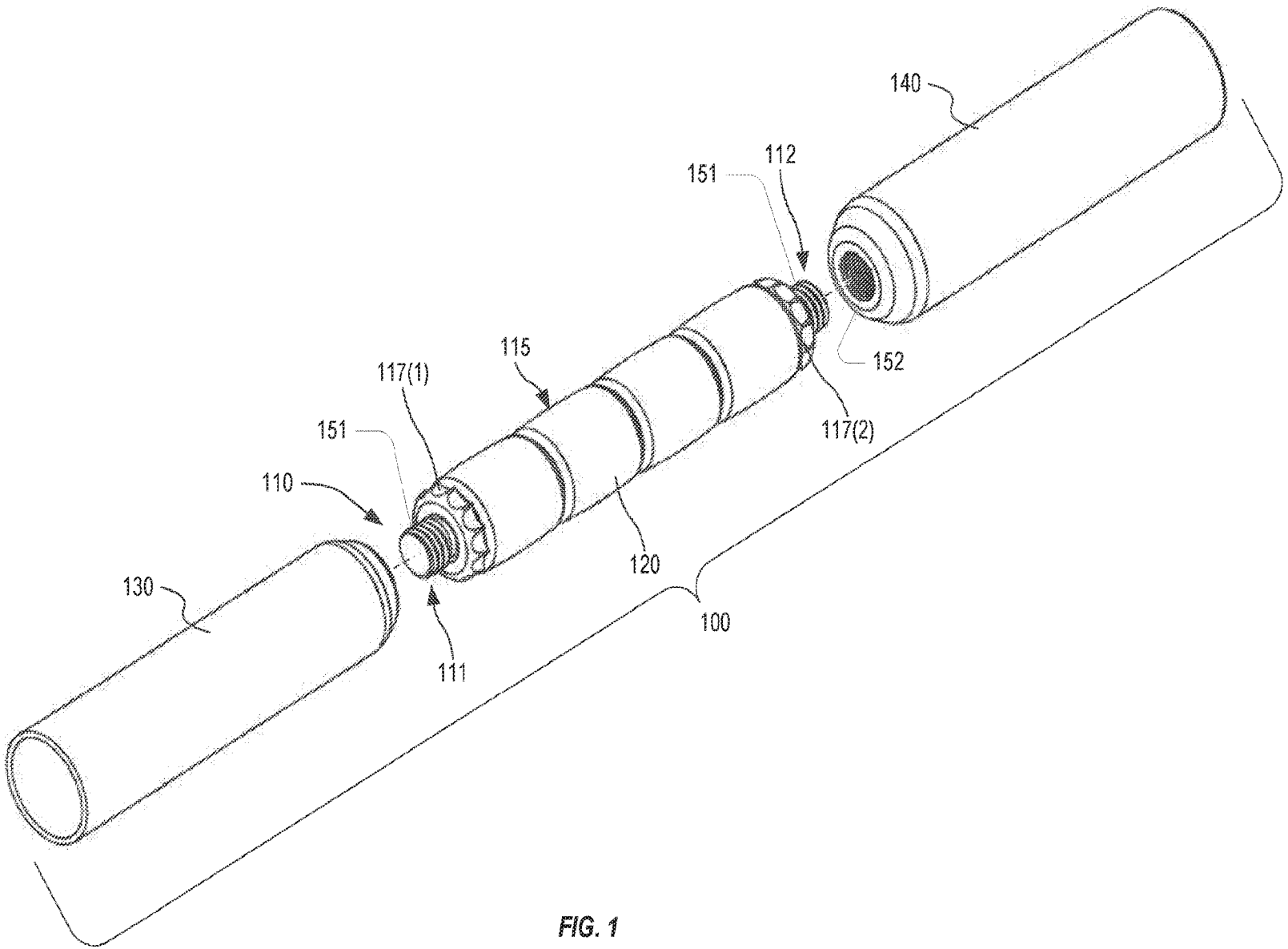
FIG. 1 illustrates a perspective view of a thread-to-connect portable roller massager in accordance with an embodiment of the disclosure.

FIG. 1 illustrates a perspective view of an embodiment of a portable roller massager 100. The roller massager 100 includes an elongate center shaft 110 having an outer surface 115. The elongate center shaft 110 may also have a first end 111 and a second end 112, and a longitudinal axis extending between the first end 111 and the second end 112. Generally, the elongate center shaft 110 may be cylindrical in shape, as illustrated in FIG. 1. The elongate center shaft 110 may be formed from a plastic, metal, wood, or polymer tubing or solid rod, or any other material suitable for forming the elongate center shaft 110.

FIG. 1 also illustrates a roller section 120, rotatably positioned around the outer surface 115 of the elongate center shaft 110. The roller section 120 may extend from the first end 111 of the elongate center shaft 110 to the second end 112 of the elongate center shaft 110. Alternatively, the roller section 120 may extend only a portion of the elongate center shaft 110. The roller section 120 may be configured to rotate 360 degrees freely about the outer surface 115 of the elongate center shaft 110. However, any suitable range of rotation could also be used. The roller section 120 may take the form of multiple segments of uniform length, as illustrated in the embodiment in FIG. 1. Alternatively, the roller section 120 may have a unibody construction, segments having different lengths, or any other suitable construction (not shown). The outer surface of the roller section 120 may have a generally curved or cylindrical shape, but any suitable geometry may be used. The outer surface of the roller section 120 may include a texture that may be in the form of ridges, as well as many other forms suitable for the purpose of treating a person's musculature. The texture may also be configured to cover all of or just a portion of the outer surface of the roller section 120. The roller section 120 may be formed from any suitable material such as foam, rubber, or any durometer plastic, or thermoplastic elastomer.

Also, as illustrated in FIG. 1, a first handle member 130 and a second handle member 140 may be movably attached to the first end 111 and second end 112 of the elongate cylindrical center shaft 110 of the roller massager 100. The first and/or second handle members 130 and 140 may be attached such that either one of the members may be easily removed or detached. A number of different forms of attachment may be used such as thread-to-connect, twist-to-connect, and push-to-connect. The first and second handle members 130 and 140 may also be held in place frictionally, or by any other means suitable for connecting them to the elongate center shaft 110. The shape of the first and second handle members 130 and 140 may be configured such that the roller section 120 is prevented from sliding off the elongate center shaft 110. The handle members 130 and 140 may be formed from any suitable material such as plastic, foam, or rubber. The handle members 130 and 140 may also include a textured outer surface in order to improve the user's grip on the roller massager 100.

The roller massager 100 may also include washers 117 at the first end 111 and second end 112 of the elongate center shaft 110. The washers 117 may be used to hold the roller section 120 on the elongate center shaft 110. In some embodiments, at least one of these washers 117 may be removed such that the roller section 120 may be exchanged for a different roller section.

A number of embodiments relating to the forms of connection between the elongate center shaft 110 and the first and second handle members 130 and 140 are described herein.

Figure 2A:
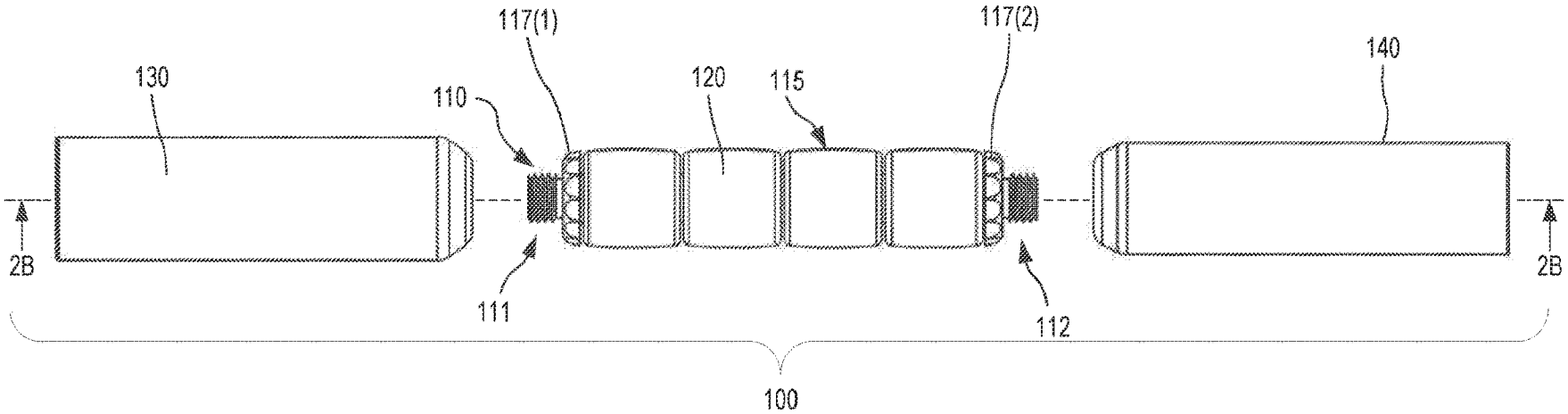
FIGS. 2A and 2B illustrate, respectively, a side view, and a cross section view of the thread-to-connect portable roller massager in accordance with an embodiment of the disclosure.
Figure 2B:
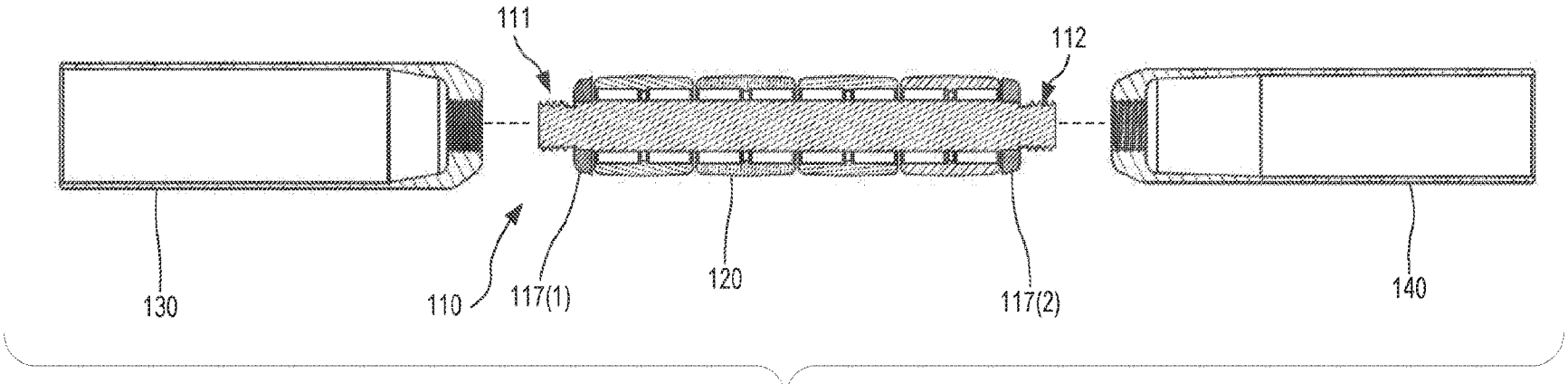
Figure 3:
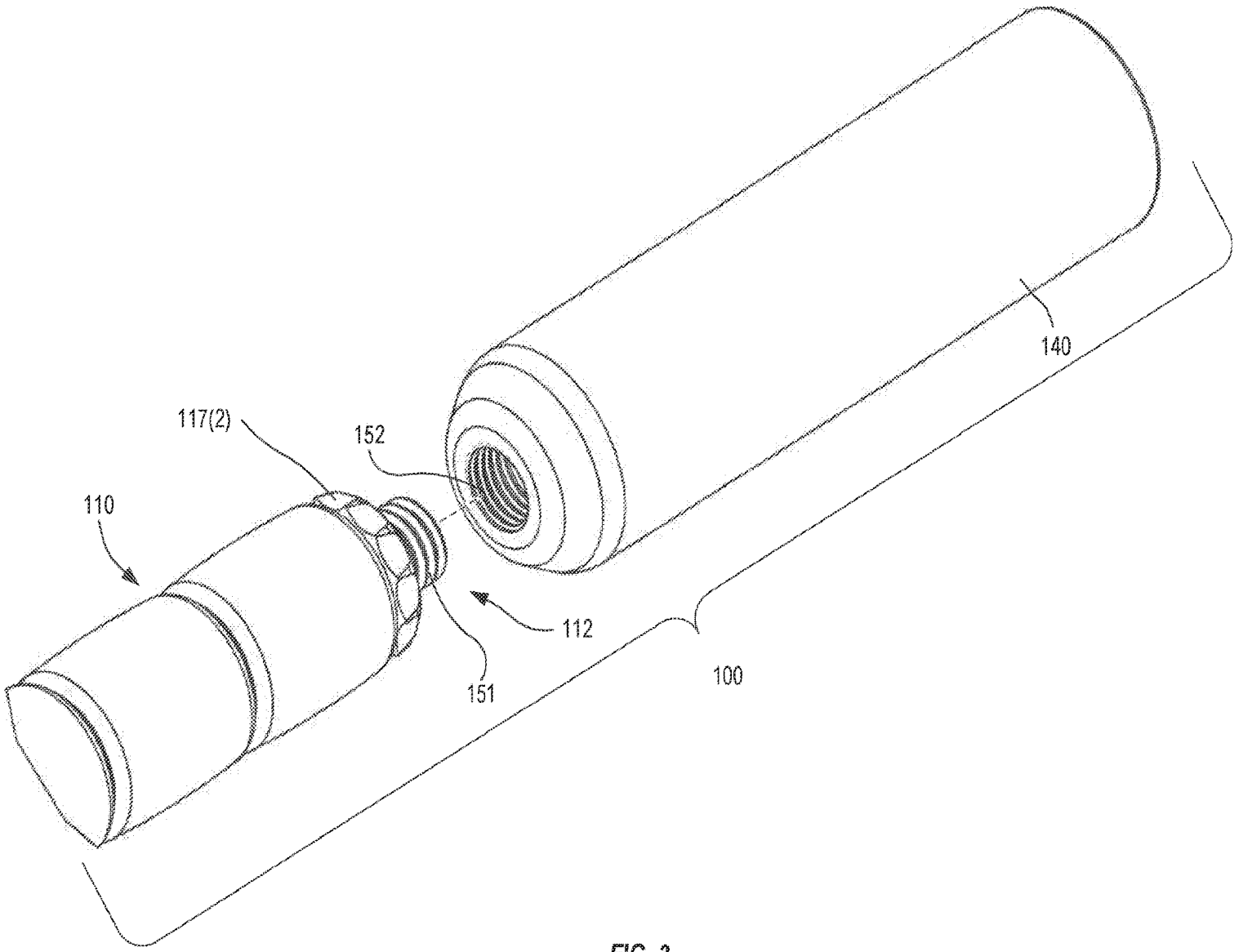
FIG. 3 illustrates a close up perspective view a thread-to-connect connection in accordance with an embodiment of the disclosure.
Figure 4A:
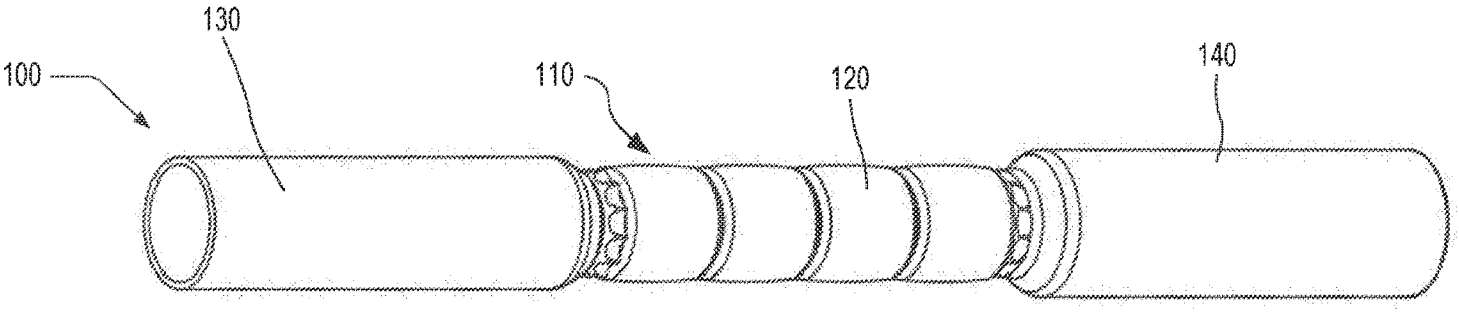
FIGS. 4A, 4B, and 4C illustrate, respectively, a perspective view, a side view, and a cross section view of a portable roller massager in accordance with an embodiment of the disclosure.
Figure 4B:
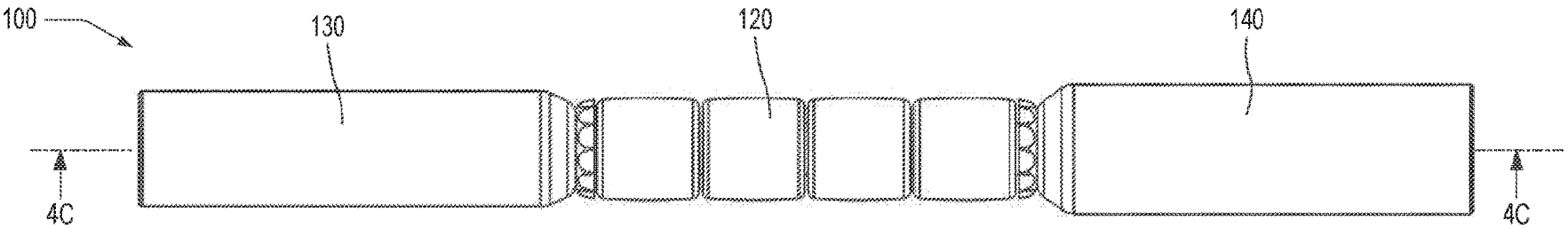
Figure 4C:
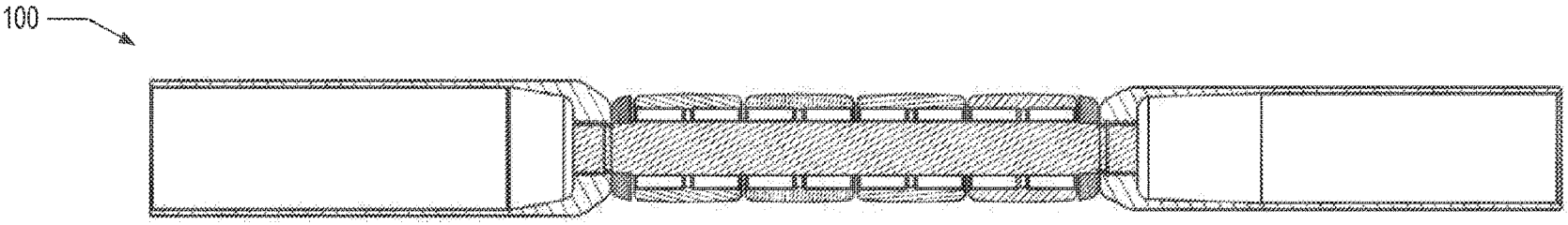

The first embodiment of connection is a thread-to-connect connection. FIG. 1 illustrates a perspective view of this connection, in which first end 111 and second end 112 each include male threads 151 and handles 130 and 140 include female threads 152 that fit onto the male threads of ends 111 and 112. FIGS. 2A and 2B illustrates, respectively, a side view and a cross section view in a plane 2B of FIG. 2A. FIG. 3 illustrates a close up perspective view. FIGS. 4A, 4B, and 4C illustrates, respectively, a perspective view and a cross section view, in a plane 4C of FIG. 4B, after the first and second handle members 130 and 140 have been connected to the elongate center shaft 110.

Figure 5A:
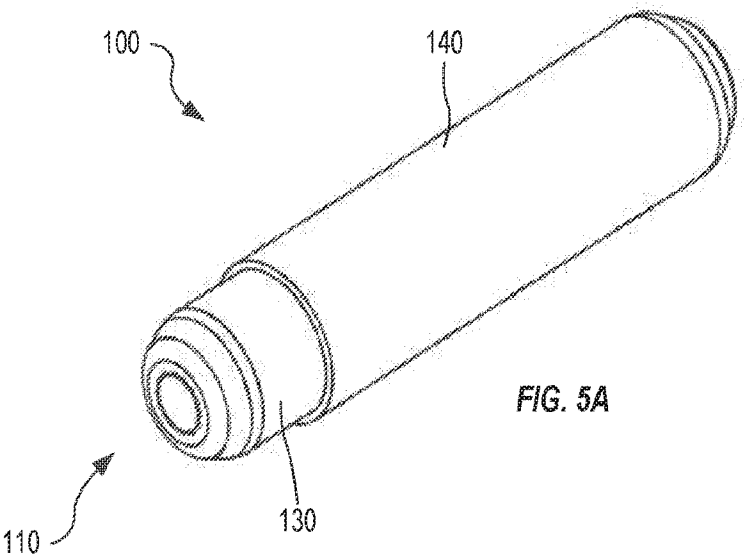
FIGS. 5A, 5B, and 5C illustrate, respectively, a perspective view, a side view, and a cross section view of a portable roller massager in accordance with an embodiment of the disclosure.
Figure 5B:
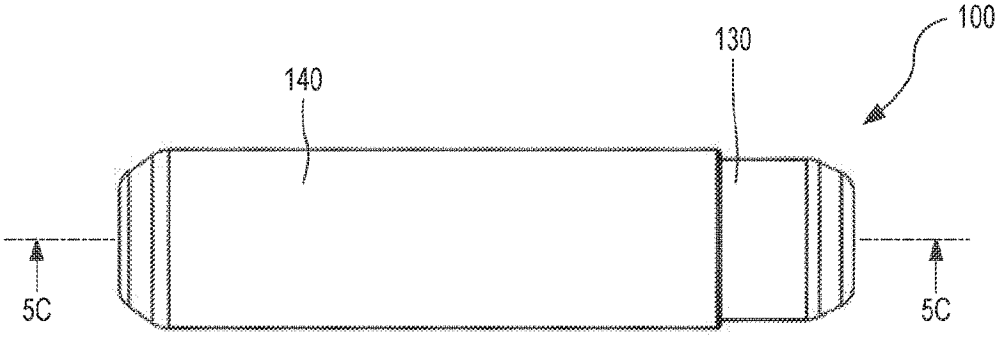
Figure 5C:
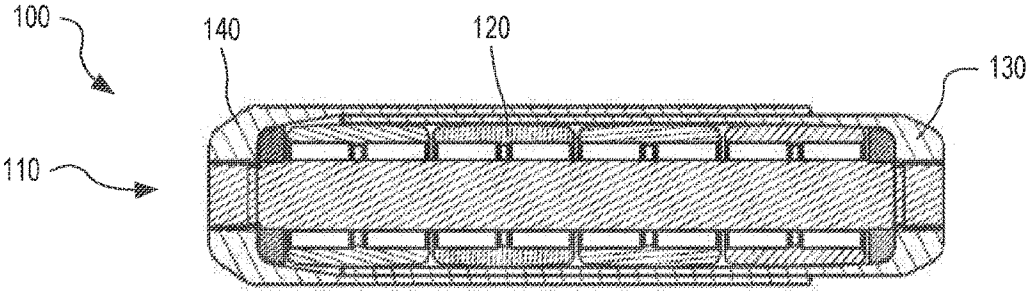

The first and second handle members 130 and 140 may be solid (not shown). Alternatively, they may be hollow, as shown in the aforementioned figures. The hollow handle members may offer a storage capability for the portable roller massager 100. More specifically, the first handle member 130 includes a hollow cavity that is sufficient to contain the elongate center shaft 110 and roller section 120, or part of them. The second handle member 140 includes a hollow cavity that is sufficient to contain the first handle member 130 (that already contains contain all or part of the elongate center shaft 110 and roller section 120), or a part of it. This allows the user to reduce the overall size of the portable roller massager 100 for the ease of carrying and storage. FIGS. 5A, 5B, and 5C illustrates, respectively a perspective view and a cross section view of the portable roller massager 100 after it has been reduced in size by first detaching the first and second handle members 130 and 140, and then using them to store the elongate center shaft 110. The cross section view of FIG. 5C is in a plane 5C of FIG. 5B.

Figure 6:
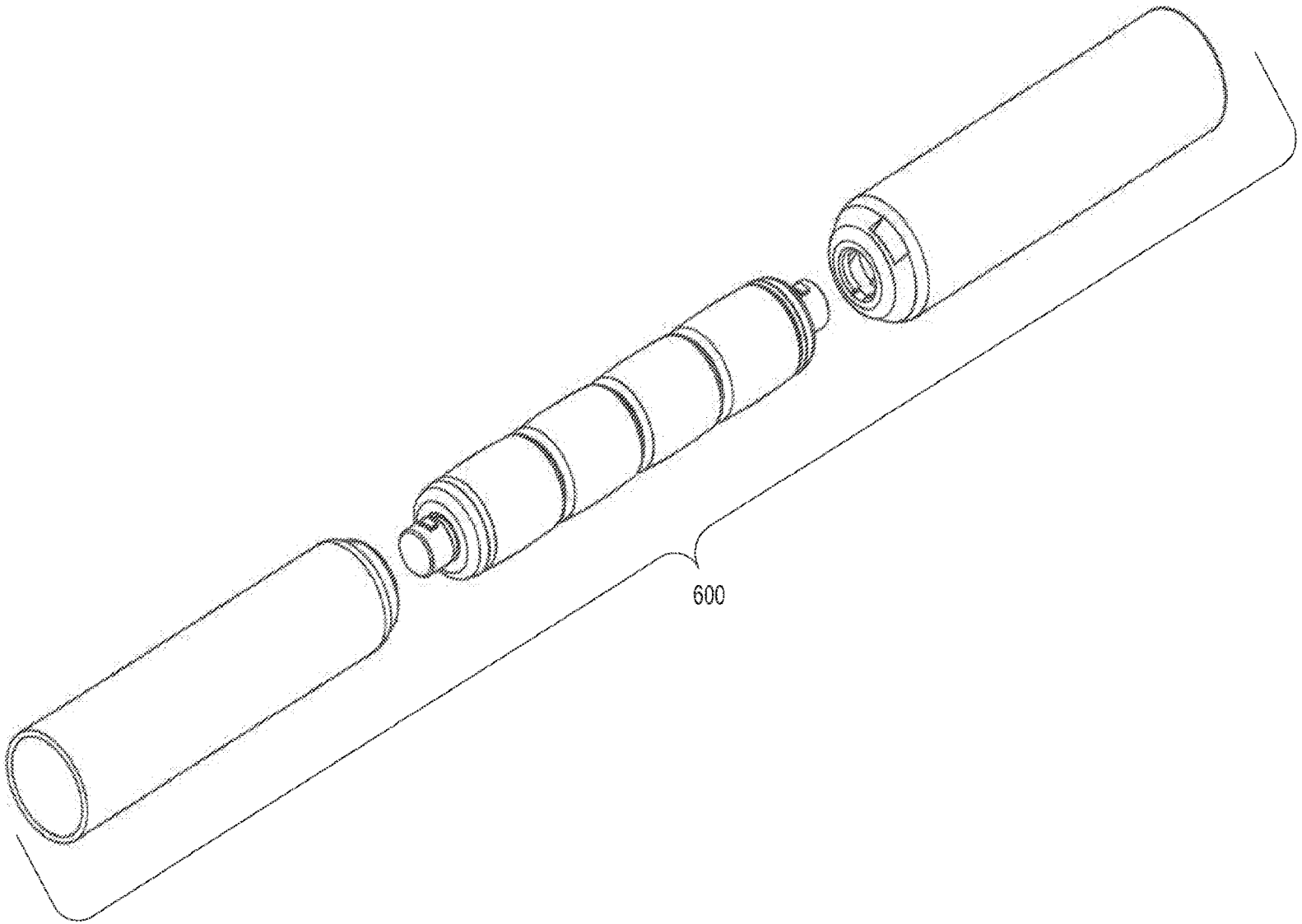
FIG. 6 illustrates a perspective view of a twist-to-connect portable roller massager in accordance with an embodiment of the disclosure.
Figure 7:
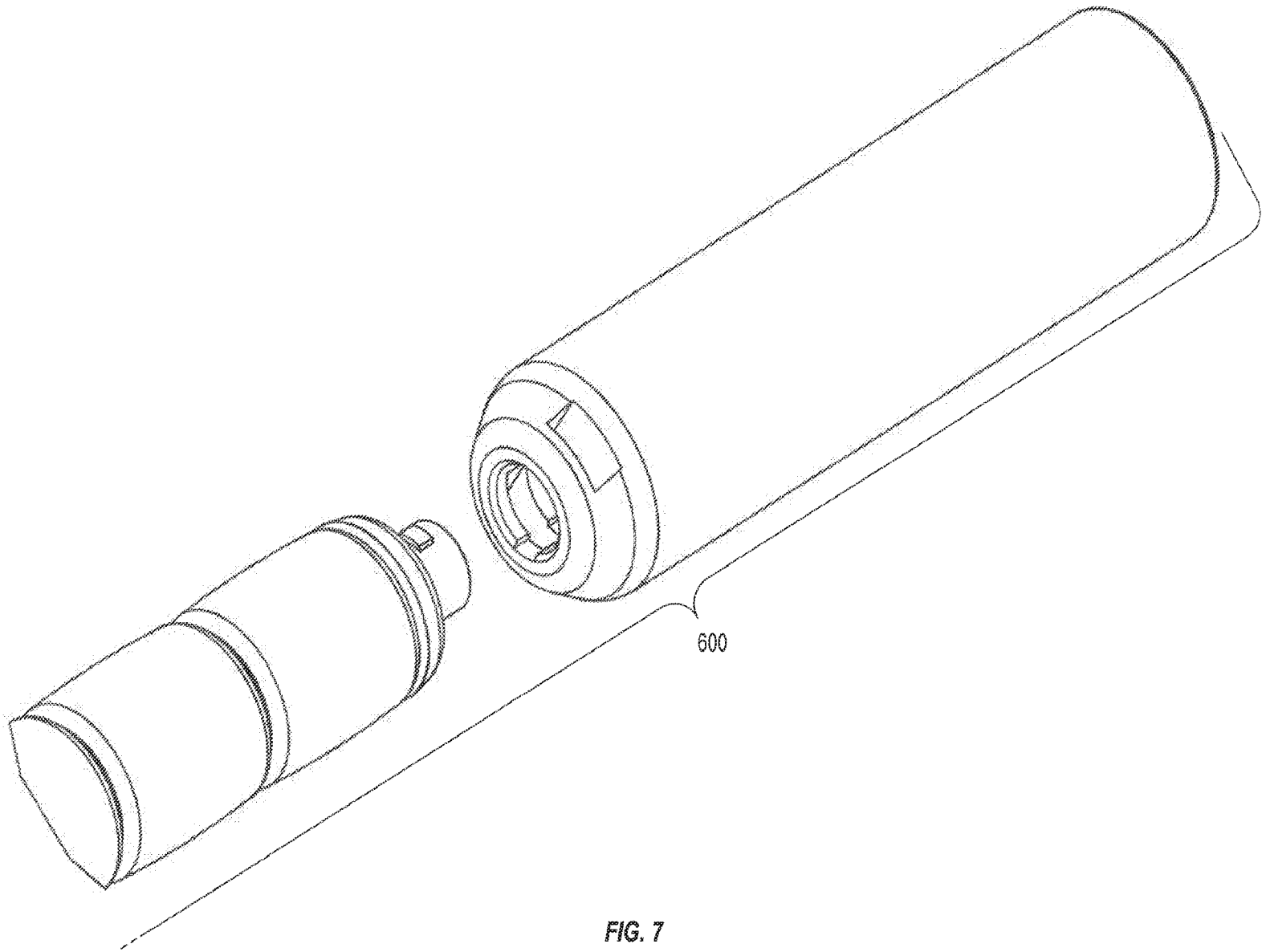
FIG. 7 illustrates a close up perspective view a twist-to-connect connection in accordance with an embodiment of the disclosure.

The second embodiment of connection is a twist-to-connect connection. FIG. 6 illustrates a perspective view of a portable roller massager 600 that employs a twist-to-connect connection. FIG. 7 illustrates a close up perspective view of portable massager 600.

Figure 8:
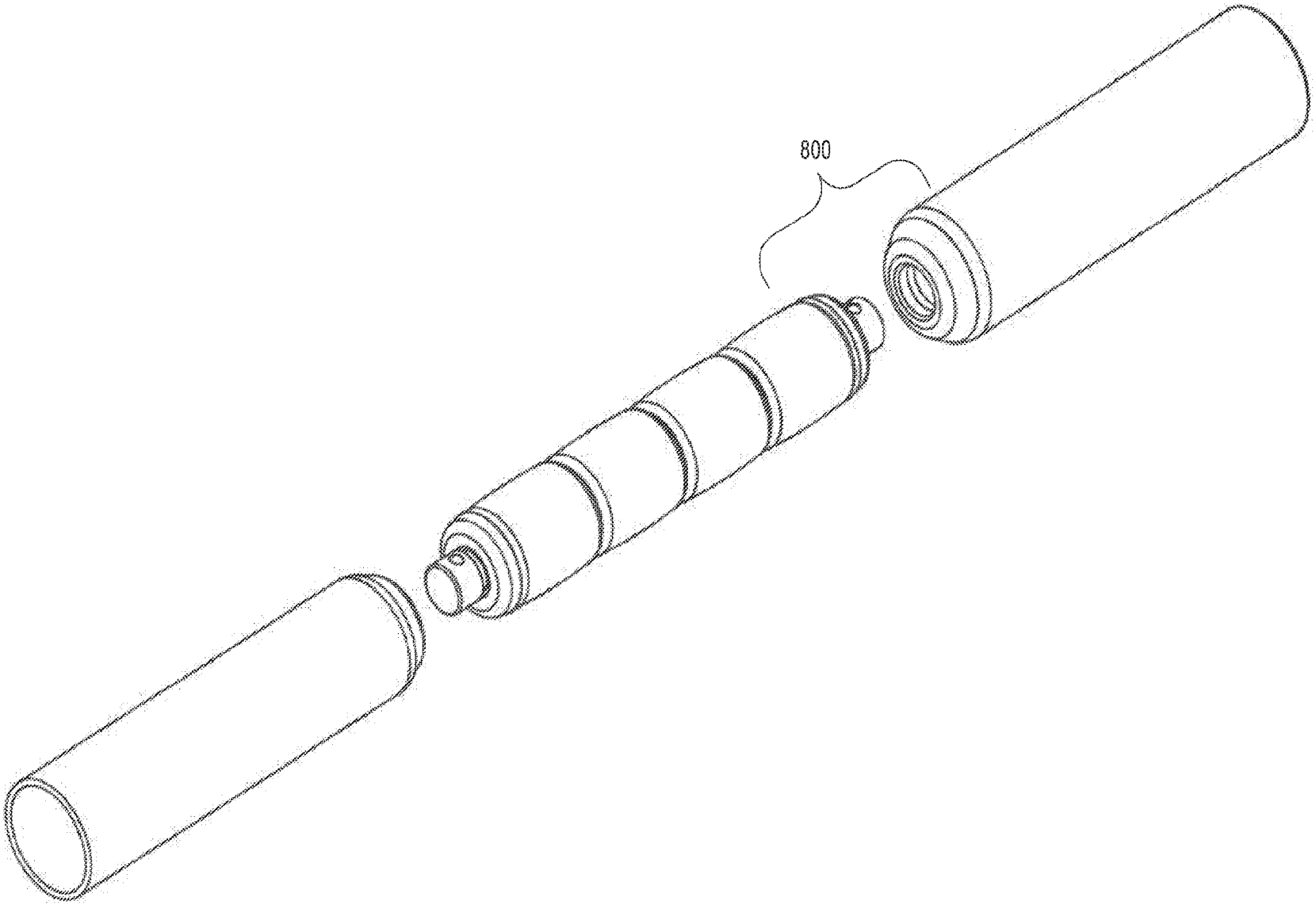
FIG. 8 illustrates a perspective view of a push-to-connect portable roller massager in accordance with an embodiment of the disclosure.
Figure 9:
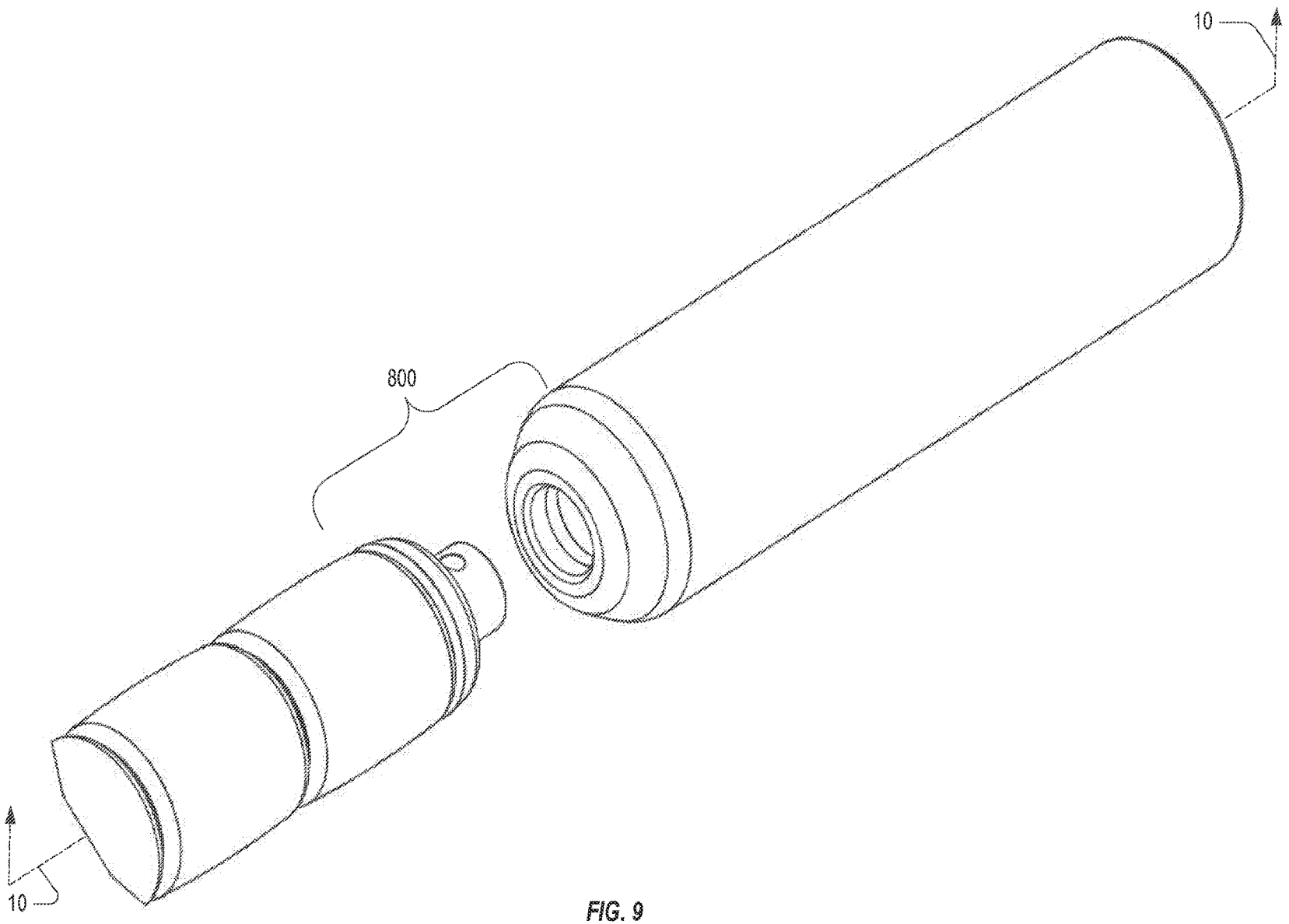
FIG. 9 illustrates a close up perspective view a push-to-connect connection in accordance with an embodiment of the disclosure.
Figure 10:
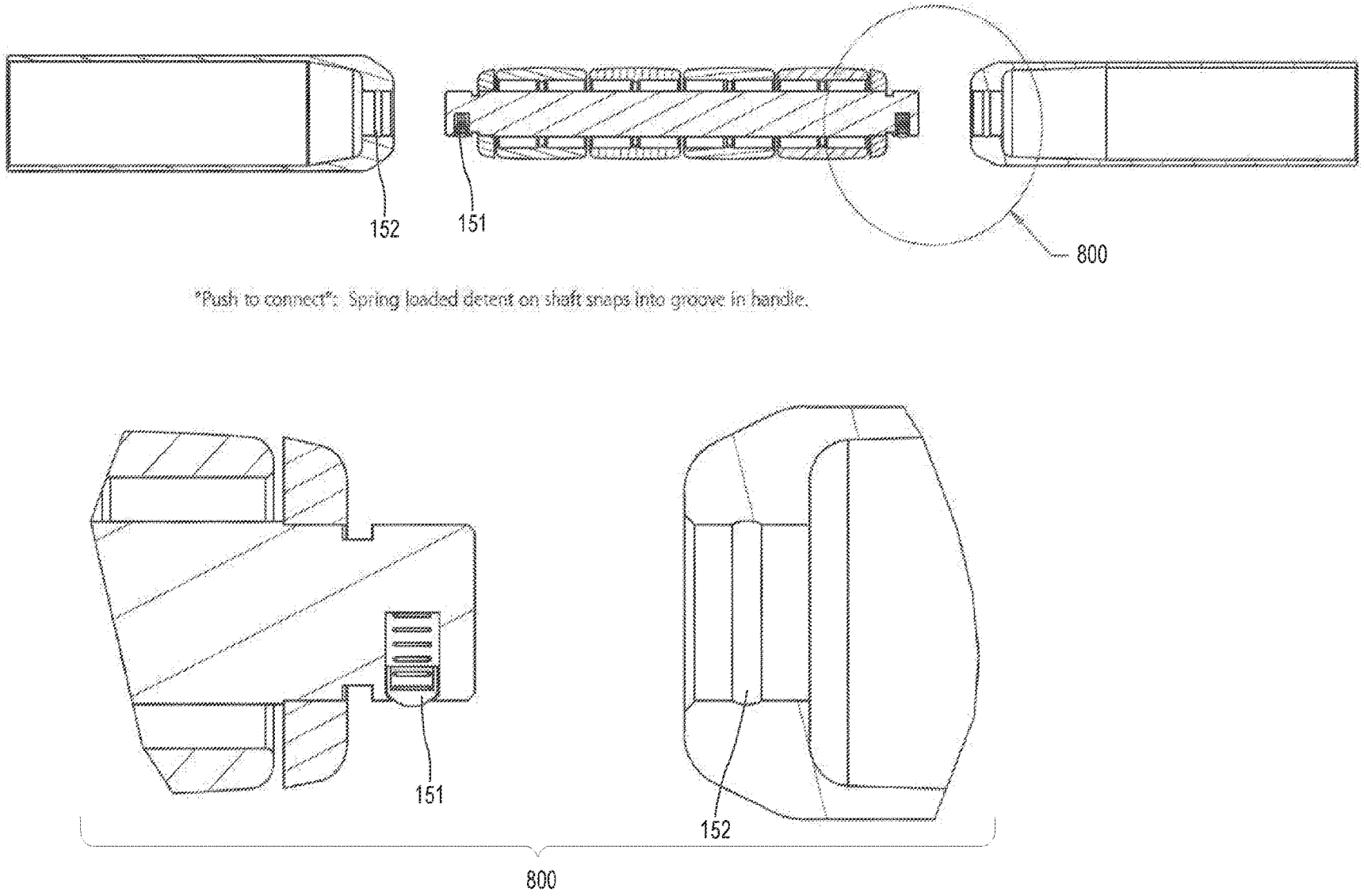
FIG. 10 illustrates cross section views of the push-to-connect connection in accordance with an embodiment of the disclosure.
Figure 11:
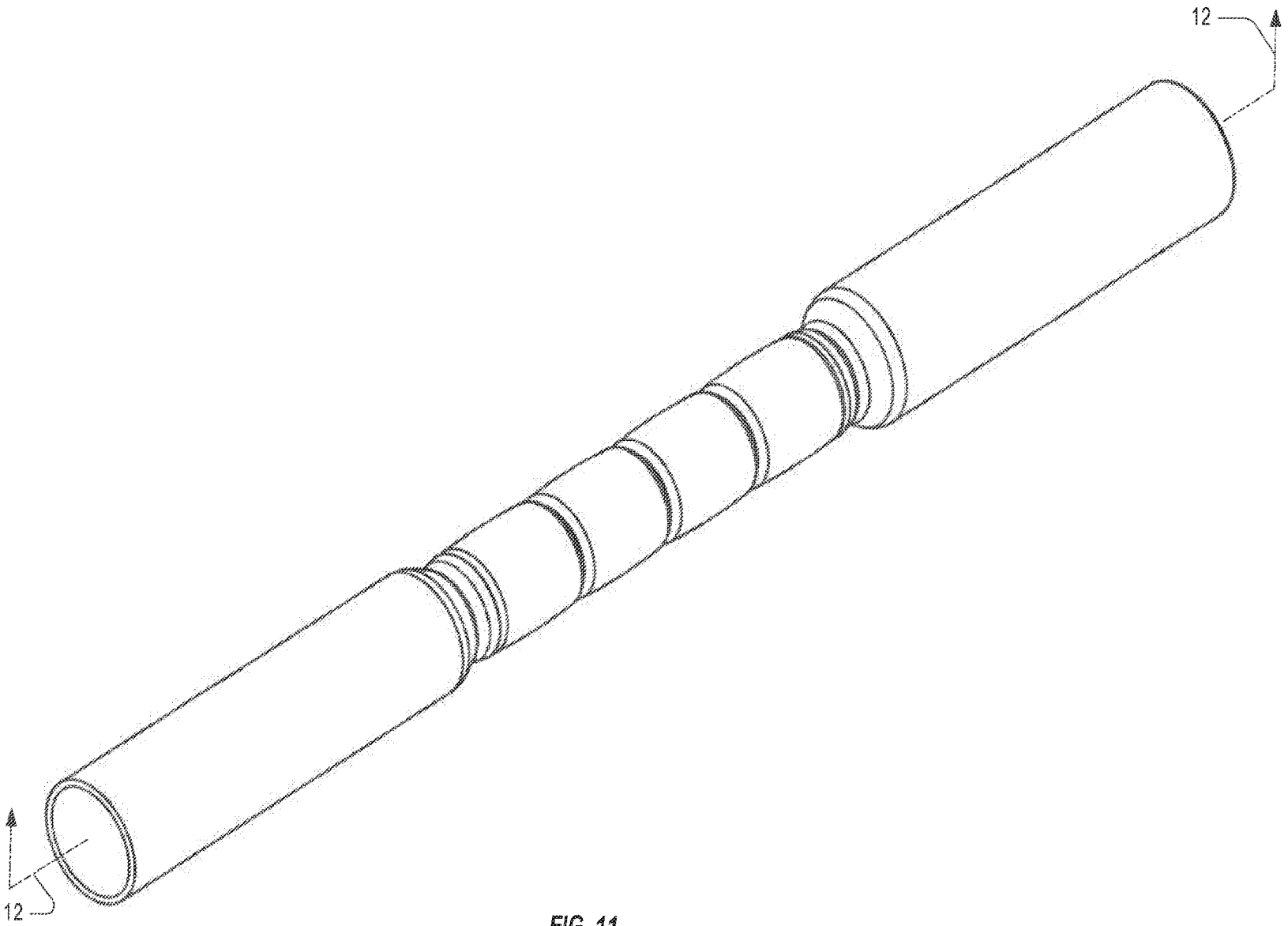
FIG. 11 illustrates a perspective view of a portable roller massager in accordance with an embodiment of the disclosure.
Figure 12:
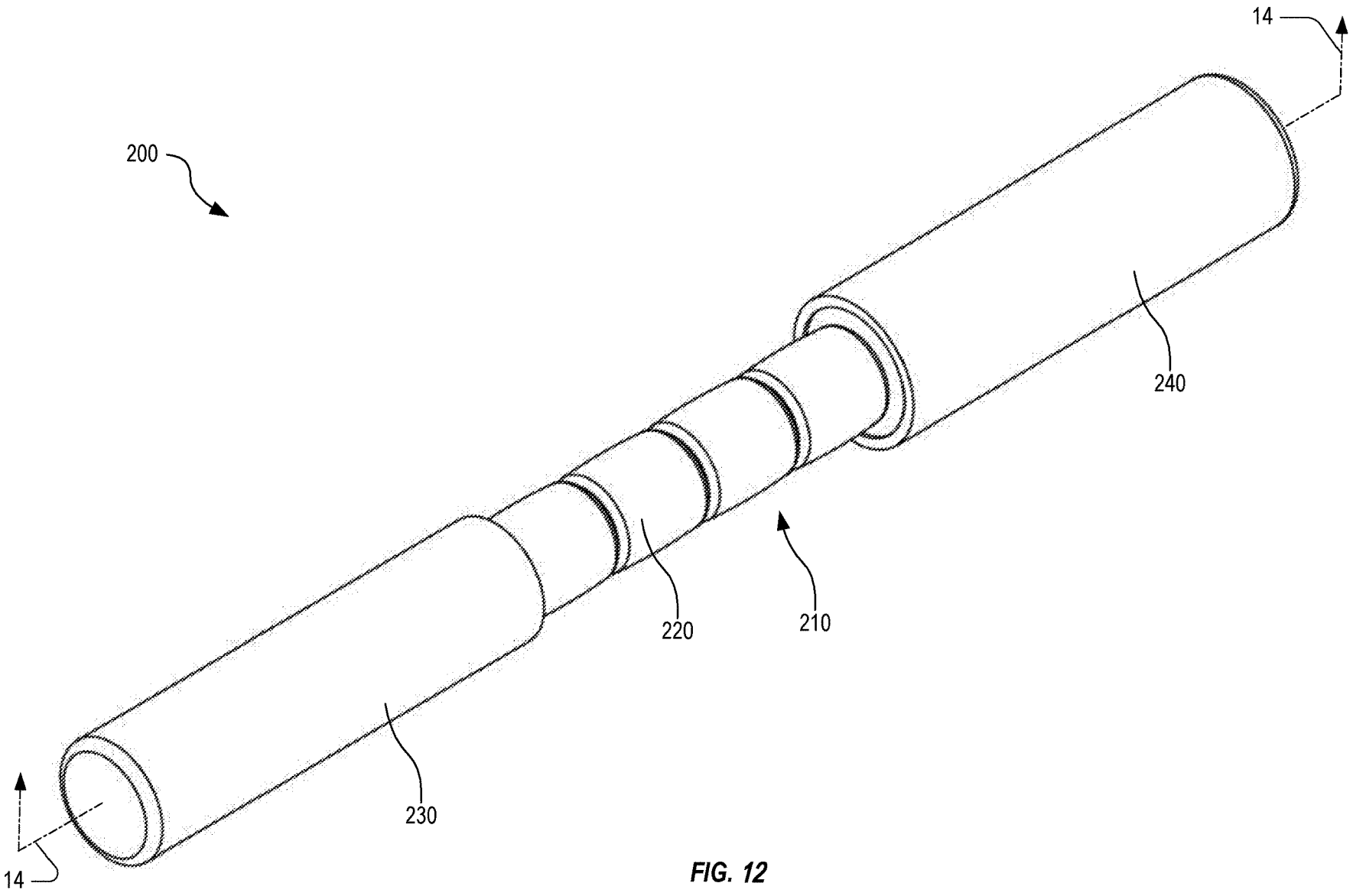
FIG. 12 illustrates cross section views of a push-to-connect connection in accordance with an embodiment of the disclosure.

The third embodiment of the connection is a push-to-connect connection. FIG. 8 illustrates a perspective view of such a connection, a push-to-connect connection 800. FIG. 9 illustrates a close up perspective view of push-to-connect connection 800. FIG. 10 illustrates cross section views of push-to-connect connection 800 in a plane 10 of FIG. 9. Particularly, a spring loaded detent 651 on the elongate center shaft 110 snaps into a groove 652 in the first or second handle member 130 or 140. FIG. 11 illustrates a perspective view of after the first and second handle members 130 and 140 have been connected to the elongate center shaft 110. FIG. 12 illustrates cross section views after the first or second handle members 130 or 140 have been connected to the elongate center shaft 110 in the push-to-connect connection embodiment. The cross section views of FIG. 12 are in a plane 12 of FIG. 11.

Figure 13:
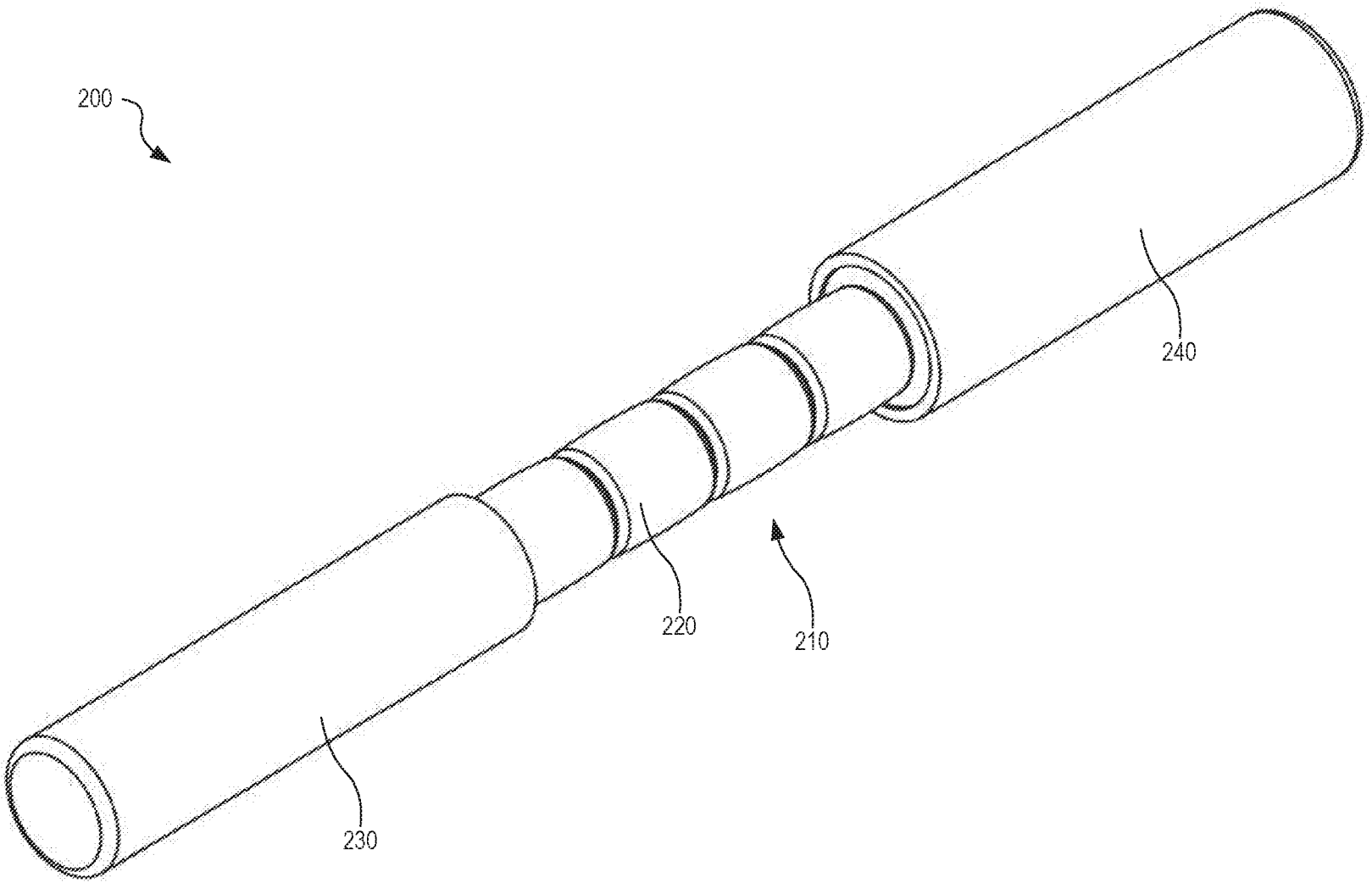
FIG. 13 illustrates a perspective view of a portable roller massager in accordance with an embodiment of the disclosure.
Figure 14:
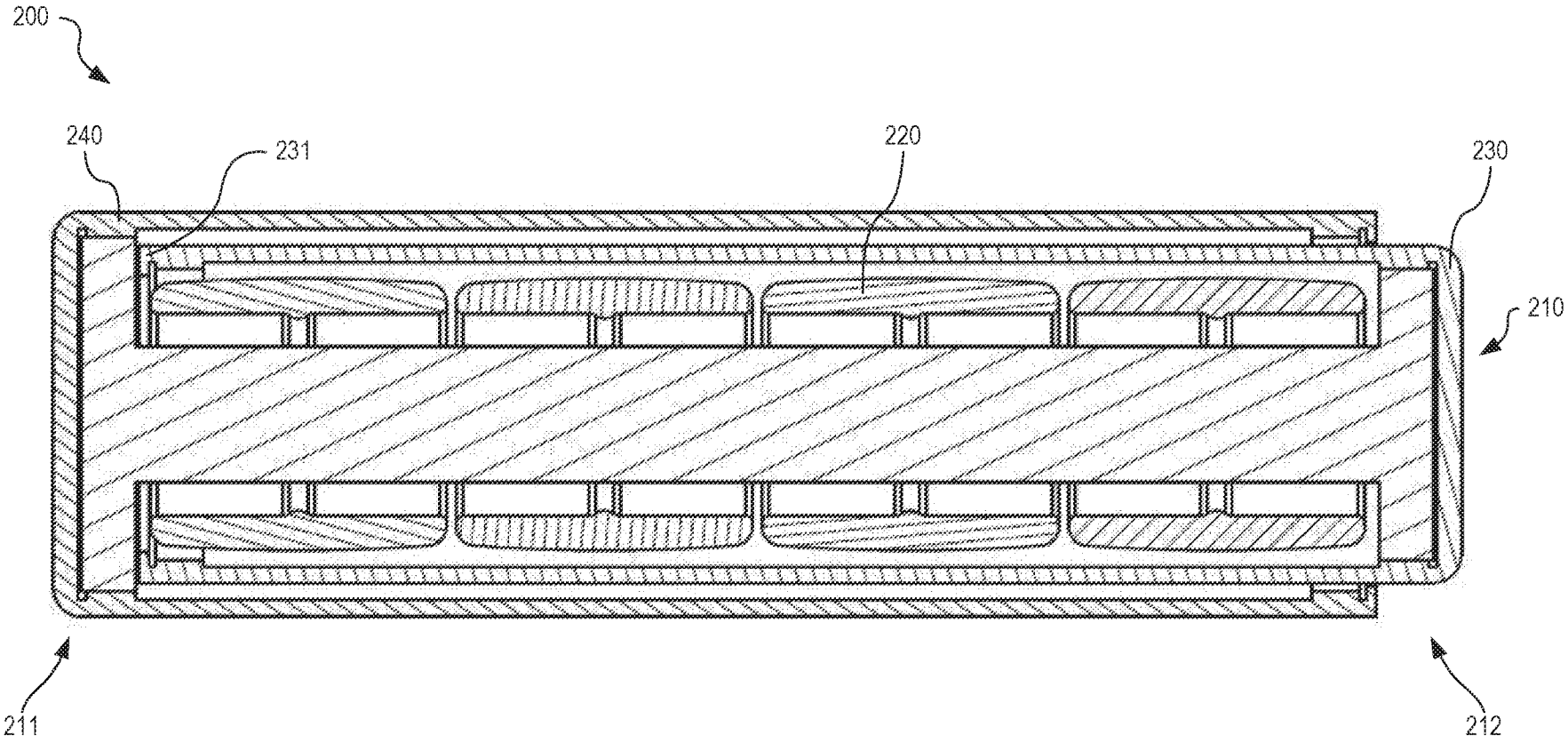
FIG. 14 illustrates a cross section view of a portable roller massager in accordance with an embodiment of the disclosure.

An alternative embodiment of a portable roller massager 200 is illustrated in FIGS. 13, 14, 15, and 16. As shown in FIGS. 13 and 14, the portable roller massager 200 includes an elongate center shaft 210 having a first end 211 and a second end 212. Additional disclosure of these parts is similar to the disclosure of parts 110, 111, and 112 as described above. Also, a roller section 220 is rotatably positioned about the outer surface of the elongate center shaft 210. Additional disclosure of these parts is similar to the disclosure of part 120 as described above.

Figure 15:
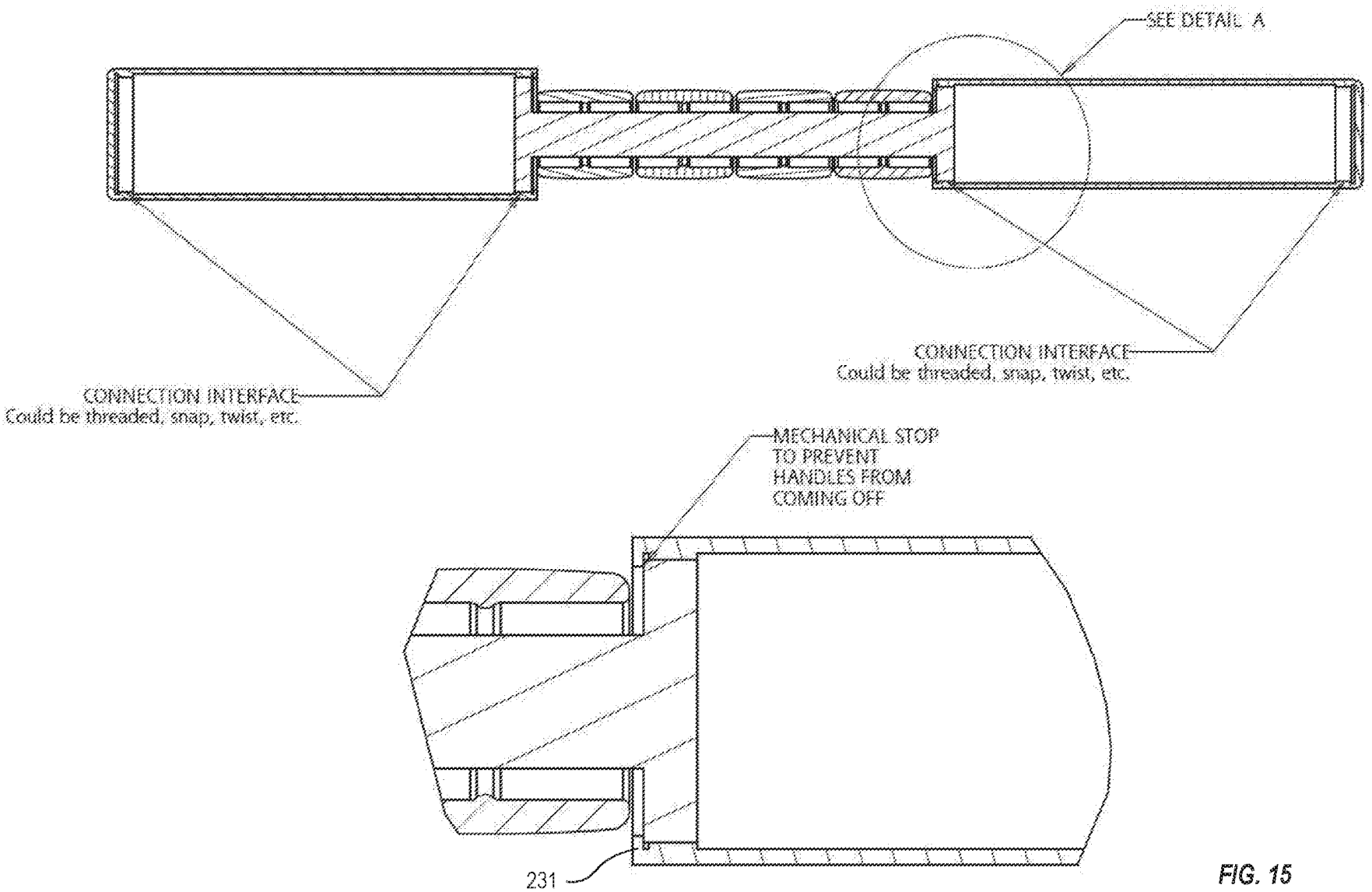
FIG. 15 illustrates cross section views of several connection interfaces in accordance with several embodiments of the disclosure.
Figure 16:
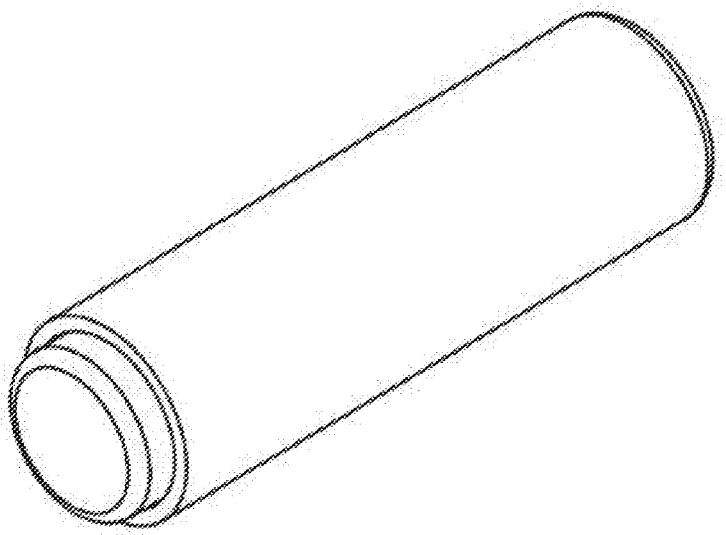
FIG. 16 illustrates a perspective view of a portable roller massager in accordance with an embodiment of the disclosure.

The roller massager 200 includes a first handle member 230 and a second handle member 240, as shown in FIG. 13. The first handle member 230 and the second handle member 240 are alternatively known as "captive handles" because they are not completely detached from the elongate center shaft 210. They are capable of being extended and collapsed, as they slide outward and inward, respectively. FIGS. 13 and 15 illustrate the first handle member 230 and the second handle member 240 in an extended position. FIGS. 14 and 16 illustrate the first handle member 230 and the second handle member 240 in a collapsed position. The cross section views of FIGS. 14 and 16 are in a plane 14 of FIG. 13. As an example shown in FIG. 14, the first handle member 230 covers at least a portion of the elongate center shaft 210 and the roller section 220, whereas the second handle member 240 covers at least a portion of the first handle member 230. The first handle member 230 and the second handle member 240 are capable of being locked into positions with the first end 211 and the second end 212 of the elongate center shaft 210 at connection interfaces, as illustrated in FIG. 15. These connection interfaces may be threaded, snap, twist, or any other means known in the art. Mechanical stops 231 prevent the first handle member 230 and the second handle member 240 from being completed detached from the elongate center shaft 210, as shown in FIGS. 14 and 15.

Detent Connection

FIG. 17 is a perspective view illustrating one exemplary portable roller massager 1700 with detent push-to-connect connections 1702, in accordance with an embodiment of the disclosure. FIG. 18 is a front elevation of portable roller massager 1700. FIG. 19 is a cross section through portable roller massager 1700 in plane 19 of FIG. 17. FIGS. 17-19 are best viewed together with the following description.

Portable roller massager 1700 is similar to portable roller massager 100 of FIG. 1. The roller massager 1700 has an elongate center section 1710 having an outer surface 1715 formed by a plurality of roller sections 1720 rotatably positioned on a shaft 1902 (see FIG. 19) that extends between outer handle 1730 and inner handle 1740. Shaft 1902 is cylindrical in shape and may be formed as a tube or solid rod from one or more of plastic, metal, wood, polymer, any other suitable material.

Although shown with four roller sections 1720(1)-(4), portable roller massager 1700 may have more or fewer roller sections 1720 without departing from the scope hereof. Roller sections 1720 are shown filling the space between the outer handle 1730 and the inner handle 1740; however, roller sections 1720 may cover only a portion of shaft 1902 between handles 1730 and 1740. Each roller section 1720 may rotate 360 degrees around shaft 1902. However, any other suitable range of rotation could also be used. The roller sections 1720 may be of uniform length, as illustrated in the embodiment in FIG. 17. Alternatively, roller section 1720 may have a unibody construction, segments having different lengths, or any other suitable construction (not shown). The outer surface of the roller section 1720 may have a generally curved or cylindrical shape, but any suitable geometry may be used. The outer surface of the roller section 1720 may include a texture that may be in the form of ridges, as well as many other forms suitable for the purpose of treating a person's musculature. The texture may also be configured to cover all of or just a portion of the outer surface of the roller section 1720. The roller section 1720 may be formed from any suitable material such as foam, rubber, or any durometer plastic, thermoplastic elastomer, and any combination thereof.

Outer handle 1730 and inner handle 1740 are removably attached to the ends of shaft 1902 of elongate cylindrical center 1710. The inner handle 1740 and/or outer handle 1730 are configured such that one or both handles 1730, 1740 may be easily detached. In the embodiment, of FIG. 17, handles 1730, 1740 are secured to shaft 1902, FIG. 19, by detents 1904(1) and 1904(2), respectively. Detents 1904(1) and 1904(2) are for example O-rings, springs, and other such mechanical mechanisms for securing handles 1730, 1740 to shaft 1902. The handles 1730 and 1740 may be formed from any suitable material such as plastic, foam, or rubber. The handles 1730 and 1740 may also include a textured outer surface in order to improve a user's grip on the roller massager 1700.

Roller sections 1720 are retained on shaft 1902 by two roller stops 1704(1) and 1704(2) positioned towards either end of shaft 1902.

FIGS. 20, 21, and 22 shows one exemplary roller section 1720 of the portable roller massager of FIG. 17. Roller section 1720 is similar to roller section 120 of FIG. 1.

FIG. 23 is a cross-section through inner handle 1740 of portable roller massager 1700 in plane 19 of FIG. 17. A connection end of inner handle 1740 is configured with an aperture 2310 having a diameter 2306 for receiving one end of shaft 1902. An internal surface of aperture 2310 has a groove 2308 for receiving detent 1904(1) to removably secure shaft 1902 within aperture 2310. An open end of inner handle 1740 has an internal diameter 2302 to fit over roller sections 1720, and an outer diameter 2304.

FIG. 24 is a cross-section through the outer handle 1730 of the portable roller massager 1700 in plane 19 of FIG. 17. Outer handle 1730 has an aperture 2410 that is similar to aperture 2310 of inner handle 1740 and receives the other end of shaft 1902. Aperture 2410 has a groove 2408 for receiving detent 1904(2) to removably secure shaft 1902 within aperture 2410. An opposite end of outer handle 1730 has an internal diameter 2402 that is slightly larger than outer diameter 2304 of inner handle 1740 and an outer diameter 2404.

FIG. 25 is a cross-section showing greater detail of the outer handle 1730 of FIG. 23 illustrating the detent groove 2408 within aperture 2410 for receiving detent 1904(2) to removably secure outer handle 1730 to shaft 1902. An internal diameter 2506 of aperture 2410 corresponds to a diameter of shaft 1902.

FIG. 26 is a front elevation of the shaft 1902 of FIG. 19 illustrating exemplary dimensions for construction. Ends of shaft 1902 are similar and each has a groove 2602 for receiving one roller stop 1704, when roller sections 1720 are positioned on a center portion of shaft 1902.

FIG. 27 is a side elevation of one exemplary roller stop 1704 of the portable roller massager of FIG. 17. FIG. 28 is a front elevation of one exemplary roller stop 1704 of the portable roller massager of FIG. 17. Roller stop 1704 has an internal diameter 2702 that is sized such that roller stop 1704 is retained within groove 2602 of shaft 1902.

FIG. 29 is a perspective view of the portable roller massager of FIG. 17 configured for carrying. FIG. 30 is a front elevation of the portable roller massager of FIG. 17 configured for carrying. FIG. 31 is a cross-section of the portable roller massager of FIG. 17 configured for carrying. As shown in FIG. 29, one end of shaft 1902 is removably secured within inner handle 1740 such that roller sections 1720 and the elongate center section 1710 is at least partially within inner handle 1740. Outer handle 1730 is removable retained by the opposite end of shaft 1902 such that inner handle 1740 is within outer handle 1730, as shown. Thus, portable roller massager 1700 is compact and easy to carry.

Equal Sized Handles

FIG. 32 is a perspective view illustrating one exemplary portable roller massager 3200 with a detent push-to-connect connection and equal sized handles 3230, in accordance with an embodiment of the disclosure. FIG. 33 is a front elevation of the portable roller massager 3200 of FIG. 32. FIG. 34 is a cross section through the portable roller massager of FIG. 32. FIGS. 32-24 are best viewed together with the following description.

Portable roller massager 3200 is similar to portable roller massager 100 of FIG. 1 and portable roller massager 1700 of FIG. 17. The roller massager 3200 has an elongate center section 3210 having an outer surface 3215 formed by a plurality of roller sections 3220 rotatably positioned on a shaft 3402 (see FIG. 34) that extends between handle 3230(1) and handle 3230(2). Roller sections 3220 may be retained on shaft 3202 by roller stops 3204(1) and 3204(2). Shaft 3402 is cylindrical in shape and may be formed as a tube or solid rod from one or more of plastic, metal, wood, polymer, any other suitable material.

Although shown with four roller sections 3220(1)-(4), portable roller massager 3200 may have more or fewer roller sections 3220 without departing from the scope hereof. Roller sections 3220 are shown filling the space between handles 3230(1) and 3230(2); however, roller sections 3220 may cover only a portion of shaft 3402 between handles 3230(1) and 3230(2). Each roller section 3220 may rotate 360 degrees around shaft 3402. However, any other suitable range of rotation could also be used. The roller sections 3220 may be of uniform length, as illustrated in the embodiment in FIG. 32. Alternatively, roller section 3220 may have a unibody construction, segments having different lengths, or any other suitable construction (not shown). The outer surface of the roller section 3220 may have a generally curved or cylindrical shape, but any suitable geometry may be used. The outer surface of the roller section 3220 may include a texture that may be in the form of ridges, as well as many other forms suitable for the purpose of treating a person's musculature. The texture may also be configured to cover all of or just a portion of the outer surface of the roller section 3220. The roller section 3220 may be formed from any suitable material such as foam, rubber, or any durometer plastic, thermoplastic elastomer, and any combination thereof.

FIGS. 35, 36, and 37 shows one exemplary roller section 3220 of the portable roller massager 3200 of FIG. 32. FIG. 39 is a front elevation of the shaft of the portable roller massager of FIG. 32. FIG. 40 is a side elevation of one exemplary roller stop 3204 of the portable roller massager of FIG. 32. FIG. 41 is a front elevation of one exemplary roller stop 3204 of the portable roller massager of FIG. 32. The shaft, elongate center section, roller sections, roller stops, and detents of portable roller massager 3200 are similar to those of portable roller massager 1700 and reference to FIGS. 17-31 should be made for further details thereon.

Handles 3230 are similar to one another and are interchangeable. FIG. 38 is a cross-section through one handle 3230 of the portable roller massager 3200 of FIG. 32. A connection end of handle 3230 is configured with an aperture 3810 having a diameter 3806 for receiving one end of the shaft. An internal surface of aperture 3810 has a groove 3808 for receiving a detent (e.g., O-ring, spring, and other such mechanical mechanisms) to removably secure the shaft within aperture 3810. An open end of handle 3230 has an internal diameter 3802 to fit over the roller sections positioned on the shaft. A length 3812 of handle 3230 is selected such that when both handles are reversed and attached to the shaft in preparation for carrying, the handles 3230 meet in the middle of the elongate center section 3210. Handles 3230 may be removably retained on shaft 3402 in a manner similar to retention of handles 1730, 1740 on shaft 1902 of portable roller massager 1700 of FIG. 17.

FIG. 42 is a perspective view of the portable roller massager 3200 of FIG. 32 configured for carrying. FIG. 43 is a front elevation of the portable roller massager of FIG. 32 configured for carrying. FIG. 44 is a cross-section of the portable roller massager of FIG. 32 configured for carrying. As shown in FIG. 42, one end of shaft 3402 is removably secured within handle 3230(1) such that roller sections 3220 and the elongate center section 3210 are at least partially within handle 3230(1). The other handle 3230(2) is removable retained by the opposite end of shaft 3402 such that such that roller sections 3220 and the elongate center section 3210 are also at least partially within handle 3230(2), as shown. Thus, portable roller massager 3200 is compact and easy to carry. This embodiment has the advantage that both handles are similarly sized, making portable roller massager 3200 symmetrical, and that one handle is not required to fit within the other, thereby allowing the handles to be sized to contain the elongate center section 3210, making portable roller massager 3200 more compact than portable roller massager 1700 of FIG. 17, for example.

Hybrid

FIG. 45 is a perspective view illustrating one exemplary portable roller massager 4500 with one detent push-to-connect connection for an inner handle 4540 and a telescoping outer handle 4530, in accordance with an embodiment of the disclosure. FIG. 46 is a front elevation of the portable roller massager 4500 of FIG. 45. FIG. 47 is a cross section through the portable roller massager 4500 of FIG. 45. Outer handle 4530 is similar to outer handle 240 of portable roller massager 200 of FIG. 13, and accordingly outer handle end 4703 of shaft 4702 is configured similar to a corresponding end 211 of shaft 210. An opposite end 4705 of shaft 4702 is configured similar to one end of shaft 1902 of FIG. 19. Accordingly, inner handle 4540 is similar to inner handle 1740 of FIG. 17. Thus, portable roller massager 4500 is a hybrid of portable roller massager 200 and portable roller massager 1700.

FIGS. 48, 49, and 50 shows one exemplary roller section 4520 of the portable roller massager 4500 of FIG. 45. Roller section 4520 is similar to roller section 1720 of FIG. 17 and roller section 3220 of FIG. 32.

FIG. 51 is a cross-section through the inner handle 4540 of the portable roller massager 4500 of FIG. 45. FIG. 52 is a cross-section through the outer handle 4530 of the portable roller massager of FIG. 45. FIG. 53 is a cross-section showing greater detail of the outer handle 4530 of FIG. 52 illustrating groove 5302 for receiving detent 4720 that releasably secures outer handle 4530 to outer handle end 4703 of shaft 4702.

FIG. 54 is a front elevation of the shaft 4702 of the portable roller massager 4500 of FIG. 45. As shown, outer handle end 4703 has a diameter 5412 that fits within outer handle 4530, and a groove 5414 that receives detent 4720. Shaft 4702 also includes a groove 5402 for securing roller stop 4504 that retains roller sections 4520 on shaft 4702. A groove 5408 receives detent 4704.

FIG. 55 is a side elevation of one exemplary roller stop 4504 of the portable roller massager of FIG. 45. FIG. 56 is a front elevation of one exemplary roller stop 4504 of the portable roller massager of FIG. 45. Roller stop 4504 is similar to roller stop 1704 of FIG. 27.

FIG. 57 is a perspective view of the portable roller massager 4500 of FIG. 45 configured for carrying. FIG. 58 is a front elevation of the portable roller massager 4500 of FIG. 45 configured for carrying. FIG. 59 is a cross-section of the portable roller massager 4500 of FIG. 45 configured for carrying. As shown in FIG. 59, one end of shaft 4702 is removably secured within inner handle 4540 such that roller sections 4520 and the elongate center section 4510 are at least partially within inner handle 4540. Outer handle 4530 is retained by the opposite end of shaft 4702 and telescoped closed such that inner handle 4540 is within outer handle 4530, as shown. Thus, portable roller massager 4500 is compact and easy to carry. One advantage of portable roller massager 4500 over portable roller massager 1700 for example is that only inner handle 4540 is separable from shaft 4702 thereby reducing effort in configuring portable roller massager 4500 for use.

Telescoping

FIG. 60 is a perspective view illustrating one exemplary portable roller massager 6000 with telescoping handles 6030 and 6040, in accordance with an embodiment of the disclosure. FIG. 61 is a front elevation of the portable roller massager 6000 of FIG. 60. FIG. 62 is a cross section through the portable roller massager 6000 of FIG. 60. Portable roller massager 6000 is similar to portable roller massager 200 of FIG. 13, however, each end 6002(1) and (2) of shaft 6202 includes detents 6204(1) and (2) that operate to releasably hold outer handle 6030 and inner handle 6040, respectively, in position when both opened or closed. As with portable roller massager 200, handles 6030 and 6040 of portable roller massager 6000 are permanently captured by ends 6002(1) and 6002(2) of shaft 6202, respectively. Inner handle 6040 is shaped to facilitate a user's grip to extract inner handle 6040 and elongate central section 6010 from outer handle 6030.

FIG. 63 is a perspective view of the portable roller massager 6000 of FIG. 60 configured for carrying. FIG. 64 is a front elevation of the portable roller massager 6000 of FIG. 60 configured for carrying. FIG. 65 is a cross-section of the portable roller massager 6000 of FIG. 60 configured for carrying. As shown, when portable roller massager 6000 is telescoped closed, outer handle 6030 is secured in position by detent 6204(1) and inner handle 6040 is secured in position by detent 6204(2). Grip 6050 facilitates telescoping of handles 6030, 6040 in preparation for use. In the closed position, roller sections 6020 and the elongate center section 6010 is at least partially within inner handle 6040. Outer handle 6030 then encloses at least part of inner handle 6040, as shown. Thus, portable roller massager 6000 is compact and easy to carry. Advantageously, handles 6030, 6040 are retained by shaft 6202 and reconnection of handles 6030, 6040 to shaft 6202 is not required, making preparation for use much quicker, as compared to portable massage roller 1700 of FIG. 17 and portable roller massager 3200 of FIG. 32.

Trigger Point Ring Portable Roller Massager

FIG. 66 is a perspective view illustrating one exemplary portable roller massager 6600 with a raised knobbed trigger point ring, detent push-to-connect connection and equal sized handles 6630, in accordance with an embodiment of the disclosure. FIG. 67 is a front elevation of the portable roller massager 6600 of FIG. 66. FIG. 68 is a cross section through the portable roller massager of FIG. 66. Portable roller massager 6600 has an elongate center section 6610 with five roller sections 6620, where a center roller section 6620(3) includes a raised ring 6621 configured with a plurality of knobs 6622. The shaft, elongate center section 6610, roller sections 6620(1), (2), (4), and (5), roller stops 6604, and detents 6804 of portable roller massager 6600 are similar to those of portable roller massagers 1700, 3200 and reference to FIGS. 17-44 and associated description should be made for further details thereon.

Handles 6630 are similar to one another, are interchangeable, and are similar to handles 3230 of portable roller massager 3200 of FIG. 32. A length of handle 6630 is selected such that when both handles are reversed and attached to the shaft in preparation for carrying, the handles 6630 meet raised ring 6621 of center roller section 6620(3), as shown in FIGS. 69, 70, and 71.

FIG. 69 is a perspective view of the portable roller massager 6600 of FIG. 66 configured for carrying. FIG. 70 is a front elevation of the portable roller massager of FIG. 66 configured for carrying. FIG. 71 is a cross-section of the portable roller massager of FIG. 66 configured for carrying. As shown in FIG. 69, one end of shaft 6802 is removably secured within handle 6630(1) such that roller sections 6620 and the elongate center section 6610 are at least partially within handle 6630(1). The other handle 6630(2) is removable retained by the opposite end of shaft 6802 such that such that roller sections 6620 and the elongate center section 6610 are also at least partially within handle 6630(2), as shown. Thus, portable roller massager 6600 is compact and easy to carry. This embodiment has the advantage that center roller section 6620(3) has raised ring 6621 with a plurality of knobs 6622 for accessing trigger points within muscle tissue. Although shown with knobs 6622, raised ring 6621 may have other textures and surface structures without departing from the scope hereof.

The many features and advantages of the disclosure are apparent from the detailed specification, and thus, it is intended by the appended claims to cover all such features and advantages of the disclosure which fall within the true spirit and scope of the disclosure. Further, because numerous modifications and variations will readily occur to those skilled in the art, it is not desired to limit the disclosure to the exact construction and operation illustrated and described, and accordingly, all suitable modifications and equivalents may be resorted to falling within the scope of the disclosure.

FIG. 72 is a perspective view illustrating one exemplary portable roller massager 7200 that is similar to the portable roller massager 3800 of FIG. 68, except that raised ring 7221 has a smooth outer surface 7222, in accordance with an embodiment of the disclosure.

Combinations of Features

Features described above as well as those claimed below may be combined in various ways without departing from the scope hereof. The following examples illustrate possible, non-limiting combinations of features of the inventions described above. It should be clear that many changes and modifications may be made to the systems and methods described above without departing from the spirit and scope of this invention:

(a) A portable roller massager includes: an elongate center shaft having a longitudinal axis extending between a first end and a second end; a roller section rotatably positioned about an outer surface of the elongate center shaft and extending not entirely between the first and second ends; a first handle member movably attachable to the first end of the elongate center shaft; and a second handle member movably attachable to the second end of the elongate center shaft; the elongate center shaft, roller section, first handle member, and second handle member cooperating such that manual operation of the handles causes rotation of the roller section when applied to a body during massage.

(b) In the portable roller massager denoted as (a), when configured for carrying, the first handle member containing at least part of the elongate center shaft and roller section and the second handle member containing at least a part of the first handle member.

(c) In the portable roller massagers denoted as (a) and (b), further including a first connector joining the first handle member to, and alternatively detaching the first handle member from, the first end the elongate center shaft; and a second connector joining the second handle member to, and detaching the second handle member from, the second end of the elongate center shaft.

(d) In the portable roller massager denoted as (c), the first connector and the second connector are thread-to-connect.

(e) In the portable roller massager denoted as (c), the first connector and the second connector are twist-to-connect.

(f) In the portable roller massager denoted as (c), the first connector and the second connector are push-to-connect.

(g) In the portable roller massagers denoted as (c)-(f), at least one of the first and second connectors includes a detent for securing one of the first and second handle members to the elongate center shaft.

(h) In the portable roller massager denoted as (a)-(g), the first handle member is capable of being collapsed to cover at least part of the elongate center shaft; and wherein the second handle member is capable of being collapsed to cover at least part of the first handle member.

(i) In the portable roller massagers denoted as (a) and (b), further including a first connection interface between the first handle member and the elongate center shaft, and a second connection interface between the second handle member and the elongate center shaft.

(j) In the portable roller massagers denoted as (a), (b) and (i), the first connection interface is threaded.

(k) In the portable roller massagers denoted as (a), (b), (i) and (j), the second connection interface is threaded.

(l) In the portable roller massagers denoted as (a), (b) and (i), the first connection interface is snapped.

(m) In the portable roller massagers denoted as (a), (b), (i) and (l), the second connection interface is snapped.

(n) In the portable roller massagers denoted as (a), (b) and (i), the first connection interface is twisted.

(o) In the portable roller massagers denoted as (a), (b), (i) and (n), the second connection interface is twisted.

(p) In the portable roller massagers denoted as (a), (b) and (i), the first connection interface comprises a first detent for removably retaining the first handle member on one end of the elongate center shaft.

(q) In the portable roller massager denoted as (a), (b), (i) and (p), the second connection interface comprises a second detent for removably retaining the second handle member on the other end of the elongate center shaft.

(r) A portable roller massager, including: a shaft having a longitudinal axis extending from a first end to a second end, the first end forming a first groove about the longitudinal axis, the second end forming a second groove about the longitudinal axis; a first detent positioned about the first groove; a second detent positioned about the second groove; a roller section rotatably positioned about an outer surface of the shaft and extending not entirely between the first and second ends of the shaft; a first roller stop positioned on the shaft at the first end and a second roller stop positioned on the shaft at the second end to retain the roller section on the shaft; an outer handle removably attachable to the first end of the shaft and retained by the first detent; and an inner handle removably attachable to the second end of the shaft and retained by the second detent; the shaft, first detent, second detent, roller section, first roller stop, second roller stop, and handles cooperating such that manual operation of the handles causes rotation of the roller section when applied to a body during massage.

(s) In the portable roller massager denoted as (r), when configured for carrying, the inner handle coupling with one end of the shaft and containing at least part of the roller section and the outer handle coupling to the other end of the shaft and containing at least a part of the inner handle.

(t) In the portable roller massagers denoted as (r) and (s), a form of connection for joining one of the first and second handles to, and detaching it from, one of the first or second ends of the shaft is push-to-connect.

(u) In the portable roller massagers denoted as (r)-(t), the first and second detents each comprise an O-ring.

(v) A portable roller massager, including: a shaft having a longitudinal axis extending from a first end to a second end; a roller section rotatably positioned about an outer surface of the shaft and extending not entirely between the first and second ends; a first roller stop positioned on the shaft at the first end and a second roller stop positioned on the shaft at the second end to retain the roller section on the shaft; a first handle removably attachable to the first end of the shaft; and a second handle removably attachable to the second end of the shaft; the shaft, roller section, first roller stop, second roller stop, first handle, and second handle cooperating such that manual operation of the handles causes rotation of the roller section when applied to a body during massage.

(w) In the portable roller massager denoted as (v), when configured for carrying, the first handle coupling with one end of the shaft and containing a first portion of the roller section and the second handle, coupling to the other end of the shaft and containing a second portion of the roller section.

(x) In the portable roller massagers denoted as (v) and (w), a form of connection for joining one of the first and second handles to, and detaching it from, one of the first or second ends of the shaft is push-to-connect.

(y) In the portable roller massagers denoted as (v)-(x), the shaft forming a first groove about the longitudinal axis of the first end and a second groove about the longitudinal axis of the second end, and further including: a first detent positioned about the first groove; and a second detent positioned about the second groove; wherein the first handle is retained by the first detent and the second handle is retained by the second detent.

(z) In the portable roller massagers denoted as (v)-(y), the first and second detents each comprise an O-ring.

(aa) A portable roller massager, including: a shaft having a longitudinal axis extending from a first end to a second end; a roller section rotatably positioned about an outer surface of the shaft and extending not entirely between the first and second ends; a roller stop positioned on the shaft at the first end, the roller stop and shape of the second end retaining the roller section on the shaft; an inner handle movably attachable to the first end of the shaft; and an outer handle retained by the shape of the second end of the shaft; the shaft, roller section, roller stop, and handles cooperating such that manual operation of the handles causes rotation of the roller section when applied to a body during massage.

(ab) In the portable roller massager denoted as (aa), when configured for carrying, the inner handle reversed and attached to the first end of the shaft to cover at least part of the roller section.

(ac) In the portable roller massagers denoted as (aa) and (ab), when configured for carrying, the outer handle sliding to cover at least part of the inner handle.

(ad) In the portable roller massagers denoted as (aa)-(ac), wherein a form of connection for joining the inner handle to, and detaching it from, the first end of the shaft is push-to-connect.

(ae) In the portable roller massager denoted as (ad), the shaft forming a first groove about the longitudinal axis of the first end and a second groove about the longitudinal axis of the second end, and further including: a first detent positioned about the first groove; and a second detent positioned about the second groove; wherein the first handle is retained by the first detent and the second handle is retained by the second detent.

(af) In the portable roller massager denoted as (ae), the first and second detents each comprise an O-ring.

(ag) A portable roller massager, including a shaft having a longitudinal axis extending from a first detent to a second detent; a roller section rotatably positioned about an outer surface of the shaft and extending not entirely between the first and second detents; an inner handle retained by a first shape of a first end of the shaft and secured by the first detent; and an outer handle retained by a second shape of a second end of the shaft and secured in position by the second detent; the shaft, roller section, and handles cooperating such that manual operation of the handles causes rotation of the roller section when applied to a body during massage.

(ah) In the portable roller massager denoted as (ag), when configured for carrying, the inner handle slides to cover at least part of the roller section and the outer handle slides to cover at least part of the inner handle.

(ai) In the portable roller massagers denoted as (ag) and (ah), the first and second ends of the shaft are shaped to retain the roller section.

(aj) In the portable roller massagers denoted as (ag)-(ai), the first and second detents each comprise an O-ring.

(ak) A portable roller massager, including: a shaft having a longitudinal axis extending from a first end to a second end; a roller section rotatably positioned about an outer surface of the shaft, and extending not entirely between the first and second ends; a raised ring optionally having a textured outer surface and positioned centrally to and about the roller section; a first roller stop positioned at the first end and a second roller stop positioned at the second end, wherein the first and second roller stops retain the roller section on the shaft; a first handle removably attachable to the first end; and a second handle removably attachable to the second end; the shaft, roller section, raised ring, first roller stop, second roller stop, first handle, and second handle cooperating such that manual operation of the handles causes rotation of the roller section when applied to a body during massage.

(al) In the portable roller massager denoted as (ak), when configured for carrying, the first handle coupling with one end of the shaft to contain a first portion of the roller section and the second handle coupling to the other end of the shaft to contain a second portion of the roller section.

(am) In the portable roller massagers denoted as (ak)-(al), a form of connection for joining one of the first and second handles to, and detaching it from, one of the first or second ends of the shaft is push-to-connect.

(an) In the portable roller massagers denoted as (ak)-(am), the shaft forming a first groove about the longitudinal axis of the first end and a second groove about the longitudinal axis of the second end, and further including: a first detent positioned about the first groove; and a second detent positioned about the second groove; wherein the first handle is retained by the first detent and the second handle is retained by the second detent.

(ao) In the portable roller massager denoted as (am), the first and second detents each comprise an O-ring.

(ap) A portable roller massager, including: an elongate center shaft having a longitudinal axis extending between a first end and a second end; a roller section rotatably positioned about an outer surface of the elongate center shaft and extending not entirely between the first and second ends; a first handle movably attachable to the first end of the elongate center shaft; and a second handle movably attachable to the second end of the elongate center shaft; the elongate center shaft, roller section, first handle, and second handle cooperating such that manual operation of the handles causes rotation of the roller section when applied to a body during massage.

(aq) In the portable roller massager denoted as (ap), further including a first roller stop positioned on the elongate center shaft at the first end and a second roller stop positioned on the elongate center shaft at the second end to retain the roller section on the elongate center shaft.

(ar) In the portable roller massagers denoted as (ap) and (aq), further including a first connector joining the first handle to, and alternatively detaching the first handle from, the first end the elongate center shaft; and a second connector joining the second handle to, and detaching the second handle from, the second end of the elongate center shaft.

(as) In the portable roller massager denoted as (ar), the first connector comprising a thread-to-connect.

(at) In the portable roller massagers denoted as (ar) and (as), the second connector comprising a thread-to-connect.

(au) In the portable roller massager denoted as (ar), the first connector comprising a twist-to-connect.

(av) In the portable roller massagers denoted as (ar) and (as), the second connector comprising a twist-to-connect.

(aw) In the portable roller massager denoted as (ar), the first connector comprising a push-to-connect.

(ax) In the portable roller massagers denoted as (ar) and (as), the second connector comprising a push-to-connect.

(ay) In the portable roller massagers denoted as (ap)-(ax), the elongate center shaft forming a first groove about the longitudinal axis of the first end and a second groove about the longitudinal axis of the second end, and further including: a first detent positioned about the first groove; and a second detent positioned about the second groove; wherein the first handle is retained by the first detent and the second handle is retained by the second detent.

(az) In the portable roller massager denoted as (ay), the first and second detents each comprise an O-ring.

(ba) In the portable roller massagers denoted as (ap)-(az), when configured for carrying, the first handle containing at least part of the elongate center shaft and roller section and the second handle containing at least part of the elongate center shaft and roller section.

(bb) In the portable roller massagers denoted as (ap)-(ba), when configured for carrying, the first handle is reversed and attached to the first end of the elongate center shaft to cover at least part of the roller section.

(be) In the portable roller massagers denoted as (ap)-(bb), when configured for carrying, the second handle is reversed and attached to the second end of the elongate center shaft to cover at least part of the roller section.

(bd) In the portable roller massagers denoted as (ap)-(bc), further including a raised ring having a textured outer surface and positioned centrally to and about the roller section.

(be) In the portable roller massagers denoted as (ap)-(bc), further comprising a raised ring having a smooth outer surface and positioned centrally to and about the roller section.

(bf) In the portable roller massagers denoted as (ap)-(be), the roller section comprising four individually rotating rollers.

(bg) In the portable roller massagers denoted as (ap)-(be), the roller section comprising five individually rotating rollers.

Changes may be made in the above methods and systems without departing from the scope hereof. It should thus be noted that the matter contained in the above description or shown in the accompanying drawings should be interpreted as illustrative and not in a limiting sense. The following claims are intended to cover all generic and specific features described herein, as well as all statements of the scope of the present method and system, which, as a matter of language, might be said to fall therebetween.

What is claimed is:

1. A portable massage roller, comprising:

a shaft;

first and second handles removably coupled at first and second ends of the shaft, respectively, via respective cooperation with at least one of a plurality of detents of the shaft, each of the first and the second handle including:

a connection end having a first aperture having a first diameter that is larger than a second diameter of the first and the second end of the shaft, respectively, an internal surface of the aperture including a groove for receiving at least one of the plurality of detents, and an open end having a second aperture having a third diameter that is larger than a fourth diameter of an outer surface of a plurality of roller sections, the fourth diameter larger than the first diameter; and the plurality of roller sections rotatably positioned on the shaft between the first and second handle when the first and second handle are respectively coupled at the first and second end of the shaft.

2. The portable massage roller of claim 1, the shaft being cylindrical.

3. The portable massage roller of claim 1, the shaft being a tube or solid rod.

4. The portable massage roller of claim 1, the plurality of roller sections configured to rotate 360 degrees about the shaft.

5. The portable massage roller of claim 1, at least some of the plurality of roller sections having a textured surface.

6. The portable massage roller of claim 1, the detents being O-rings or springs.

7. The portable massage roller of claim 1, the third diameter of each of the first and second handles being the same.

8. The portable massage roller of claim 7, further comprising roller stops, respectively positioned between each of the first and second ends and outer ones of the plurality of roller sections; the roller sections having an inner surface with a fifth diameter larger than the second diameter; the roller stops having a sixth diameter larger than the first diameter and smaller than the third diameter.

9. The portable massage roller of claim 1, the shaft, and each of the first and second handles having respective lengths such that the open ends of each of the first and second handles meet each other when the first and second handles are positioned to cover the plurality of roller sections.

10. The portable massage roller of claim 9, the portable massage roller being symmetrical along a longitudinal axis along a length of the shaft.

11. The portable massage roller of claim 1, the plurality of roller sections including a point ring in a middle of the plurality of roller sections.

12. The portable massage roller of claim 11, the point ring including a raised knobbed ring.

13. The portable massage roller of claim 11, the shaft and the first and second handles being sized and shaped such that the point ring is not covered when the first and second handles are configured to cover others of the plurality of roller sections.

14. The portable massage roller of claim 1, further comprising roller stops, respectively positioned between each of the first and second ends and outer ones of the plurality of roller sections, configured to retain rollers of the plurality of roller sections on the shaft.

15. The portable massage roller of claim 14, the roller stops being removably attached at respective grooves within the shaft.

16. The portable massage roller of claim 1, the first and the second handles being equally sized and shaped such that when the first and the second handles are attached to the shaft in a carrying configuration, an open end of each of the first and second handles meet adjacent the middle of the shaft.

17. The portable massage roller of claim 16, the first and second handles overlapping the plurality of roller sections in the carrying configuration.

18. The portable massage roller of claim 1, the third diameter of the open end of the second handle being larger than an outer diameter of the first handle such that the second handle overlaps the first handle when in a carrying configuration.

19. The portable massage roller of claim 18, the first and second handles overlapping the plurality of roller sections in the carrying configuration.

20. The portable massage roller of claim 1, the third diameter of each of the first and second handles being different.

* * * * *